US011465018B2

(12) United States Patent
Stokke et al.

(10) Patent No.: US 11,465,018 B2
(45) Date of Patent: Oct. 11, 2022

(54) CLUB HEAD SETS WITH VARYING CHARACTERISTICS AND RELATED METHODS

(71) Applicant: KARSTEN MANUFACTURING CORPORATION, Phoenix, AZ (US)

(72) Inventors: Ryan M. Stokke, Anthem, AZ (US); Martin R. Jertson, Cave Creek, AZ (US); Cory S. Bacon, Cave Creek, AZ (US); Travis D. Milleman, Portland, OR (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/981,605

(22) Filed: May 16, 2018

(65) Prior Publication Data

US 2018/0256946 A1 Sep. 13, 2018

Related U.S. Application Data

(63) Continuation-in-part of application No. 15/403,291, filed on Jan. 11, 2017, which is a continuation-in-part (Continued)

(51) Int. Cl.

| | |
|---|---|
| ***A63B 53/00*** | (2015.01) |
| ***A63B 53/04*** | (2015.01) |
| ***A63B 60/00*** | (2015.01) |
| *A63B 60/54* | (2015.01) |
| *A63B 60/02* | (2015.01) |

(52) U.S. Cl.

CPC ..... *A63B 53/04* (2013.01); *A63B 53/047* (2013.01); *A63B 60/00* (2015.10); *A63B 53/005* (2020.08); *A63B 53/0408* (2020.08); *A63B 53/0433* (2020.08); *A63B 53/0454* (2020.08); *A63B 53/0458* (2020.08); *A63B 53/0466* (2013.01); *A63B 53/0487* (2013.01); *A63B 60/02* (2015.10); *A63B 60/54* (2015.10); *A63B 2053/0479* (2013.01); *A63B 2053/0491* (2013.01)

(58) Field of Classification Search

CPC ..... A63B 60/54

USPC ..... 473/350, 344

See application file for complete search history.

(56) References Cited

U.S. PATENT DOCUMENTS 3,863,932 A * 2/1975 Lezatte ..... A63B 53/04 473/342

3,955,820 A 5/1976 Cochran et al.

(Continued)

FOREIGN PATENT DOCUMENTS

| | | |
|---|---|---|
| JP | 09285576 | 11/1997 |
| JP | 10201883 | 8/1998 |
| JP | 2000189545 | 7/2000 |

OTHER PUBLICATIONS

Rick White, Shore Durometer Conversion Chart, uploaded May 29, 2019, Thermal Tech Equipment, 1 page.*

(Continued)

*Primary Examiner* — Eugene L Kim
*Assistant Examiner* — Matthew B Stanczak

(57) ABSTRACT

Embodiments of golf clubs head sets with varying characteristics are disclosed herein. Other examples and related methods are also generally described herein.

19 Claims, 29 Drawing Sheets

Related U.S. Application Data of application No. 14/306,033, filed on Jun. 16, 2014, now Pat. No. 9,849,354, which is a continuation of application No. 13/096,944, filed on Apr. 28, 2011, now Pat. No. 8,753,230, which is a continuation-in-part of application No. 12/791,738, filed on Jun. 1, 2010, now Pat. No. 8,574,094, which is a continuation-in-part of application No. 12/791,734, filed on Jun. 1, 2010, now Pat. No. 8,690,710, which is a continuation-in-part of application No. 12/791,740, filed on Jun. 1, 2010, now Pat. No. 8,657,700, which is a continuation-in-part of application No. 11/828,260, filed on Jul. 25, 2007, now abandoned.

(60) Provisional application No. 62/631,115, filed on Feb. 15, 2018, provisional application No. 62/506,746, filed on May 16, 2017, provisional application No. 62/318,665, filed on Apr. 5, 2016, provisional application No. 62/277,342, filed on Jan. 11, 2016, provisional application No. 61/453,904, filed on Mar. 17, 2011, provisional application No. 61/323,349, filed on Apr. 12, 2010.

(56) References Cited

U.S. PATENT DOCUMENTS 4,681,322 A * 7/1987 Straza ..... A63B 53/0466 473/329
4,754,977 A 7/1988 Sahm
4,826,172 A 5/1989 Antonious
D315,768 S 3/1991 Antonious
5,026,056 A 6/1991 McNally et al.
D319,091 S 8/1991 Antonious
D320,056 S 9/1991 Antonious
5,048,835 A 9/1991 Gorman
D327,308 S 6/1992 Antonious
D327,520 S 6/1992 Antonious
D327,720 S 7/1992 Antonious
D328,116 S 7/1992 Antonious
D329,904 S 9/1992 Gorman
D331,272 S 11/1992 Antonious
5,221,087 A * 6/1993 Fenton ..... A63B 60/00 473/342
5,242,167 A 9/1993 Antonious
5,290,032 A 3/1994 Fenton et al.
5,303,922 A * 4/1994 Lo ..... A63B 53/04 473/330
5,356,138 A 10/1994 Chen et al.
5,390,924 A 2/1995 Antonious
5,395,113 A 3/1995 Antonious
5,439,223 A * 8/1995 Kobayashi ..... A63B 60/00 473/334
5,447,307 A 9/1995 Antonious
5,547,194 A 8/1996 Aizawa et al.
5,595,552 A 1/1997 Wright et al.
5,629,475 A 5/1997 Chastonay
D383,819 S 9/1997 Takahashi
5,669,826 A 9/1997 Chang et al.
5,674,133 A 10/1997 Chang et al.
5,749,794 A * 5/1998 Kobayashi ..... A63B 53/047 473/342
5,792,005 A 8/1998 Sieleman et al.
5,813,919 A 9/1998 Best et al.
5,842,934 A 12/1998 Ezaki et al.
5,873,795 A 2/1999 Wozny et al.
5,921,869 A 7/1999 Blough
5,967,903 A * 10/1999 Cheng ..... A63B 60/00 473/342
5,971,868 A 10/1999 Kosmatka
6,015,354 A 1/2000 Ahn et al.
6,027,415 A 2/2000 Takeda
6,077,173 A 6/2000 Stites
D428,634 S 7/2000 Nagai et al.
6,120,388 A 9/2000 Bough
6,200,228 B1 * 3/2001 Takeda ..... A63B 60/00 473/324
6,210,290 B1 4/2001 Erickson et al.
6,238,302 B1 * 5/2001 Helmstetter ..... A63B 53/047 473/340
D444,195 S 6/2001 Wahl et al.
D445,157 S 7/2001 Jones et al.
6,280,348 B1 8/2001 Stites
6,290,608 B2 9/2001 Gates
D456,056 S 4/2002 Bakke
6,379,262 B1 4/2002 Boone
6,450,897 B2 9/2002 Stites et al.
6,454,665 B2 9/2002 Antonious
6,482,104 B1 11/2002 Gilbert
D476,708 S 7/2003 Wahl et al.
6,709,345 B2 3/2004 Iwata et al.
D489,106 S 4/2004 Wahl et al.
6,773,361 B1 8/2004 Lee
D496,973 S 10/2004 Wahl et al.
D501,035 S 1/2005 Wahl et al.
6,860,819 B2 3/2005 Gilbert
6,921,344 B2 7/2005 Gilbert et al.
6,929,563 B2 * 8/2005 Nishitani ..... A63B 53/047 473/334
6,935,967 B2 8/2005 Mahaffey et al.
6,962,538 B2 11/2005 Roach et al.
D512,757 S 12/2005 Cleveland et al.
D513,423 S 1/2006 Best et al.
D518,539 S 4/2006 Cleveland
7,022,028 B2 4/2006 Nagai et al.
7,112,147 B2 * 9/2006 Solheim ..... A63B 53/0487 473/340
7,160,204 B2 * 1/2007 Huang ..... A63B 53/047 473/342
7,192,362 B2 * 3/2007 Gilbert ..... A63B 53/047 473/291
D547,410 S * 7/2007 Nicolette ..... D21/753
7,244,188 B2 7/2007 Best
D550,316 S 9/2007 Nagai et al.
D554,215 S 10/2007 Ruggiero et al.
D554,217 S 10/2007 Ruggiero et al.
D554,218 S 10/2007 Ruggiero et al.
D562,423 S 2/2008 Foster
D566,803 S 4/2008 Foster et al.
7,374,499 B2 * 5/2008 Jones ..... A63B 53/04 473/340
7,399,238 B2 7/2008 Hocknell
D580,503 S 11/2008 Roach et al.
D585,951 S 2/2009 Kohno
D597,157 S 7/2009 Wallin et al.
7,749,102 B2 7/2010 Nakamura
7,789,771 B2 9/2010 Park et al.
7,789,772 B2 9/2010 Sukman
7,803,064 B2 9/2010 Roach et al.
7,815,523 B2 * 10/2010 Knutson ..... A63B 53/047 473/349
7,935,000 B2 5/2011 Stites
8,021,246 B2 9/2011 Llewllyn et al.
D659,214 S 5/2012 Oldknow
D669,947 S 10/2012 Kim
8,277,337 B2 10/2012 Shimazaki
8,403,774 B2 3/2013 Stites
D680,603 S 4/2013 Nicolette
8,435,132 B2 5/2013 Oldknow et al.
D684,228 S 6/2013 Breier
8,491,405 B2 * 7/2013 Jorgensen ..... A63B 60/00 473/288
8,535,177 B1 * 9/2013 Wahl ..... A63B 60/54 473/350
D791,892 S 7/2017 Stokke
10,363,466 B2 * 7/2019 Petersen ..... A63B 53/08
10,695,629 B2 * 6/2020 Petersen ..... A63B 60/02
11,033,789 B2 * 6/2021 Petersen ..... A63B 53/08
2001/0001774 A1 5/2001 Antonious
2001/0007834 A1 7/2001 Gates
2001/0014628 A1 8/2001 Erickson et al.
2001/0044345 A1 11/2001 Stites et al.

(56) References Cited

U.S. PATENT DOCUMENTS

2002/0068645 A1* 6/2002 Vincent ..... A63B 53/047 473/338
2002/0128088 A1 9/2002 Yializis et al.
2002/0173376 A1 11/2002 Stites et al.
2003/0032499 A1* 2/2003 Wahl ..... A63B 60/02 473/334
2003/0092499 A1 5/2003 Gilbert
2003/0092502 A1 5/2003 Pergande et al.
2003/0139222 A1 7/2003 Vadersen
2003/0199331 A1 10/2003 Stites
2004/0018890 A1 1/2004 Stites et al.
2004/0106466 A1* 6/2004 Wieland ..... A63B 53/047 473/349
2005/0020377 A1 1/2005 Yang et al.
2005/0026716 A1 2/2005 Wahl et al.
2005/0037864 A1 2/2005 Gilbert
2005/0049075 A1* 3/2005 Chen ..... B23K 1/0008 473/338
2005/0064951 A1 3/2005 Stites et al.
2005/0239572 A1* 10/2005 Roach ..... A63B 60/02 473/332
2005/0266932 A1 12/2005 Roach et al.
2006/0025234 A1* 2/2006 Nicolette ..... A63B 60/02 473/334
2006/0052184 A1* 3/2006 Soracco ..... A63B 60/54 473/345
2006/0084527 A1 4/2006 Nycum
2006/0234805 A1 10/2006 Gilbert
2007/0042834 A1* 2/2007 Nicolette ..... A63B 53/047 473/334
2007/0117653 A1 5/2007 Yoneyama
2007/0155534 A1 7/2007 Tsai et al.
2007/0293345 A1* 12/2007 Serrano ..... A63B 53/0487 473/340
2008/0045353 A1 2/2008 Lo et al.
2008/0051220 A1 2/2008 Soracco et al.
2008/0058113 A1 3/2008 Nicolette
2008/0242444 A1 10/2008 Park et al.
2009/0062032 A1 3/2009 Boyd
2009/0105009 A1* 4/2009 Cole ..... A63B 53/065 473/341
2009/0149272 A1 6/2009 Roach et al.
2009/0221382 A1 9/2009 Soracco
2010/0029407 A1* 2/2010 Chick ..... A63B 53/04 473/335
2010/0151960 A1 6/2010 Wahl
2010/0160067 A1 6/2010 Llewellyn et al.
2010/0255923 A1 10/2010 Stites
2010/0267463 A1 10/2010 Stites et al.
2010/0279795 A1 11/2010 Nicolette
2010/0279796 A1 11/2010 Nicolette
2010/0331102 A1* 12/2010 Golden ..... A63B 60/00 473/337
2011/0201444 A1 8/2011 Stokke
2012/0077613 A1 3/2012 Jertson
2012/0289360 A1 11/2012 Breier et al.
2013/0116064 A1 5/2013 Park et al.
2013/0130827 A1 5/2013 Boyd
2013/0310192 A1* 11/2013 Wahl ..... A63B 53/047 473/331
2013/0337938 A1* 12/2013 Stites ..... A63B 60/00 473/338
2014/0080621 A1 3/2014 Nicolette
2015/0024864 A1 1/2015 Jertson
2015/0231458 A1* 8/2015 Petersen ..... A63B 53/047 473/332
2017/0028271 A1* 2/2017 Petersen ..... A63B 53/0475
2017/0120112 A1 5/2017 Stokke
2017/0274253 A1 9/2017 Stokke
2017/0282025 A1* 10/2017 Petersen ..... A63B 53/04

OTHER PUBLICATIONS

Ralph Maltby, Golf Club Design, Fitting, Alteration, & Repair, Jan. 1995, Ralph Maltby Enterprises, Inc., 4th Edition, p. 508.
PCT/US17/12909 filed Jan. 11, 2017 International Search Report and Written Opinion dated Mar. 31, 2017.

* cited by examiner

40000

CLUB HEAD SETS WITH VARYING CHARACTERISTICS AND RELATED METHODS

CROSS-REFERENCE TO RELATED APPLICATIONS

This is a continuation in part of U.S. patent application Ser. No. 15/403,291, filed on Jan. 11, 2017, which is a continuation-in-part of U.S. patent application Ser. No. 14/306,033, now U.S. Pat. No. 9,849,354, filed on Jun. 16, 2014, which is a continuation of U.S. patent application Ser. No. 13/096,944, now U.S. Pat. No. 8,753,230, filed on Apr. 28, 2011, which is a continuation-in-part of U.S. patent application Ser. No. 12/791,738, now U.S. Pat. No. 8,574,094, filed on Jun. 1, 2010, which is a continuation-in-part of U.S. patent application Ser. No. 12/791,734, now U.S. Pat. No. 8,690,710, filed on Jun. 1, 2010, which is a continuation-in-part of U.S. patent application Ser. No. 12/791,740, now U.S. Pat. No. 8,657,700, filed on Jun. 1, 2010, each of which claims the benefit of U.S. Provisional Patent Application No. 61/323,349, filed on Apr. 12, 2010, which is a continuation-in-part of U.S. patent application Ser. No. 11/828,260, now abandoned, filed on Jul. 25, 2007. This also claims the benefit of U.S. Provisional Patent Application No. 61/453,904, filed on Mar. 17, 2011, which claims the benefit of U.S. Provisional Patent Application No. 62/277,342, filed on Jan. 11, 2016, which claims the benefit of U.S. Provisional Patent Application No. 62/318,665, filed on Apr. 5, 2016, which claims the benefit of U.S. Provisional Patent Application No. 62/506,746, filed on May 16, 2017, which claims the benefit of U.S. Provisional Patent Application No. 62/631,115, filed on Feb. 15, 2018. The contents of all of the above described applications are fully incorporated herein by reference.

TECHNICAL FIELD

This disclosure relates generally to sports equipment, and relates more particularly to club heads and related methods.

BACKGROUND

Golf clubs and specifically golf club heads of various designs have typically been developed to improve a person's golf swing and resulting golf shot. In particular, many people are unable to hit or lack consistency when hitting "down" on a ball, that is, to regularly hit the ball squarely. Golf club designs and, particularly, golf club head designs may optimize a golf club head's weighting scheme, such as the golf club head's center of gravity position and moments of inertia. Such designs may mitigate a person's inconsistency problems. Back weighting and/or an additional lower toe weighting may strategically position the center of gravity and may induce the person during his swing to hit "down" on the ball, thus, hitting the ball squarely.

Figure 1:
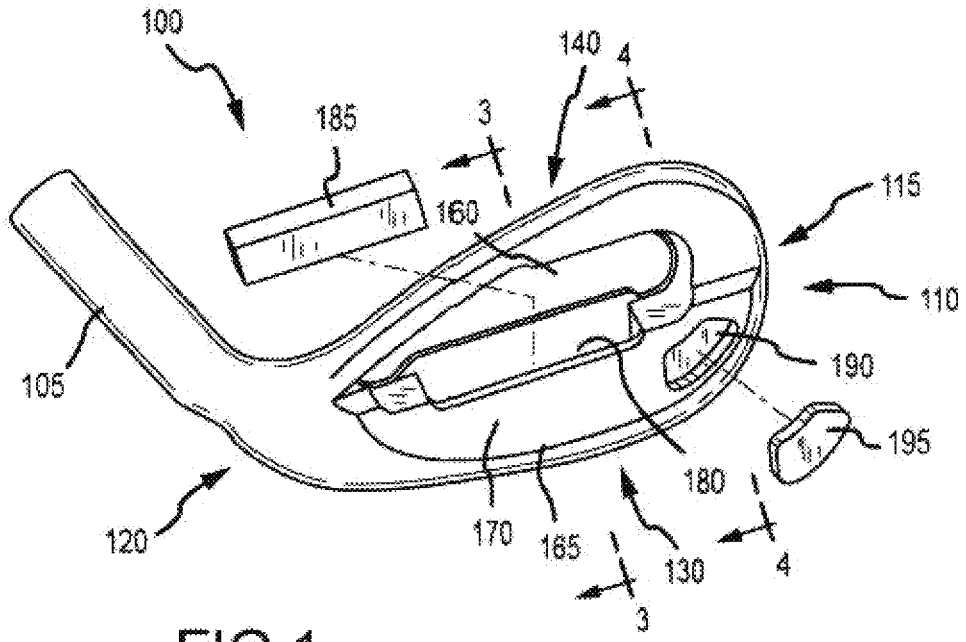
FIG. 1 illustrates an exploded view of an exemplary golf club head according to an embodiment of the golf clubs and methods of manufacture described herein.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf clubs and their methods of manufacture. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs and methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein. The term "coupled," as used herein, is defined as directly or indirectly connected in an electrical, physical, mechanical, or other manner.

DESCRIPTION

Described herein is a golf club head that can comprise an insert mechanically secured within a cavity of the golf club head. In many embodiments, the insert creates a press fit or mechanical interlock between the insert and a protrusion or other structure within the cavity of the golf club head. In some embodiments, the cavity of the golf club head can comprise one or more protrusions to receive one or more grooves of the insert. In these embodiments, the insert can be secured within the cavity by the mechanical interlock between the one or more protrusions, and one or more grooves. Alternatively, a combination of an adhesive, and the mechanical interlock between the one or more protrusions and one or more grooves secures the insert within the cavity. The insert can comprise a softer material with a lower hardness compared to most inserts positioned within the cavity of the golf club head to maximize strikeface deflection. The insert with the softer material provides less support behind the strike face during golf ball impacts. The hardness of the insert can range from Shore A 10 to Shore A 55. The contact area of the insert with the back face increases due to the softer insert material to provide more support behind the strike face during golf ball impacts. An insert height measured from the top surface of the back portion to the apex of the insert further provides more insert surface area behind the strike face. The increase in contact area between the insert and the back face allows for a thinner strikeface. The lower hardness of the insert, the thinner strikeface, and the increase in contact area between the insert and the back face of the golf club head maximizes the strikeface deflection while reducing the stress experienced by the golf club head during golf ball impacts.

In one embodiment of the golf clubs and methods of manufacture described herein, a golf club head comprises a body having a toe region, a heel region opposite the toe region, a sole region, and a top region opposite the sole region. The golf club head further comprises a front face, a first back opposite the front face, a second back opposite the front face and extending farther from the front face than the first back. The second back extends from the heel region to the toe region, and extends from the sole region to about a midpoint between the sole region and the top region. The golf cub head further comprises a first cavity between the first back and the second back, and a second cavity integral with the second back at the toe region. This embodiment may further comprise a first weight that is inserted in the first cavity and a second weight inserted in the second cavity.

In another embodiment of golf clubs and methods of manufacture, a golf club head comprises a body comprising a front face, a heel region, a toe region opposite the heel region, and a sole. The sole extends from the heel region to the toe region, and the sole extends from the front face to a back sole edge. The golf club head further comprises a top opposite the sole, and a first back opposite the front face and substantially parallel to the front face. The first back extends from the heel region to the toe region, and extends from a midpoint between the sole and the top, to the top. The golf club head further comprises a second back opposite the front face extending from the back sole edge to about the midpoint. The golf club head further comprises a rectangular first cavity between the second back and the front face, and a second cavity integral with the second back at the toe region. This embodiment may further comprise a first weight that is inserted in the first cavity and a second weight inserted in the second cavity.

In another embodiment of golf clubs and methods of manufacture, a golf club comprises a golf club head described herein and coupled to a shaft. The golf club further comprises a hosel ratio of 0.75 wherein, the hosel ratio comprises a hosel distance to a front face distance. The hosel distance extends from a point at the heel region to a second end opposite the first end, and the front face distance comprises a distance measured along the front face from the point to a toe edge and substantially parallel to the sole. The golf club may further comprise a first weight to occupy the first cavity and a second weight to occupy the second cavity.

In an embodiment of golf clubs and methods of manufacture, a method for manufacturing a golf club head comprises providing a body having a toe region, a heel region opposite the toe region, a sole region, and a top region opposite the sole region. This embodiment further comprises a front face, a first back opposite the front face, a second back opposite the front face and extending farther from the front face than the first back. The second back extends from the heel region to the toe region, and extends from the sole region to about a midpoint between the sole region and the top region. The body is further provided to comprise a first cavity between the first back and the second back, and a second cavity integral with the second back at the toe region. This embodiment may further comprise providing a first weight that is inserted in the first cavity and providing a second weight inserted in the second cavity.

There can be examples in accordance with the present disclosure where a club head set can comprise two or more club heads, each comprising a loft angle, a front face, a back face opposite the front face, and one or more support bars protruded from the back face. The loft angle can be incrementally varied across the two or more club heads, and a characteristic of the one or more support bars is incrementally varied across the two or more club heads as the loft angle is incrementally varied across the two or more club heads.

There also can be examples in accordance with the present disclosure where a club head set can comprise first and second club heads. The first club head can comprise a first loft angle, a first front face, and a first back portion comprising a first heel region, a first toe region, a first back face opposite the first front face and extended between the first heel and toe regions, and one or more first support bars coupled to the first back face. The second club head can comprise a second loft angle, a second front face, and a second back portion comprising a second heel region, a second toe region, a second back face opposite the second front face and extended between the second head and toe regions, and one or more second support bars coupled to the second back face. In such examples, the first loft angle is greater than the second loft angle, and an attribute of the one or more first support bars is greater than an attribute of the one or more second support bars.

There also can be examples in accordance with the present disclosure where a method can comprise providing a club head set. Providing the club head set can comprise providing a first club head, the first club head comprising a first loft angle, a first front face, and a first back portion comprising, a first heel region, a first toe region, a first back face opposite the first front face and extended between the first heel and toe regions, and one or more first support bars coupled to the first back face, the one or more first support bars comprising a first support bar characteristic. Providing the club head set can also comprise providing a second club head, the second club head comprising a second loft angle, a second front face and a second back portion comprising a second heel region, a second toe region, a second back face opposite the second front face and extended between the second heel and toe regions, and one or more second support bars coupled to the second back face, the one or more second support bars comprising a second support bar characteristic. In such examples, providing the first club head comprises providing the first loft angle to be greater than the second loft angle, and providing the first support bar characteristic to be greater than the second support bar characteristic.

There also can be examples in accordance with the present disclosure where a club head set can comprise two or more club heads, each comprising a loft angle, a front face, and a backside comprising a back face opposite the front face, and a weight located only at a lower toe section of the backside. In such examples, the loft angle can be varied across the two or more club heads, a first characteristic of the weight can be varied across the two or more club heads, a second characteristic of the weight can be varied across the two or more club heads, and the first and second characteristics can be inversely varied relative to each other.

There also can be examples in accordance with the present disclosure where a club head set can comprise first and second club heads. The first club head can comprise a first loft angle, a first front face, and a first back portion that comprises a first heel region, a first toe region comprising a first lower toe section, and a first back face opposite the first front face and extended between the first heel and first toe regions. The second club head can comprise a second loft angle, a second front face, and a second back portion that comprises a second heel region, a second toe region comprising a second lower toe section, and a second back face opposite the second front face and extended between the second heel and second toe regions. The first club head can also comprise a first weight at the first lower toe section of the first toe region, and the second club head can also comprise a second weight at the second lower toe section of the second toe region. In such examples, the first loft angle can be greater than the second loft angle, the first and second weights can comprise substantially similar masses, the first and second weights each comprise first dimensions corresponding to each other, and the first and second weights each comprise second dimensions corresponding to each other. When the first dimension of the first weight is greater than the first dimension of the second weight, the second dimension of the second weight can be greater than the second dimension of the first weight. When the second dimension of the first weight is greater than the second dimension of the second weight, the first dimension of the second weight can be greater than the first dimension of the first weight.

There also can be examples in accordance with the present disclosure where a method can comprise providing a club head set. Providing the club head set can comprise providing a first club head of the club head set, and providing a second club head of the club head set. The first club head can comprise a first loft angle, a first front face, and a first back portion comprising a first back face opposite the first front face and extended between heel and toe regions of the first back portion and a first lower toe section comprising a first cavity. The second club head can comprise a second loft angle, a second front face, and a second back portion comprising a second back face opposite the second front face and extended between heel and toe regions of the second back portion, and a second lower toe section comprising a second cavity. Providing the first club head can comprise providing a first weight at the first cavity, and providing the first loft angle to be greater than the second loft angle. Providing the second club head can comprise providing a second weight at the second cavity. Providing the first weight can comprise providing a first length, a first width, and a first depth of the first weight. Providing the second weight can comprises providing a second length and a second width of the second weight such that at least one of the second length of the second weight is greater than the first length of the first weight, or the second width of the second weight is greater than the first width of the first weight. Providing the second weight can also comprise providing a second depth of the second weight such that the first depth of the first weight is greater than the second depth of the second weight.

There also can be examples in accordance with the present disclosure where a golf club head can comprise a front face and a back portion. The back portion can comprise a heel region, a toe region, a center region between the heel and toe regions, a back end extended between the heel and toe regions, and a cavity. The cavity can comprise a cavity heel zone, a cavity toe zone, a cavity center zone between the cavity heel and toe zones, a cavity inner section located towards the front face, and a cavity outer section located towards the back end. The cavity can be wider at the cavity center zone than at the cavity heel and toe zones.

There also can be examples in accordance with the present disclosure where a method can comprise providing an insert for a golf club head and/or providing a body of a club head. Providing the insert can comprise providing insert heel and toe zones, and providing an insert center zone between the insert heel and toe zones that is thicker than the insert heel and toe zones. Providing the body can comprise providing a back face and a back end at a back portion of the body, and providing a cavity between the back face and the back end. The cavity can comprise a cavity inner section adjacent to the back face, a cavity outer section opposite the back end, cavity heel and toe zones, and a cavity center zone between the cavity heel and toe zones that is thicker than the cavity heel and toe zones. The insert can be provided to be at least partially housed in the cavity.

There also can be examples in accordance with the present disclosure where a golf club head can comprise a back portion of a body of the club head, and an insert. The back portion can comprise a heel region, a toe region, a center region between the heel and toe regions, a back surface opposite the front face and extended between the heel and toe regions, a back wall extended between the heel and toe regions, and a cavity located between the back surface and the back wall. The cavity can comprise a cavity heel zone, a cavity toe zone, a cavity center zone between the cavity heel and toe zones, a cavity inner wall comprising a portion of the back surface, and a cavity outer wall located opposite the back wall. The insert can comprise an insert heel zone, an insert toe zone, an insert center zone between the insert heel and toe zones, an insert inner wall complementary to the cavity inner wall, and an insert outer wall complementary to the cavity outer wall. The golf club head can comprise a moment of inertia about the center region. The insert can be configured to be at least partially housed in the cavity. The cavity can be wider, from the cavity inner wall to the cavity outer wall, at the cavity center zone than at the cavity heel and toe zones. The insert can be wider, from the insert inner wall to the insert outer wall, at the insert center zone than at the insert heel and toe zones. A distribution of mass of the cavity inner wall can be concentrated at the cavity center zone. A distribution of mass of the insert can be shifted away from the insert heel and toe zones and towards the insert center zone. A density of a body of the golf club head can be greater than a density of the insert. A first portion of the moment of inertia contributed by the body of the club head at the cavity heel and toe zones can be greater than a second portion of the moment of inertia contributed by the insert at the insert heel and toe zones. The insert heel and toe zones can be obtusely angled relative to each other about the insert center zone and along the insert inner wall. The cavity inner wall can be obtusely angled complementarily to the insert inner wall. The insert can comprise a grip portion to aid during removal of the insert from the cavity, where the grip portion can be configured to remain external to the cavity when the insert is housed in the cavity.

There also can be examples in accordance with the present disclosure where a golf club head set can comprise a first club head comprising a first strike face, a first back face opposite the first strike face, a first top end, a first bottom end opposite the first top end, a first toe end, a first toe region comprising the first toe end, a first heel end opposite the first toe end, a first heel region comprising the first heel end, and a first vertical axis extended substantially perpendicularly through the first top end and the first bottom ends, and extended between the first heel and first toe regions. The first back face can comprise a first cavity located at the toe region and comprising a first cavity base and a first cavity wall bounding at least a portion of the first cavity base. The first back face can also comprise a first bar comprising a first bar axis extending along a length of the first bar. The first bar can be protruded from the first cavity base and extend diagonally, relative to the first vertical axis, across at least a first portion of the first cavity. The first bar axis can intersect the first vertical axis and extend therefrom towards the first toe end and the first top end.

There also can be examples in accordance with the present disclosure where a golf club head set can comprise a first club head comprising a first strike face, a first back face opposite the first strike face, a first top end, a first bottom end opposite the first top end, a first toe end, a first toe region comprising the first toe end, a first heel end opposite the first toe end, a first heel region comprising the first heel end, and a first vertical axis extended substantially perpendicularly through the first top end and the first bottom end and extended between the first heel region and the first toe region. The first back face can comprise a first cavity located at the toe region and comprising a first cavity base and a first cavity wall bounding the first cavity base. The first back face can also comprise a first bar protruded from the first cavity base, angled at a first bar angle relative to the first vertical axis, and extending across the first cavity. The first back face can also comprise a first hourglass support protruded from the first back face and comprising top and bottom portions a middle portion narrower than the top and bottom portions, and heel and toe sidewalls defining the top, middle, and bottom portions of the first hourglass support therebetween. The toe sidewall of the first hourglass support can protrude above the first cavity base. The first cavity wall can comprise the toe sidewall of the first hourglass support.

There also can be examples in accordance with the present disclosure where a method for providing a golf club head set can comprise providing a first club head of one or more club heads comprising diagonal stabilizing bars. A first vertical axis can extend through a first top end and a first bottom end of the first club head, and between a first heel region and a first toe region of the first club head. Providing the first club head can comprise providing a first back face opposite a first strike face of the first club head, providing a first cavity at the first back face and the first toe region, and providing a first bar within and protruded from the first cavity. The first bar can comprise a first bar axis extending along a length of the first bar. The diagonal stabilizing bars of the one or more club heads can comprise the first bar. Providing the first cavity can comprise providing a first cavity base, and providing a first cavity wall bounding the first cavity base. Providing the first bar can comprise aligning the first bar diagonally at a first bar angle relative to the first vertical axis such that the first bar axis intersects the first vertical axis and extends therefrom towards a first toe end and the first top end of the first club head.

Some embodiments include a golf club head. The golf club head comprises a strike face, a back face opposite the strike face, a top end, a bottom end opposite the top end, a toe end, a toe region comprising the toe end, a heel end opposite the toe end, and a heel region comprising the heel end. Further, the golf club head comprises a vertical axis. The vertical axis extends substantially perpendicularly to a horizontal centerline of the back face, is located approximately mid-way between the toe end and the heel end, extends through the top end and the bottom end, and demarcates the heel region from the toe region. Further still, the golf club head comprises a perimeter weight at the back face extending away from the strike face and along at least the top end and the bottom end of the club head. Also, the golf club head comprises an hourglass support at the back face traversing the vertical axis and extending between the perimeter weight at the top end and the perimeter weight at the bottom end. The hourglass support comprises top and bottom hourglass portions, a middle hourglass portion narrower than the top and bottom hourglass portions, and heel and toe hourglass sidewalls defining the top, middle, and bottom hourglass portions of the hourglass support therebetween. In these embodiments, the middle hourglass portion can be located above the horizontal centerline to raise a center of gravity of the golf club head, and/or the top hourglass portion can be wider and/or thicker than the bottom hourglass portion to raise the center of gravity of the golf club head. Further in these or other embodiments, the golf club head can be part of a set of golf club heads.

In another embodiment of golf clubs and methods of manufacture, a golf club comprises a golf club head having a top region, a sole region opposite the top region, a toe region, a heel region opposite the toe region, a support structure having a central support bar and a bottom support bar, a strike face having a front face and a back face opposite the front face, wherein a thinnest portion of the strike face has a thickness less than or equal to approximately 0.080 inches, measured as the minimum perpendicular distance from the front face to the back face of the strike face, and a cavity configured to receive an insert, wherein the contact area of the insert with the back face comprises 20%-45% of the surface area of the front face.

In some embodiments, the central support bar has a width that increases from near the top region to near the sole region, and the bottom support bar has a height that decreases from near the center to near the heel region and the toe region of the club head.

In some embodiments, the strike face of the club head can further comprise a central zone comprising a portion of the strike face reinforced by the central support bar, a heel zone comprising a portion of the strike face devoid of reinforcement from the support structure near the heel region of the club head, a toe zone comprising a portion of the strike face devoid of reinforcement from the support structure near the toe region of the club head, a perimeter zone comprising a portion of the strike face surrounding the central zone, the heel zone, the toe zone, and the bottom support bar, wherein the thickness of the strike face in the heel zone is approximately the same as the thickness of the strike face in the toe zone, the thickness of the strike face in the heel zone and the toe zone is less than the thickness of the strike face in the central zone, and the thickness of the strike face in the central zone is less than the thickness of the strike face in the perimeter zone.

In some embodiments, the cavity of the club head can comprise a volume ranging from approximately 4.5 cc to approximately 5.0 cc. In some embodiments, the cavity of the club head can comprise a volume greater than or equal to approximately 4.0 cc.

In some embodiments, the insert can extend past the opening of the cavity adjacent to the back face by a distance of approximately 0.15 inches to 0.20 inches. In some embodiments, the insert can extend past the opening of the cavity adjacent to the back face by a distance less than or equal to approximately 0.25 inches.

In some embodiments, the moment of inertia of the club head about the x-axis extending through the center of gravity of the club head from the heel region to the toe region is greater than or equal to approximately 80 $g \cdot in^2$. In some embodiments, the moment of inertia of the club head about the y-axis extending through the center of gravity of the club head from the top region to the sole region is greater than or equal to approximately 350 $g \cdot in^2$.

Other examples and embodiments are further disclosed herein. Such examples and embodiments may be found in the figures, in the claims, and/or in the description of the present application.

Figure 2:
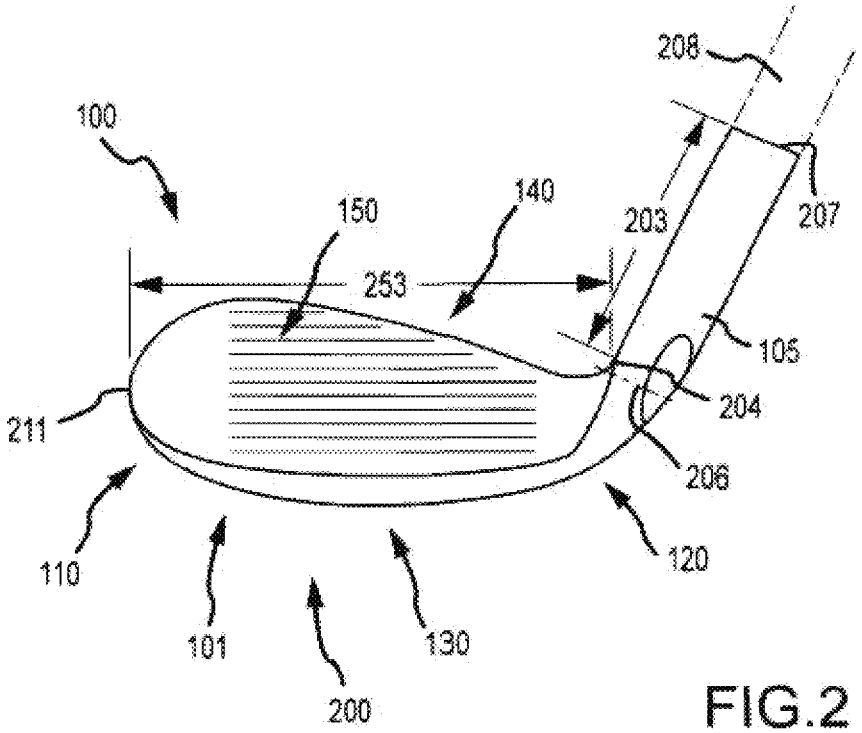
FIG. 2 illustrates a front view of the exemplary golf club head of FIG. 1.

Turning now to the figures, FIG. 1 illustrates a rear, exploded perspective view of an exemplary golf club head 100 according to an embodiment of golf clubs and methods of manufacture, and FIG. 2 illustrates a front view of the golf club head 100. In one embodiment of the golf clubs and methods of manufacture described herein, the golf club head 100 comprises a body 101 having a toe region 110, a heel region 120 opposite the toe region 110, a hosel 105 at the heel region 120, a sole region 130, and a top region 140 opposite the sole region 130. The sole region 130 may extend from the heel region 120 to the toe region 110, and the sole region 130 may extend from a front face 250 (FIG. 2) to a back sole edge 165. In a different embodiment, the golf club head 100 may have a bore (not shown), instead of the hosel 105, at the heel region 120.

Figure 5:
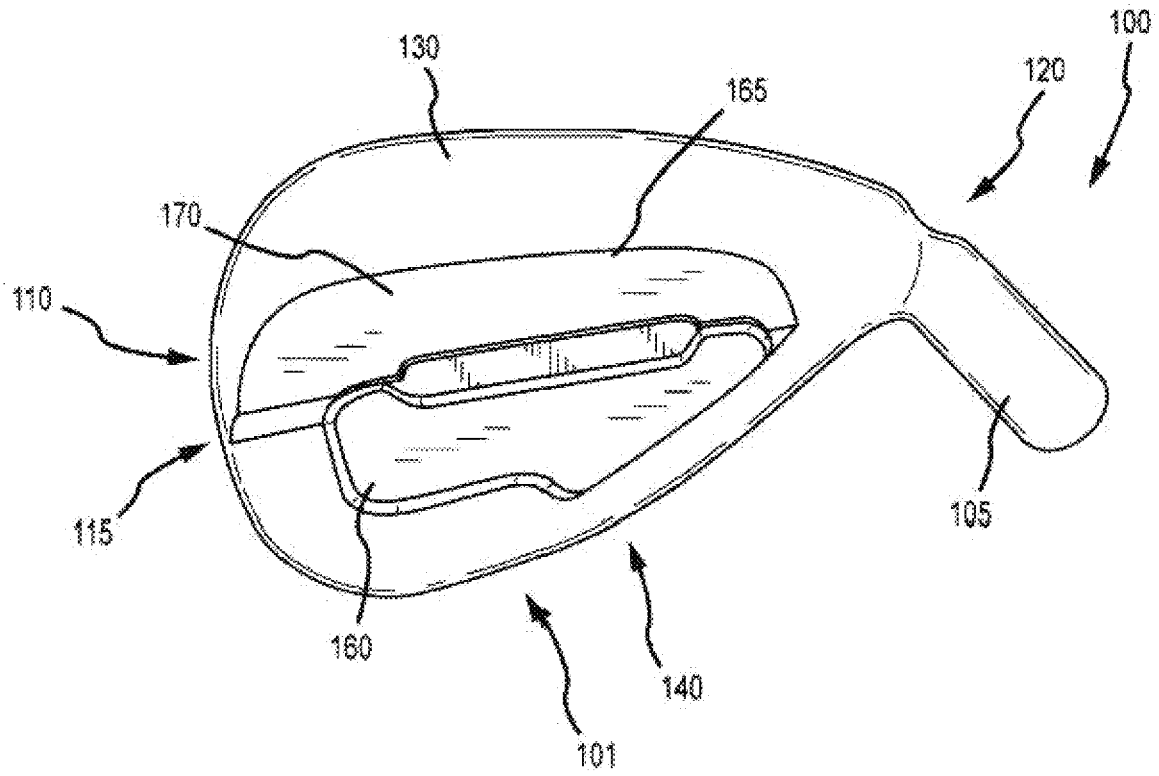
FIG. 5 illustrates a perspective view of the exemplary golf club head of FIG. 1.

The golf club head 100 further comprises a first back 160 (FIG. 1) opposite the front face 250 (FIG. 2), a second back 170 (FIG. 1) opposite the front face 250 (FIG. 2) and extending farther from the front face 250 (FIG. 2) than the first back 160 (FIG. 1), as explained in more detail hereinafter. The first back 160 may be substantially parallel to the front face 250 (FIG. 2) and the first back 160 may extend from the heel region 120 to the toe region 110. The first back 160 may also extend from the sole 130 to a midpoint 115 (FIG. 1) between the sole region 130 and the top region 140, and may further extend from the midpoint 115 to the top region 140. The second back 170 (FIG. 1) may extend from the heel region 120 to the toe region 110, and may extend from the sole region 130 to about the midpoint 115 (FIG. 1)

between the sole region 130 and the top region 140, as can be seen in FIGS. 1 and 5. In a different embodiment, back face 170 (FIG. 1) may extend from the sole region 130 beyond the midpoint 115, or the back face 170 may extend from the sole region 130 below the midpoint 115.

Figure 3:
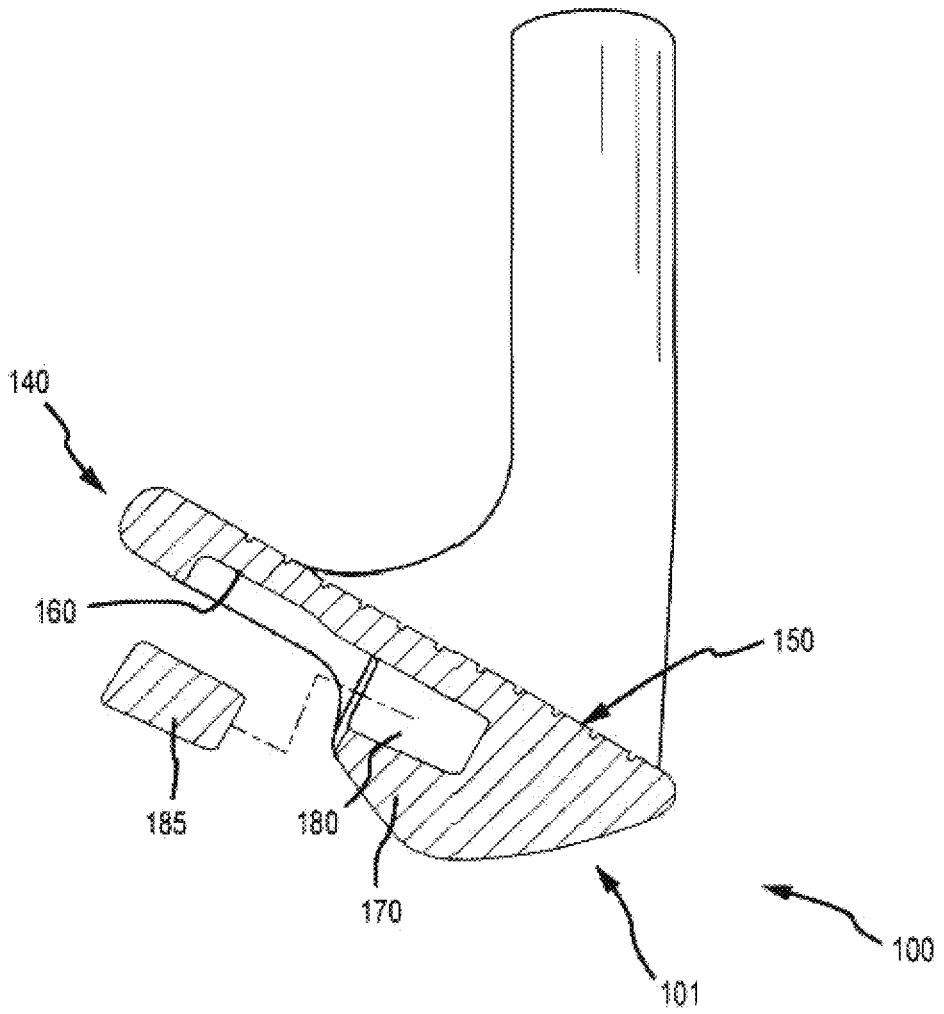
FIG. 3 illustrates an exploded, cross-sectional view of the exemplary golf club head, taken from a section line 3-3 in FIG. 1.

As illustrated in FIGS. 1 and 3, the golf club head 100 further comprises a first cavity 180 between the first back 160 and the second back 170. As illustrated in FIG. 3, the first cavity 180 separates the first back 160 from the second back 170, and vice versa. According to the various embodiments described herein, the golf clubs and methods of manufacture comprise the first cavity 180 to have a rectangular shape, but other configurations are contemplated. For example, the first cavity 180 may comprise an irregular shape, or a different regular shape, for example, triangular, circular, octagonal, hexagonal, and the like. In another example, the first cavity 180 may comprise a symmetrical shape or an asymmetrical shape. Moreover, the first cavity 180 may comprise various dimensions.

Figure 4:
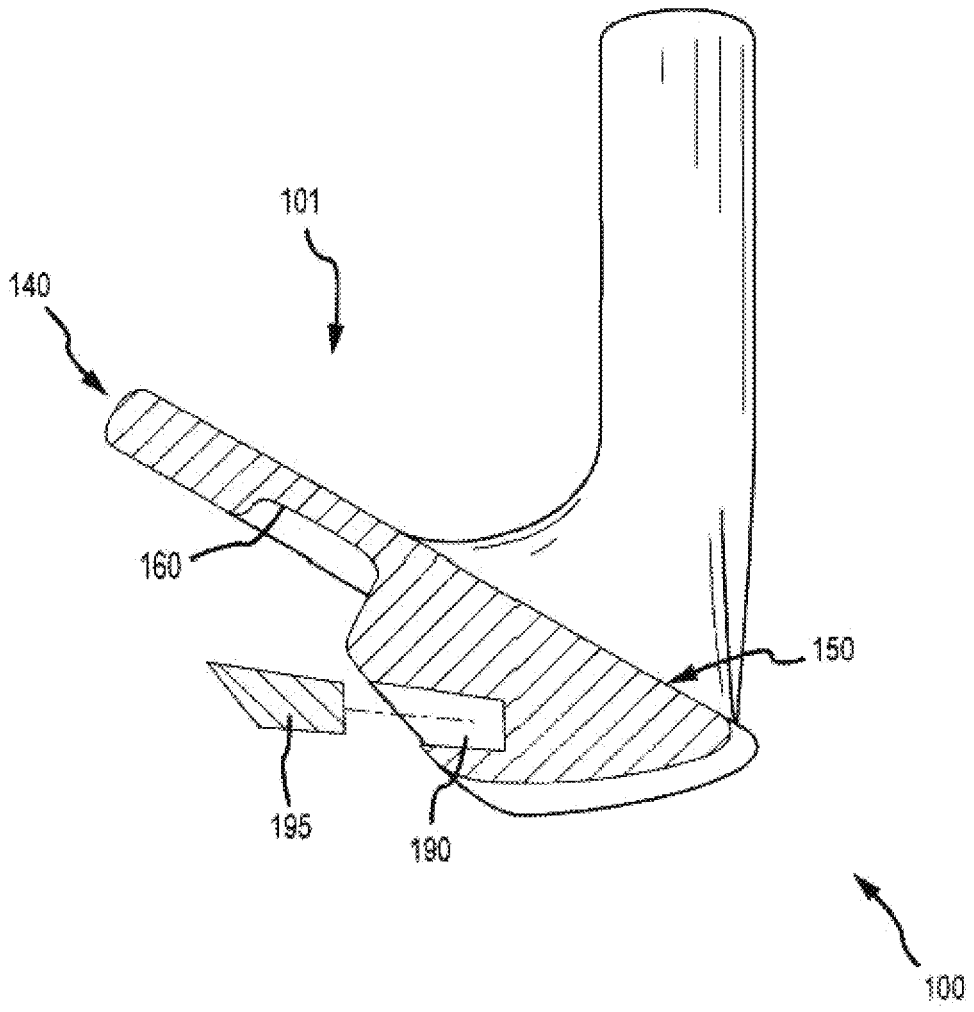
FIG. 4 illustrates an exploded, cross-sectional view of the exemplary golf club head, taken from a section line 4-4 in FIG. 1.

As illustrated in FIGS. 1 and 4, the golf club head 100 also comprises a second cavity 190 integral with the second back 170 at the lower toe region 110. Similar to the first cavity 180, the second cavity 190 may also comprise various shape and dimensional configurations. The shape and dimensional of the first cavity 180 and the second cavity 190 may be determined by the variables that optimize the utility of the golf club head 100, and to adjust the moments of inertia, the center of gravity, and the like. Also, the golf clubs and methods of manufacture described herein, may further comprise cavities that vary in volume, and the volume may depend upon the desired design of the golf club head. Although the above examples may describe two cavities (e.g., the first and second cavities 180 and 190), the golf clubs and methods of manufacture described herein may include additional cavities.

This embodiment of golf club head 100 may further comprises a first weight 185 that is inserted in the first cavity 180 and a second weight 195 that is inserted in the second cavity 190. According to the various embodiments described herein, first weight 185 and second weight 195 may comprise various shapes and dimensional configurations. For example, the first weight 185 and the second weight 195 may comprise shapes and dimensions that are complimentary to the respective cavities into which they are inserted (e.g., the first and second cavities 180 and 190, respectively). In another example, the first weight 185 and the second weight 195 may comprise shapes that only partially occupy the cavities into which they are inserted, or the first weight 185 and the second weight 195 may comprise shapes that overfill the first and second cavities 180 and 190, respectively. The first weight 185 and the second weight 195 can comprise various materials. In one embodiment, the first weight 185 comprises a metal matrix material. In another embodiment, the first weight 185 comprises a polymer, and may be either a thermoset or thermoplastic polymer. First weight 185 may comprise a specific gravity of approximately 1 g/cm$^3$ (grams per cubed centimeter) to approximately 9 g/cm$^3$ in some examples. The second weight 195 may comprise a metal, and may be either a single elemental metal such as iron, or a metal alloy, such as tungsten or titanium alloy. In this embodiment, the first weight 185 comprises a metal matrix material because it generally provides the ability to adjust the back weighting more so than the lightest, or least dense metal or metal alloy, and the second weight 195 comprises a metal because an outer toe weight may be beneficial to induce a golfer to swing "downwardly" and "outwardly." In another embodiment, the first weight 185 and the second weight 195 may comprise of the same material, such as a polymer, a composite, a metal, or a metal alloy. The body 101 can comprise standard golf club head materials such as iron, iron alloys, titanium alloys, and the like, and the first weight 185 and the second weight 195 can comprise the same or different materials as the body 101. As with the shape determination for the first and second cavities, the material determination may be similarly dependant upon the variables that maximize the utility of the golf club head, and other material configurations other than those specifically described are contemplated.

In another embodiment of golf clubs and methods of manufacture, and with reference to FIG. 2 a golf club 200 comprises the golf club head 100 coupled to a shaft 208. In this embodiment, the golf club 200 may further comprise a hosel ratio of 0.75. The hosel ratio comprises a hosel distance 203 to a front face distance 253. The hosel distance 203 measures from a first end 206 at about the heel region 120 to a second end 207 opposite the first end 206. The first end 206 is located at a point 204 where a linear portion of the hosel 105 begins to curve into the front face 250. The front face distance 253 comprises the distance measured along the front face 250 from the point 204 to a toe edge 211 and substantially parallel to the sole 130. The golf club 200 may further comprise, for example as shown in FIG. 1, the first weight 185 to occupy the first cavity 180 and the second weight 195 to occupy the second cavity 190.

The golf club 200, as described herein with the cavities and inserted weights of the golf club head 100, provides for an exemplary golf club that assists a golfer to improve his or her golf swing by allowing for customization of the back weight and toe weight in the club head 100. Furthermore, among the various embodiments described herein, the golf clubs and their methods of manufacture may be for irons, drivers, fairway woods, hybrids, putter, and or other suitable types of clubs.

In an embodiment of golf clubs and methods of manufacture, a method 600 for manufacturing a golf club head comprises providing a golf club head (a block 610). The golf club head of the block 610 may be similar to the golf club head 100 shown in FIGS. 1-5. Method 600 further comprises determining a first weight (a block 620), securing the first weight in a first cavity (a block 630), determining a second weight (a block 640), and securing the second weight in a second cavity (a block 650). As an example, the first weight of the block 620 may be similar to the first weight 185 of FIG. 1, and the second weight of the block 640 may be similar to the second weight 195 of FIG. 1.

Furthermore, the determining step in the block 620 may include having a professional golf technician analyze a golfer's swing. Depending on the swing analyzed by the professional golf technician, a lighter or heavier weight may be determined. Similarly, the determining step in the block 640 may likewise include determining whether to use a lighter or heavier weight based upon analysis of a golfers swing by a professional golf technician. In addition or alternatively, software, firmware, and/or hardware may be used to determine the first weight (e.g., monitor, measure, and/or analyze various parameters associated with an individual's golf swing).

In an embodiment of golf clubs and methods of manufacture, a method 700 for manufacturing a golf club, comprises providing a golf club head (the block 610), determining a first weight (the block 620), securing the first weight in a first cavity (the block 630), determining a second weight (the block 640), securing the second weight in a second cavity (the block 650), and coupling the body to a golf club shaft (a block 760). As an example, the shaft of the block 760 may be similar to the shaft 208 of FIG. 2. Also, the coupling step of the block 760 can include taping, adhering, welding, swaging, or other suitable techniques.

According to the method embodiments described herein, the method for securing the first and/or second weight(s) comprises any process to secure the weights in their respective cavities. For example, if either of the weights comprises a polymer material, then the weights may be glued and/or secured by an adhesive. If, for example, either of the weights is made of metal, then the weights may be similarly glued or secured by an adhesive, and additionally may be secured by any other known method for securing a metal within a cavity, such as welding, swaging, and the like.

Figure 6:
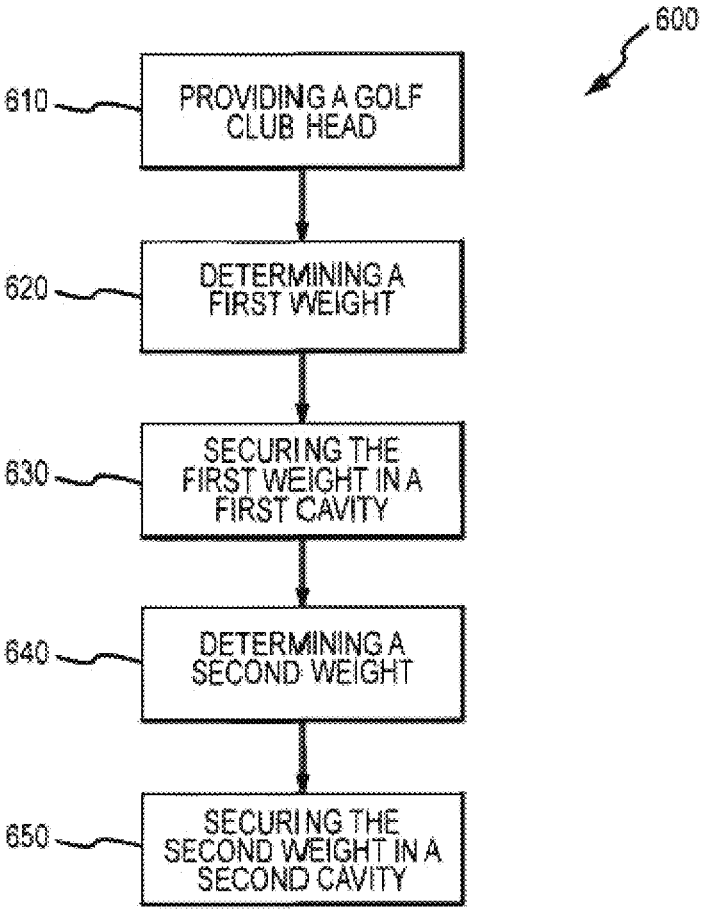
FIG. 6 depicts a flow diagram representation of one manner in which a golf club head may be manufactured.
Figure 7:
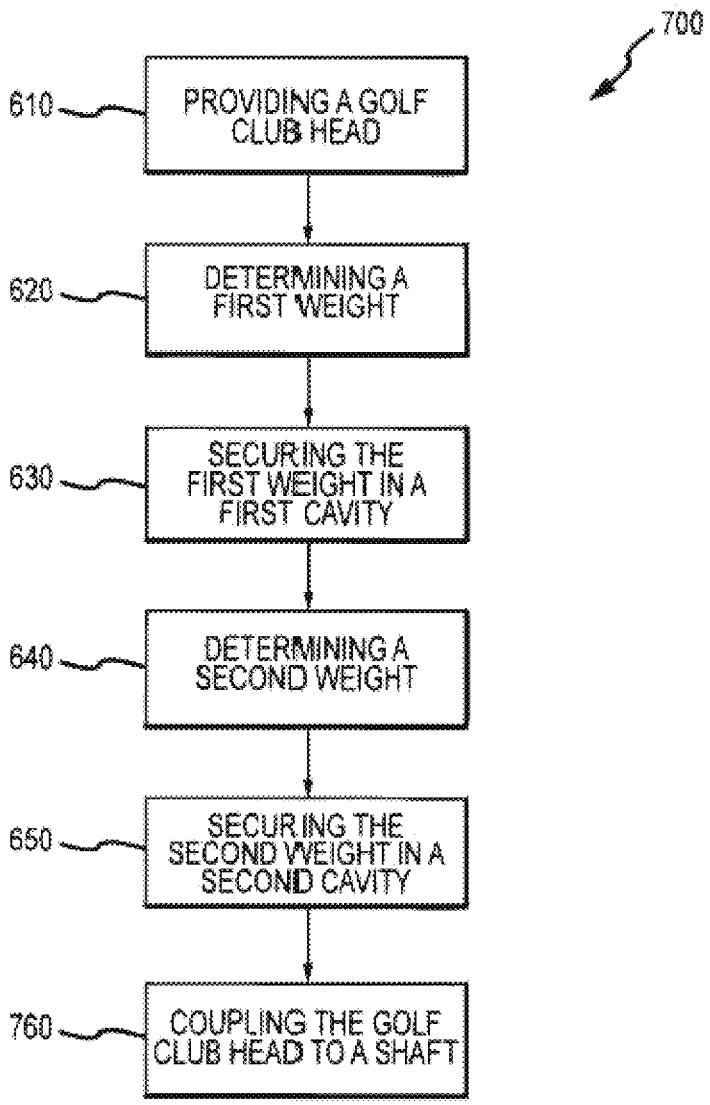
FIG. 7 depicts a flow diagram representation of one manner in which a golf club may be manufactured.

Although a particular order of actions is illustrated in FIGS. 6 and 7, these actions may be performed in other temporal sequences. For example, the actions depicted in FIGS. 6 and 7 may be performed sequentially, concurrently, or simultaneously. Also, the blocks 640 and 650 can be performed before the blocks 620 and 630, and the blocks 620 and 640 may be performed before the blocks 630 and 650.

The providing steps in the described methods of FIGS. 6 and 7 may include designing and/or manufacturing a golf club head. As an example, body 100 in FIG. 5 may be manufactured using a metal casting process. Furthermore, the described methods may be used to manufacture the other aspects of body 100 described with reference to FIGS. 1-5.

Figure 8:
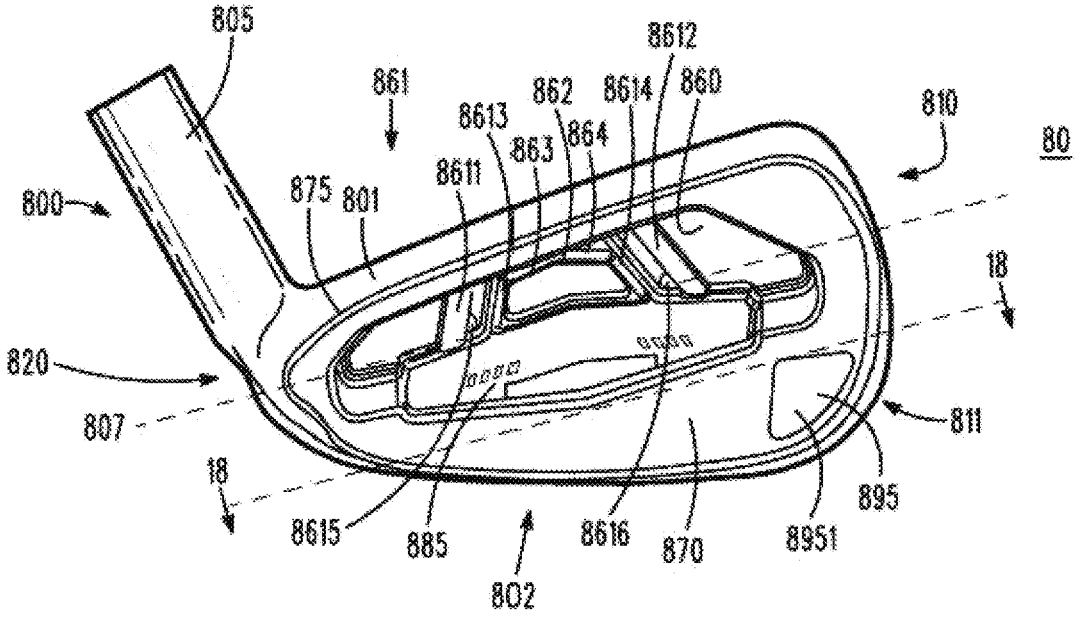
FIG. 8 presents a rear view of a club head of a club head set with varying characteristics according to an embodiment of the golf clubs and methods of manufacture described herein.
Figure 9:
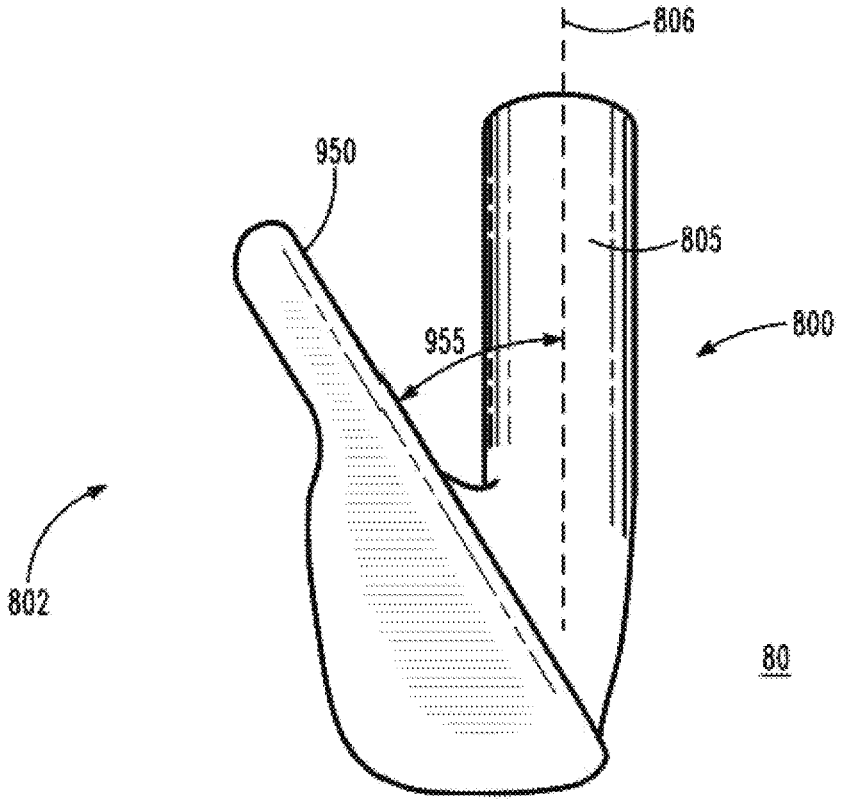
FIG. 9 presents a toe side view of the club head of FIG. 8.
Figure 10:
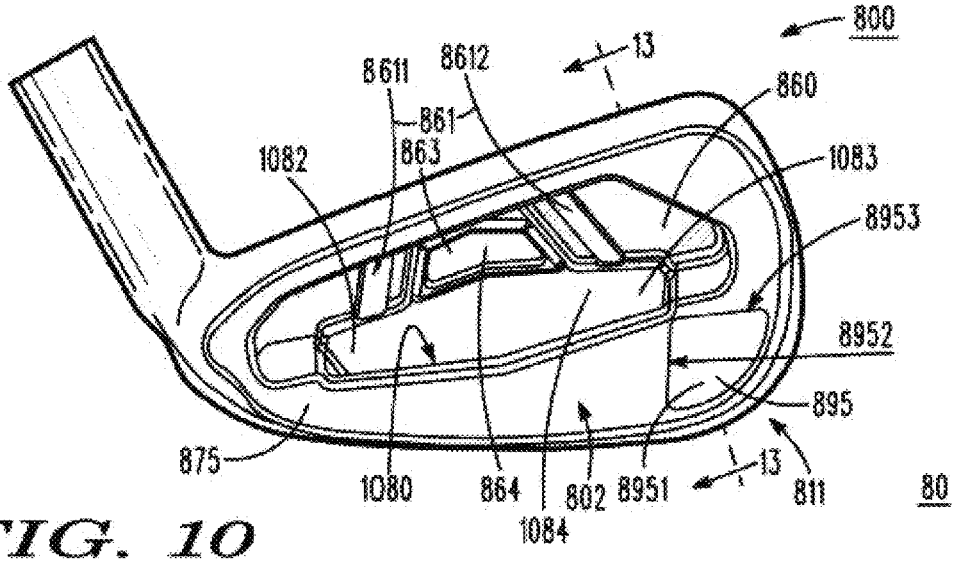
FIG. 10 illustrates a rear view of a body of the club head of FIG. 8, where the club head is in a disassembled state.

Continuing with the figures, FIG. 8 presents a rear view of club head 800 of club head set 80 according to an embodiment of the golf clubs and methods of manufacture described herein. FIG. 9 presents a toe side view of club head 800. FIG. 10 illustrates a rear view of body 801 of club head 800, where club head 800 is in a disassembled state. Club head 800 is similar to club head 100 (FIGS. 1-5), and comprises loft angle 955 (FIG. 9) between front face 950 (FIG. 9) and shaft bore axis 806. In the present example of FIG. 9, shaft bore axis 806 is defined by a bore of hosel 805, but there can be other hosel-less examples where shaft bore axis 806 could be defined by a shaft bore at a heel of a club head body. In the present example of FIG. 8, club head 800 also comprises back portion 802 comprising back face 860 opposite front face 950 (FIG. 9) and extended between toe region 810 and heel region 820 of back portion 802. In some embodiments, back portion 802 can also be referred to as a back side of club head 800. Club head 800 also comprises inserts 885 and 895 in the present embodiment. Insert 885 can be similar to weight 185 (FIGS. 1, 3), and can be inserted at back portion 802 into a cavity 1080 (FIG. 10) similar to cavity 180 of club head 100 (FIGS. 1, 3, 5). Lower toe insert 895 can be similar to weight 195 of club head 100 (FIGS. 1, 4). Club head 800 comprises part of club head set 80 of two or more golf clubs, as will be further discussed below.

Club head 800 also comprises insert 862 located at insert base 863 at a center of back face 860 in the present embodiment. As shown in FIG. 8, insert 862 comprises a logo or other identifying characteristic related to club head 800. There can be embodiments where insert 862 can comprise materials such as those described for weight 185 and/or weight 195 in FIGS. 1, 3, and 4, such as to have an effect on sound, vibration, frequency, and/or mass distribution of club head 800.

Club head 800 differs from club head 100 (FIGS. 1-5) by comprising support bars 861 coupled to back face 860 astride of, and equidistant from, center region 864. Support bars 861 comprise support bars 8611 at heel region 820, and support bar 8612 at toe region 810, both protruding from back face 860. There can be other examples, however, with a different number and/or different arrangement of support bars. For example, additional support bars may be positioned between support bar 8611 and the heel end of heel region 820. Similarly, additional support bars may be positioned between support bar 8612 and the toe end of toe region 810. In some examples, insert base 863 may be considered as also comprising one or more support bars. For example, base ends 8613 and 8614 of insert base 863 can also be considered in some examples as support bars protruding from back face 860. In addition, there can be examples where insert base 863 is protruding from back face 860, such that insert base 863 may itself be considered a support bar.

In the present embodiment, support bars 8611 and 8612 comprise substantially the same support bar width. In the same or other embodiments, the support bar width can be of approximately 0.03 inches (0.75 millimeters) to approximately 0.5 inches (12.7) millimeters). Although the support bar width is constant for both support bars 8611 and 8612 in the example of FIG. 8, there can be other examples where the support bar width tapers or otherwise varies along a length of a support bar similar to support bar 8611 and/or 8612. In addition, although the support bar thickness also is constant for support bars 861 in the present example, there also can be examples where the support bar thickness can taper or otherwise vary, as measured from back face 860, along a length of a support bar similar to support bar 8611 and/or 8612.

Support bars 861 are integral with back face 860 in the present embodiment by comprising part of the same piece of material. For example, support bars 861 can be cast, forged, or machined along with back face 860. There can be other embodiments where support bars may not be integral with their respective back faces, but are securely attached thereto. In such examples, the support bars can be welded, brazed, epoxied, or otherwise adhered to the back faces.

In the present embodiment, support bar 8611 comprises angle 8615 facing center region 864 and measured from horizontal axis 807. Similarly, support bar 8612 also comprises angle 8616 facing center region 864 and measured from horizontal axis 807. Horizontal axis 807 is an axis bisecting club 800 into an upper half and a lower half. There can be embodiments where angles 8615 and/or 8616 comprise acute angles of approximately 30 degrees to approximately 90 degrees from horizontal axis 807. In the same or other embodiments, support bars 8611 and 8612 are angled for convergence towards center region 864. There can also be embodiments where angles 8615 and/or 8616 can be obtuse and/or of approximately 90 degrees to approximately 150 degrees from horizontal axis 807. Angles 8615 and 8616 both comprise approximately 68 degrees in the example of FIG. 8, but there can be other embodiments where angles 8615 and 8616 are not equal to each other, and/or where at least one of angles 8615 and/or 8616 are not acute relative to center region 864. Angles 8615 and/or 8616 may remain constant across the different club heads of club head set 80, or they may vary within the same club head set from club head to club head.

Figure 18:
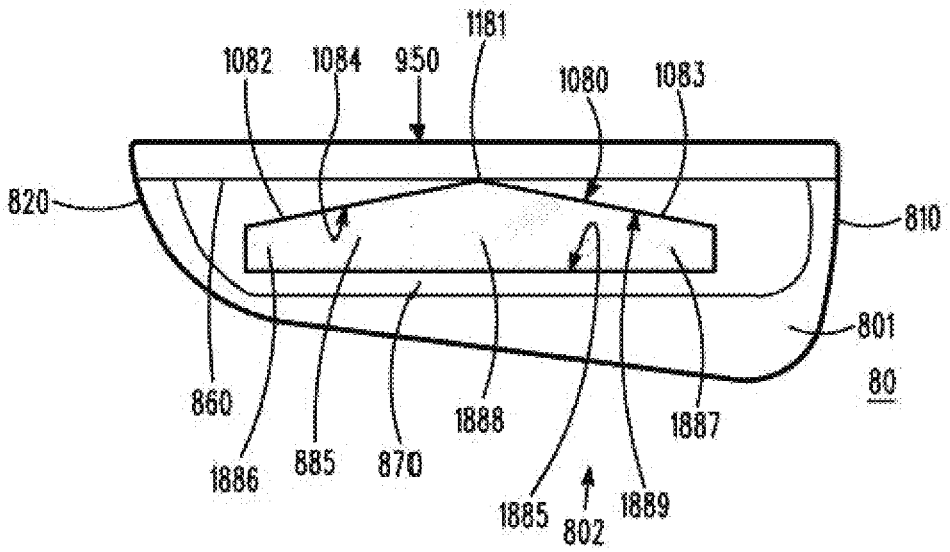
FIG. 18 illustrates a cross-sectional view of the club head of FIG. 8 along line 18-18 from FIG. 8.

FIG. 10 illustrates a rear view of body 801 of club head 800 in a disassembled state. Skipping ahead in the figures, FIG. 18 illustrates a cross-sectional view of club head 800 along line 18-18 from FIG. 8. Note that, for simplicity, details about lower toe insert 895 have been left out of FIG. 18, but insert 885 is shown as inserted into cavity 1080. As seen in FIGS. 8, 10, and 18, back portion 802 of club head 800 comprises back end 870 extended between heel region 820 and toe region 810, where back end 870 can be similar to second back 170 of club head 100 (FIGS. 1, 3-5). In some examples, back end 870 can be referred to as a back wall. Cavity 1080 is also located at back portion 802, between back face 860 and back end 870, and comprises cavity heel zone 1082, cavity toe zone 1083, cavity center zone 1181, cavity inner section 1084 located towards front face 950, and cavity outer section 1885 located towards back end 870. In the present example, cavity inner section 1084 is located opposite back face 860, and cavity outer section 1885 is located opposite back end 870. In the present embodiment, as seen in FIG. 18, cavity 1080 is wider at cavity center zone 1181 than at either of cavity heel zone 1082 or cavity toe zone 1083. For example, cavity inner section 1084 is thinner, relative to front face 950, at cavity center zone 1181 than at either of cavity heel zone 1082 or cavity toe zone 1083. In some examples, cavity inner section 1084 can be referred to as a cavity inner wall, and/or cavity outer section 1885 can be referred to as a cavity outer wall.

In the present example, a distance between front face 950 and an exposed surface of cavity inner section 1084 is greater at cavity heel zone 1082 and at cavity toe zone 1083 than at cavity center zone 1181. There can also be embodiments where a distance between back end 870 and an exposed surface of cavity outer section 1885 can be greater at cavity heel zone 1082 and at cavity toe zone 1083 than at cavity center zone 1181.

Insert 885 comprises insert heel zone 1886, insert toe zone 1887, and insert center zone 1888 in the present embodiment, and is shaped complementarily to cavity 1080 such that insert center zone 1888 is thicker than either of insert heel zone 1886 or insert toe zone 1887. In the example of FIG. 18, insert heel and toe zones 1886 and 1887 are obtusely angled relative to each other along insert inner wall 1889 and about insert center zone 1888. Similarly, cavity inner section 1084 is obtusely angled complementarily to insert inner wall 1889. In the present example, cavity 1080 is configured such that insert 885 is insertable in a top-to-sole direction with respect to club head 800. There can also be examples where insert 885 can be interchangeable with other inserts of similar shape.

In some examples, a material of body 801 of club head 800 can comprise a specific gravity of at least approximately 5.0 g/cm$^3$, and/or a material of insert 885 can comprise a specific gravity of at least approximately 1.2 g/cm$^3$. In the same or other examples, a mass of insert 885 can be of approximately 10 grams.

The dimension relationships described above for and between cavity 1080 and insert 885 can be beneficial, for example, to permit adjustments in the distribution of mass for club head 800. In the present embodiment, where a material of insert 885 is less dense than a material of body 801 of club head 800, the greater thickness of cavity inner section 1084 at cavity heel zone 1082 and at cavity toe zone 1083, relative to cavity center zone 1181, and the greater thickness of insert center zone 1888 relative to insert heel zone 1886 and insert toe zone 1887, can permit a redistribution of mass away from a center of club head 800 and towards heel and toe regions 820 and 810. As an example, a distribution of mass of cavity inner section 1084 is shifted towards heel region 820 and towards toe region 810 and away from cavity center zone 1181. Also, a distribution of mass of insert 885 is concentrated at insert center zone 1888 and diminishes towards insert heel zone 1886 and towards insert toe zone 1887.

Such distributions of mass can augment the moment of inertia about a center region of club head 800, and improve gameplay by reducing club head twisting during off-center impacts. For example, due to the shapes and configurations described above, a portion of the moment of inertia contributed by cavity inner section 1084 at cavity heel zone 1082 and at cavity toe zone 1083 is greater than a portion of the moment of inertia contributed by insert 885 at insert heel zone 1886 and at insert toe zone 1887. Other shape and/or density relationships between insert 885 and cavity 1080 may be used to achieve different desired distributions of mass or moments of inertia in other embodiments.

As shown in FIGS. 8 and 18, insert 885 is partially housed in cavity 1080, such that a grip portion of insert 885 protrudes outside cavity 1080 to allow or facilitate, for example, insertion or removal of insert 885 to or from cavity 1080. In other embodiments, however, insert 885 need not protrude from cavity 1080. Support bars 861 also extend from back face 860 to cavity inner section 1084 in the present embodiment, and cavity inner section 1084 is at least as thick as support bars 861, relative to back face 860, so as to prevent support bars 861 from interfering with the insertion or removal of insert 885 into or out of cavity 1080.

Figure 11:
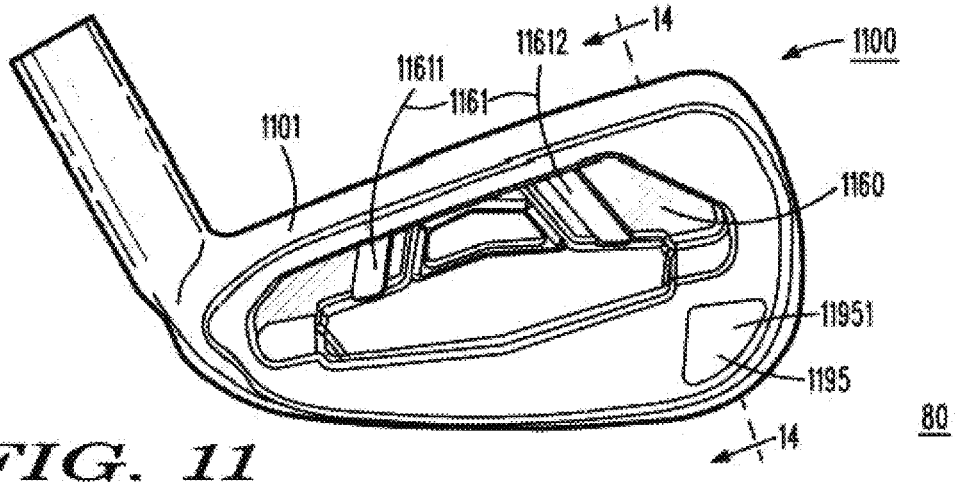
FIG. 11 illustrates a rear view of a body of another club head of the club head set of the club head of FIG. 8, where the club head is in a disassembled state.
Figure 12:
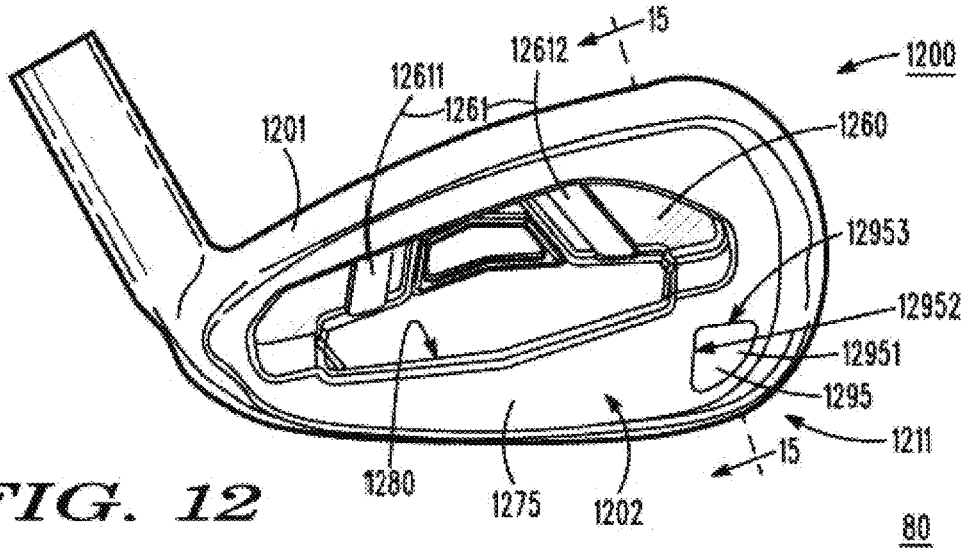
FIG. 12 illustrates a rear view of a body of yet another club head of the club head set of the club head of FIG. 8, where the club head s in a disassembled state.
Figure 15:
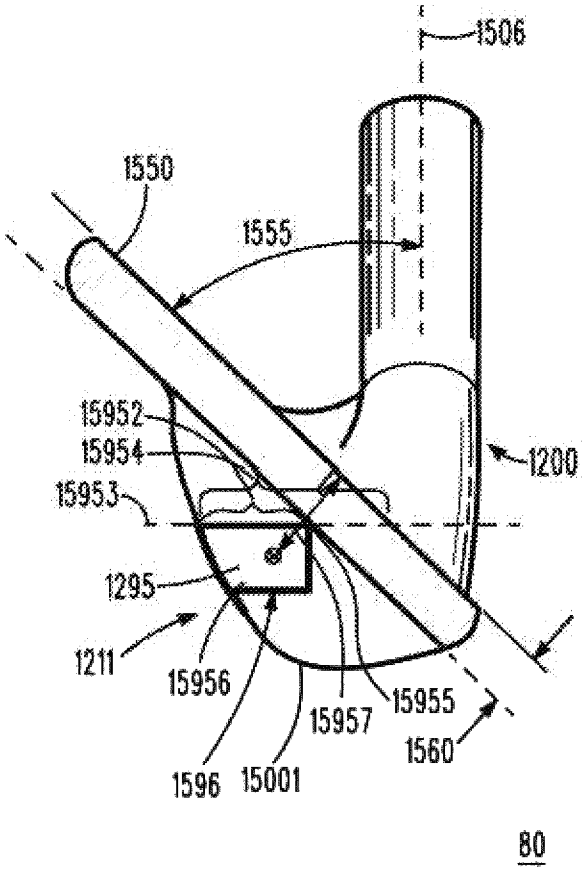
FIG. 15 illustrates a cross-sectional view of the club head of FIG. 12 along a line 15-15 of FIG. 12.
Figure 14:
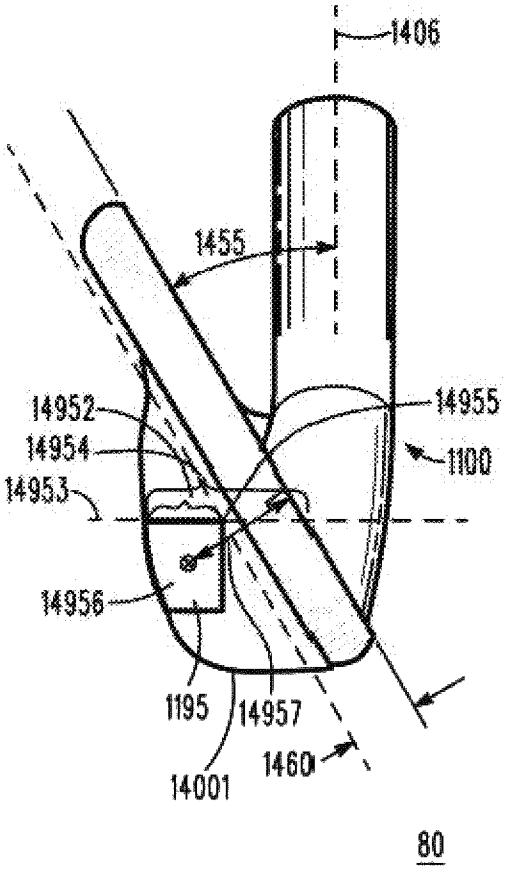
FIG. 14 illustrates a cross-sectional view of the club head of FIG. 11 along a line 14-14 of FIG. 11.
Figure 13:
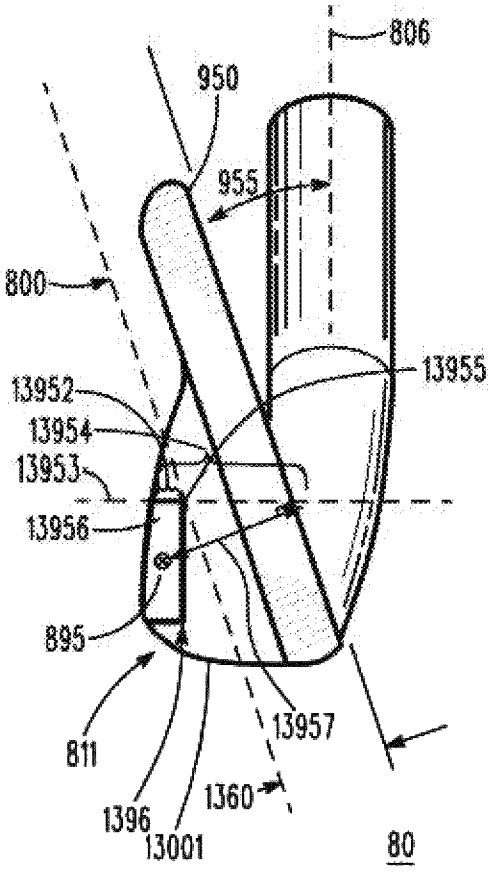
FIG. 13 illustrates a cross-sectional view of the club head of FIGS. 8 and 10 along a line 13-13 of FIG. 10.

Backtracking through the figures, FIGS. 10-15 illustrate several views of exemplary club heads of club head set 80. FIG. 10 illustrates a rear view of body 801 of club head 800, where club head 800 is in a disassembled state. FIG. 11 illustrates a rear view of body 1101 of club head 1100 of club head set 80, where club head 1100 is in a disassembled state. FIG. 12 illustrates a rear view of body 1201 of club head 1200 of club head set 80, where club head 1200 is in a disassembled state. FIG. 13 illustrates a cross-sectional view of club head 800 along a line 13-13 of FIG. 10. FIG. 14 illustrates a cross-sectional view of club head 1100 along a line 14-14 of FIG. 11. FIG. 15 illustrates a cross-sectional view of club head 1200 along a line 15-15 of FIG. 12. Club heads 800, 1100, and 1200 can be similar to each other, as detailed below.

In the present example, club heads 800, 1100, and 1200 form part of club head set 80 of related golf clubs, where club head set 80 can comprise two or more club heads. Only club heads 800, 1100, and 1200 of club head set 80 are shown in FIGS. 10-12 for simplicity, but club head set 80 can comprise more than three club heads. There also can be other embodiments where club head set 80 can comprise only two club heads. Each club head of club head set 80 comprises one or more support bars protruded from their respective back faces. For example, as seen in FIGS. 8 and 10, club head 800 comprises support bars 861, including support bars 8611 and 8612 protruded from back face 860, as detailed above. As seen in FIG. 11, club head 1100 comprises support bars 1161, namely, support bars 11611 and 11612, protruded from back face 1160. In addition, as seen in FIG. 12, club head 1200 comprises support bars 1261, namely, support bars 12611 and 12612, protruded from back face 1260.

In the present example, the loft angles of the club heads of club head set 80 are incrementally varied across the two or more club heads. For instance, in the present example of club head set 80, club head 800 comprises a 2-iron club head with loft angle 955 (FIG. 9) of approximately 18.5 degrees between front face 950 and shaft bore axis 806, (FIG. 13); club head 1100 comprises a 6-iron club head with loft angle 1455 of approximately 30.5 degrees between front face 1450 and shaft bore axis 1406 (FIG. 14); and club head 1200 comprises a wedge-iron club head with loft angle 1555 of approximately 47 degrees between front face 1550 and shaft bore axis 1506 (FIG. 15). As a result, the loft angle 1555 of club head 1200 is greater than loft angle 1455 of club head 1100, which, in turn, is greater than loft angle 955 of club head 800.

Also in the present example, a characteristic of the one or more support bars is incrementally varied across the two or more club heads according to the loft angle. For instance, loft angle 1555 is greater than loft angle 1455 as discussed above, and accordingly, an attribute of support bars 1261 of golf club 1200 (FIG. 12) is greater than an attribute of support bars 1161 of golf club 1100 (FIG. 11). In the present example, the attribute of the support bars that undergoes variation is the support bar width, such that support bars 1261 (FIG. 12) are wider than support bars 1161 (FIG. 11), and support bars 1161 (FIG. 11) are wider than support bars 861 (FIG. 10).

Figure 16:
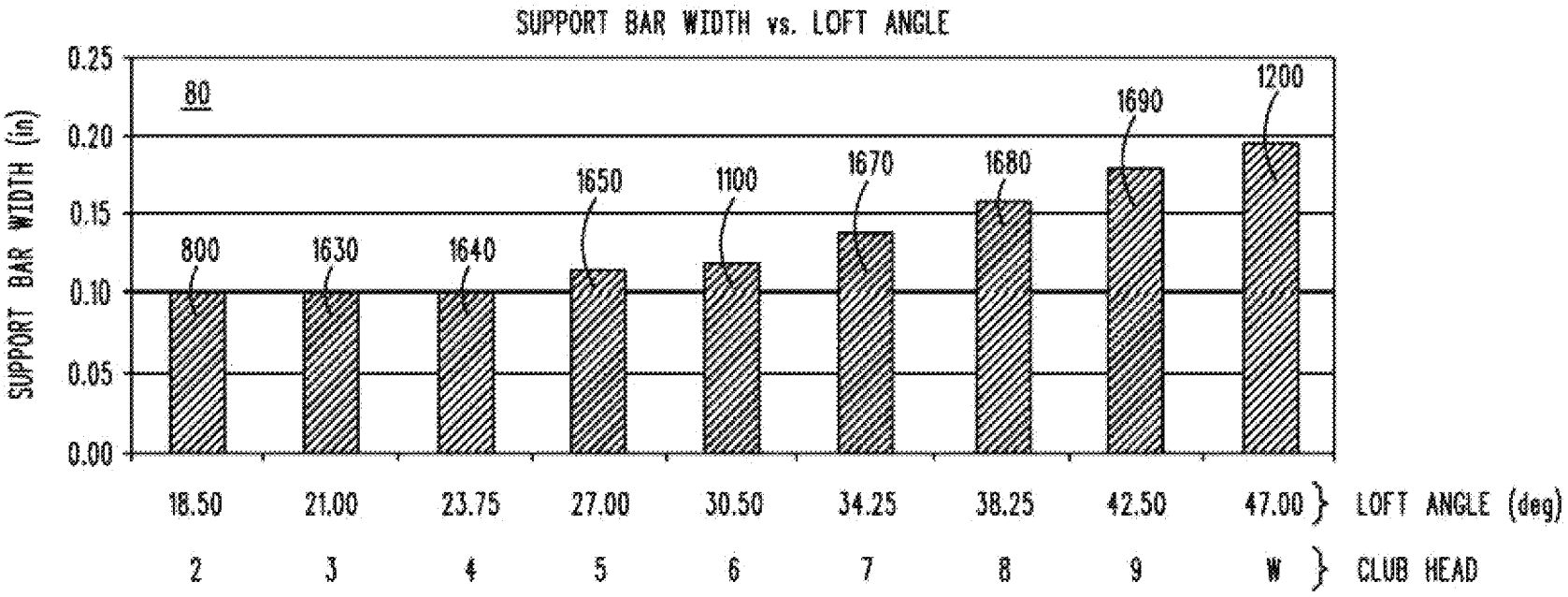
FIG. 16 illustrates a chart of an exemplary relationship between support bar width relative to loft angle for the exemplary club head set of FIGS. 8-15.

The variation of support bar width relative to loft angle is summarized in FIG. 16 for the exemplary club head set 80. In the present example, club head set 80 comprises club head 800 as a 2-iron head, club head 1630 as a 3-iron head, club head 1640 as a 4-iron head, club head 1650 as a 5-iron head, club head 1100 as a 6-iron head, club head 1670 as a 7-iron head, club head 1680 as an 8-iron head, club head 1690 as a 9-iron head, and club head 1200 as a wedge-iron head. As can be appreciated from FIG. 16, the support bar width attribute is varied incrementally as the loft angle increases from one club head to the next in club head set 80. As a result, the support bar width for a club with a higher loft angle is greater than or equal to the support bar width for a club with a lower loft angle. There can be examples, however, where the characteristic and/or attribute of the one or more support bars can be incrementally varied for each increment in loft angle, such that the support bar width for a club with higher loft angle is greater than the support bar width for any club with a lower loft angle.

Figure 22:
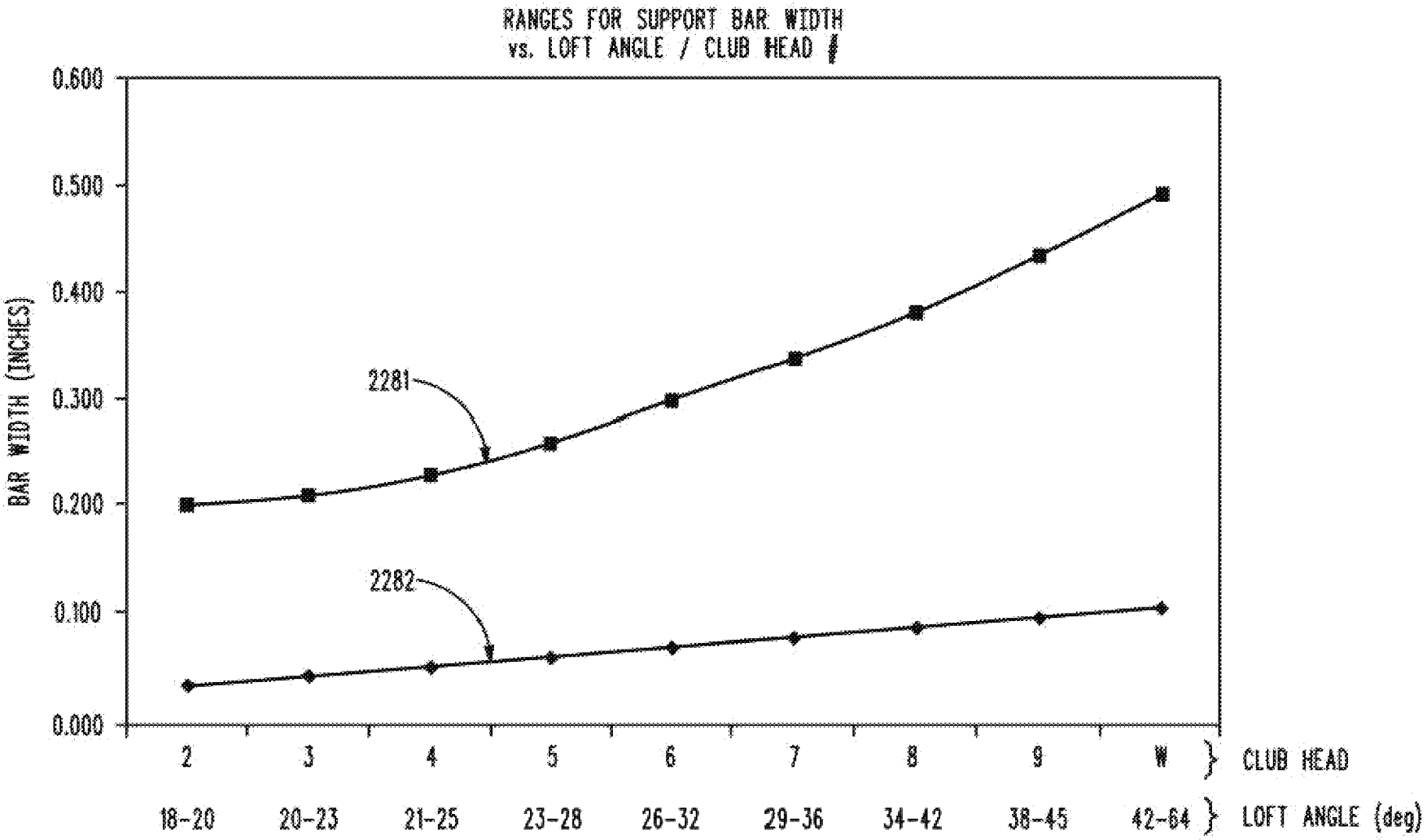
FIG. 22 illustrates a chart with sample ranges for relationships between the support bar widths and the loft angles/club head numbers.

Skipping ahead in the figures, as seen in FIG. 22, relationships between support bar width and loft angle/club head number may lie within one or more ranges. For example, club head set 2281 comprises club heads with thicker support bar widths that vary from club head to club head as indicated in FIG. 22. Similarly, in another example, club head set 2282 comprises club heads with thinner support bar widths that vary from club head to club head as also indicated in FIG. 22. Other examples or rates of variation are also possible for other club head sets.

In the same or other examples, support bar widths may vary within certain ranges, depending on the loft angle and/or the club head number, for club heads of one or more club head sets. For instance:

For a 2-iron head, the loft angle can comprise approximately 18 degrees to approximately 20 degrees, and the support bar width can comprise approximately 0.03 inches (0.75 millimeters) to approximately 0.2 inches (5.1 millimeters);

For a 3-iron head, the loft angle can comprise approximately 20 degrees to approximately 23 degrees, and the support bar width can comprise approximately 0.04 inches (1.0 millimeters) to approximately 0.21 inches (5.3 millimeters);

For a 4-iron head, the loft angle can comprise approximately 21 degrees to approximately 25 degrees, and the support bar width can comprise approximately 0.05 inches (1.3 millimeters) to approximately 0.23 inches (5.8 millimeters);

For a 5-iron head, the loft angle can comprise approximately 23 degrees to approximately 28 degrees, and the support bar width can comprise approximately 0.06 inches (1.5 millimeters) to approximately 0.26 inches (6.6 millimeters);

For a 6-iron head, the loft angle can comprise approximately 26 degrees to approximately 32 degrees, and the support bar width can comprise approximately 0.07 inches (1.8 millimeters) to approximately 0.30 inches (7.6 millimeters);

For a 7-iron head, the loft angle can comprise approximately 29 degrees to approximately 36 degrees, and the support bar width can comprise approximately 0.08 inches (2.0 millimeters) to approximately 0.34 inches (8.7 millimeters);

For a 8-iron head, the loft angle can comprise approximately 34 degrees to approximately 42 degrees, and the support bar width can comprise approximately 0.09 inches (2.3 millimeters) to approximately 0.39 inches (9.8 millimeters);

For a 9-iron head, the loft angle can comprise approximately 38 degrees to approximately 45 degrees, and the support bar width can comprise approximately 0.10 inches (2.5 millimeters) to approximately 0.44 inches (11.2 millimeters); and/or For a wedge-iron head, the loft angle can comprise approximately 42 degrees to approximately 64 degrees, and the support bar width can comprise approximately 0.11 inches (2.8 millimeters) to approximately 0.50 inches (12.7 millimeters).

In the same or other embodiments, one or more other characteristics or attributes of the support bars can vary, besides, instead of, or in addition to the support bar width, in a fashion similar to that described above for the support bar width. For example, in one embodiment, the other characteristic or attribute can comprise a support bar thickness, measured from the back face, that may be incrementally varied according to the loft angle. In such an example, a thickness of support bars 1261 of club head 1200 in FIG. 12 could be thicker than a thickness of support bars 1161 of club head 1100 in FIG. 11, and/or a thickness of support bars 1161 of club head 1100 in FIG. 11 could be thicker than a thickness of support bars 861 of club head 800 in FIG. 10.

Figure 17:
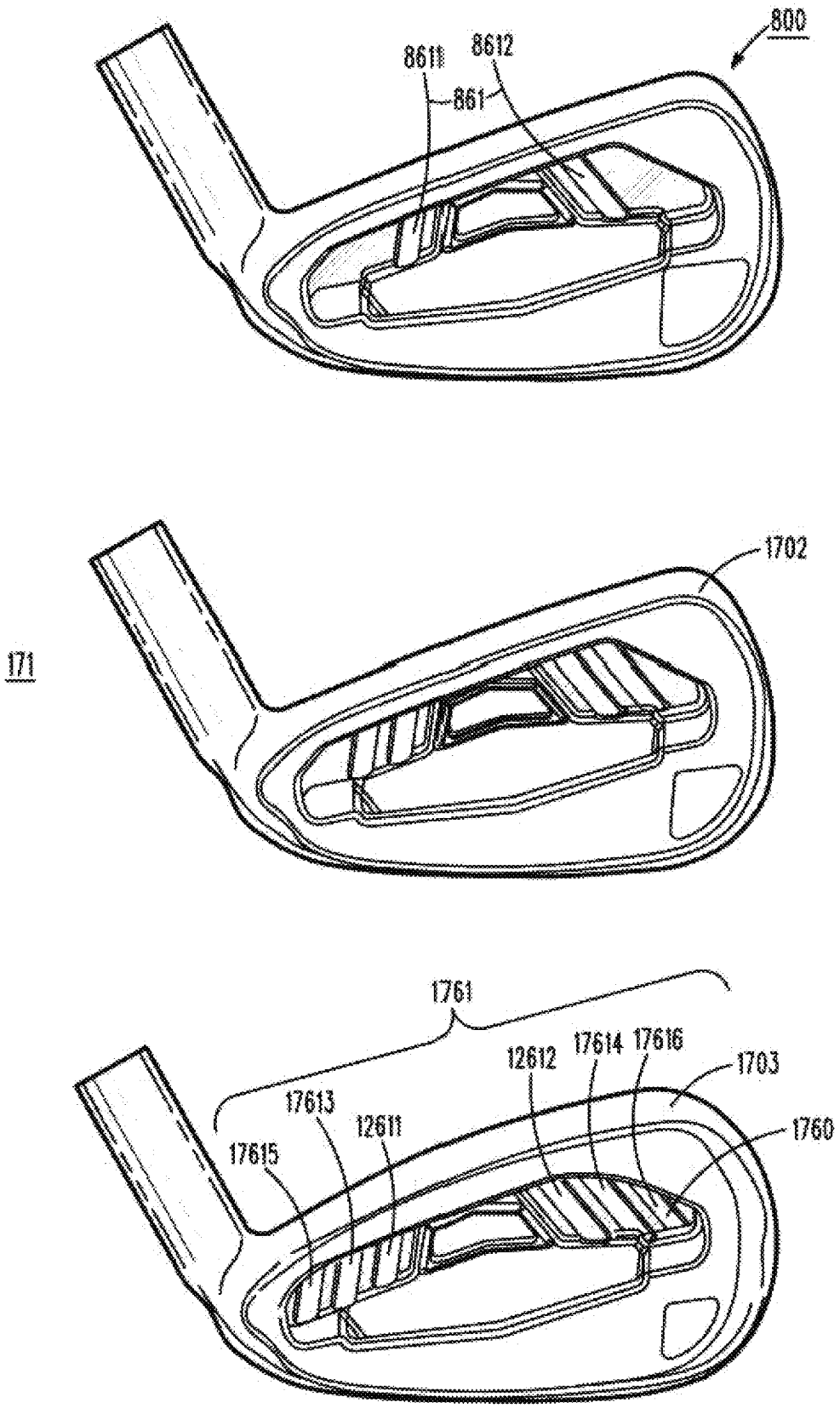
FIG. 17 illustrates several club heads of a club head set with varying characteristics according to an embodiment of the golf clubs and methods of manufacture described herein.

In the same or another embodiment, the other characteristic or attribute can comprise a total number of support bars that may be incrementally varied according to the loft angle. Such an embodiment is illustrated in FIG. 17 for club head set 171, comprising club head 800, club head 1702 similar to club head 1100, and club head 1703 similar to club head 1200. In the example of FIG. 17, the loft angle for club head 1703 is greater than the loft angle for club head 1702, and the loft angle for club head 1702 is greater than the loft angle for club head 1701, such that the total number of support bars for club head 1703 is greater than the total number of support bars for club head 1702, and the total number of support bars for club head 1702 is greater than the total number of support bars for club head 1701. In one example, the support bar width, thickness, and angle remains the same for each of the support bars in a single club head. In other examples, more than one characteristic or attribute is varied per club head, and/or support bars within a single club head can have different widths, thicknesses, and/or angles.

The incorporation of support bars at the back faces of the club heads of club head sets as described above can be beneficial for several reasons. For example, the placement of support bars proximate to a center region at back face of a club head can increase support for the front face and/or face plate to better withstand stresses associated with impacts to golf balls. Such additional support can be useful in situations where the face plate thickness has been minimized for weight savings and/or weight redistribution considerations.

In the case of short irons, such as wedge heads like club head 1200 in FIGS. 12 and 15, the placement of wider and/or thicker support bars such as support bars 1261 at back face 1260 just opposite to front face 1550 can have the effect of shifting the center of gravity of club head 1200 towards the front thereof. This shift can reduce a gear effect between front face 1550 and a golf ball, thereby limiting spin imparted onto the golf ball upon impact with front face 1550 for better trajectory control. In addition, better distance control and repeatability may be gained as a result of added face stability and reduced face deflection during impact due to the wider and/or thicker support bars. In some examples, similar results can also be achieved by having an increased number of support bars, such as in the case of support bars 1761 of club head 1703 in FIG. 17.

In the case of long irons, such as 2-irons like club head 800 in FIGS. 8, 10, and 13, the moment of inertia of the club head can be increased for better control by decreasing the relevant characteristic or attribute of the support bars, whether it be support bar width, support bar thickness, and/or total number of support bars, such that more of the mass of club head 800 can be distributed towards the edges of front face 950 of club head 800 for increased moment of inertia. In addition, longer and/or more penetrating flight paths may be achieved due to the decreased relevant support bar characteristic by permitting greater flexure of the front face and/or face plate of the club head.

Furthermore, in cases such as depicted for club head set 80, because the support bars are visible at the back face of the club heads, an increase in user confidence may be achieved for users that can appreciate the enhanced support, strength, and control features that the arrangement of support bars provides.

Backtracking to FIG. 8, club head 800 also is shown as comprising lower toe insert 895 in addition to insert 885 and related cavity 1080 (FIG. 10). There can be, however, other embodiments comprising insert 885 and cavity 1080 without lower toe insert 895, and/or other embodiments comprising lower toe insert 895 without insert 885 and cavity 1080. Similar variations in features can be extended for other clubs of respective club head sets. For example, all or part of the club heads of club head set 80 may comprise lower toe inserts similar to lower toe insert 895, in addition to inserts and related cavities similar to insert 885 and related cavity 1080. There can also be embodiments where all or a portion of the club heads of a club head set may comprise inserts and related cavities similar to insert 885 and related cavity 1080, but may lack lower to inserts similar to lower toe insert 895. There can also be embodiments where all or a portion of the club heads of a club head set may comprise lower toe inserts similar to lower toe insert 895, but may lack inserts and related cavities similar to insert 885 and related cavity 1080.

Continuing with FIG. 8, lower toe insert 895 can be similar to weight 195 of club head 100 (FIGS. 1, 4) and, in the present example, also comprises a weight. Lower toe insert 895 is located at lower toe section 811 of back portion 802, and although club head 800 comprises perimeter weight 875, lower toe insert 895 is located only at lower toe section 811. In the present example, lower toe insert 895 comprises a tungsten material and a specific gravity of approximately 10 g/cm$^3$ In the present example, the other club heads of club head set 80 also comprise corresponding lower toe inserts similar to lower toe insert 895.

In some examples, lower toe insert 895 and/or other similar inserts can be located at lower toe portion 811 to effect a redistribution of mass of club head 800. For example, lower toe insert 895 can be configured to shift the mass distribution of club head 800 away from center region 861 and towards toe region 810 and/or lower toe section 811 to thereby increase the moment of inertia of club head 800. In the same or other examples, lower toe insert 895 can be configured to counterbalance the mass of hosel 805 at the heel or upper heel portion of club head 800. By having hosel 805 and lower toe insert 895 substantially opposite each other, the distribution of mass of club head 800 can be shifted towards the ends of club head 800 to thereby increase its moment of inertia and forgiveness factor. In the same or other examples, the dimensions, location, and/or mass of lower toe insert 895 can be configured such as to adjust or align the center of gravity of club head 800 at a desired location relative to heel region 820 and/or toe region 810.

As previously described, the loft angles of the club heads of club head set 80 are incrementally varied across the two or more club heads in the present example. In addition, characteristics or dimensions of the corresponding lower toe inserts are also varied across the two or more club heads of club head set 80 in relation with the variation in loft angle. For instance, where each lower toe insert comprises two characteristics, the two characteristics can be inversely varied relative to each other for each lower toe insert across the club heads of club head set 80 as the loft angle is varied. As an example, a varied characteristic of the lower toe inserts may be incrementally varied, while an inverse characteristic of the lower toe inserts is decrementally varied as the loft angle changes.

The variation in characteristics relative to loft angle can be further appreciated as presented in FIGS. 10-15, for the example of club head set 80, via club heads 800, 1100, and 1200. As seen in FIGS. 13-15, loft angle 1555 of club head 1200 is greater than loft angle 1455 of club head 1100, which in turn is greater than loft angle 955 of club head 800. Furthermore, for the present embodiment, as loft angles increase from club head to club head, lower toe thicknesses, as measured along respective depth axes of the club heads, tend to increase from club head to club head. In the same and other embodiments, the lower toe thickness of a club head can be related and/or defined by a sole of the club head. As an example, lower toe thickness 15954 (FIG. 15) of club head 1200 is greater than lower toe thickness 14954 (FIG. 14) of club head 1100, which in turn is greater than lower toe thickness 13954 (FIG. 13) of club head 800. Similarly, lower toe thickness 13954 of club head 800 is defined by, and comprises a portion of, a thickness of sole 13001 (FIG. 13), while lower toe thickness 15954 of club head 1200 is defined by, and comprises a portion of, a thickness of sole 15001 (FIG. 15), such that the thickness of sole 15001 is greater than the thickness of sole 13001.

In the embodiment of club head set 80, the varied characteristic can be a depth of the lower toe insert, while the inverse characteristic can be an area of the lower toe insert. As an example, for club head 800, insert depth 13952 (FIG. 13) of lower toe insert 895 is measured along depth axis 13953, where depth axis 13953 traverses minimum distance point 13955 between lower toe insert 865 and front face 950, where insert area 8951 (FIGS. 8, 10) represents a cross-sectional area of lower toe insert 895 substantially perpendicular to depth axis 13953 and/or where depth axis 13953 is substantially parallel to sole 13001 (FIG. 13) and/or is substantially perpendicular to shaft bore axis 806. Similarly, for club head 1100, insert depth 14952 (FIG. 14) is measured along depth axis 14953, where depth axis 14953 traverses minimum distance point 14955 between lower toe insert 1195 and front face 1450, where insert area 11951 (FIG. 11) represents a cross-sectional area of lower toe insert 1195 substantially perpendicular to depth axis 14953, and/or where depth axis 14953 is substantially parallel to sole 14001 (FIG. 14) and/or is substantially perpendicular to shaft bore axis 1406. As another example, for club head 1200, insert depth 15952 (FIG. 15) is measured along depth axis 15953, where depth axis 15953 traverses minimum distance point 15955 between lower toe insert 1295 and front face 1550, and where insert area 12951 (FIG. 12) represents a cross-sectional area of lower toe insert 1295 substantially perpendicular to depth axis 15953, and/or where depth axis 15953 is substantially parallel to sole 15001 (FIG. 15) and/or is substantially perpendicular to shaft bore axis 1506. In such examples, where the varied characteristic of lower toe insert depth (13952, 14952, 15952) increases from club head 800 to club head 1200, the inverse characteristic of lower toe area (8991, 11951, 12951) decreases from club head 800 to club head 1200. In a different embodiment, the lower toe insert depth (13952, 14952, 15952) increases as the loft angle (955, 1455, 1555) increases.

In the same or other embodiments, one of the characteristics or dimensions that vary can be a distance between a center of gravity of the lower toe insert and the front face of respective club head. For instance, a distance between the center of gravity of a lower toe insert and the front face of a corresponding lower-lofted club head can be greater than a distance between the center of gravity of a lower toe insert and the front face of a corresponding higher-lofted club head. As an example, distance 13957 between center of gravity 13956 of lower toe insert 895 and front face 950 of club head 800 (FIG. 13) is greater than distance 14957 between center of gravity 14956 of lower toe insert 1195 and front face 1450 of club head 1100 (FIG. 14), which in turn is greater than distance 15957 between center of gravity 15956 of lower toe insert 1295 and front face 1550 of club head 1200 (FIG. 15). In such examples, where the varied characteristic of lower toe insert depth (13952, 14952, 15952) increases from club head 800 to club head 1200, the inverse characteristic of center of gravity distance (13957, 14957, 15957) decreases from club head 800 to club head 1200. In a different embodiment, the center of gravity distance (13957, 14957, 15957) decreases as the loft angle (955, 1455, 1555) increases.

The club head variations described above based on loft angle can permit the insert depths of the lower toe inserts to vary. For example, insert depth 15952 (FIG. 15) of insert 1295 is greater than insert depth 14952 (FIG. 14) of insert 1195, which in turn is greater than insert depth 13952 (FIG. 13) of lower toe insert 895. Furthermore, distances between the lower toe inserts and the respective club head front faces can vary accordingly. In the present example of club head 80, insert-to-face distance 1360 (FIG. 13) of club head 800 is of approximately 0.281 inches (7.14 millimeters), which is greater than insert-to-face distance 1460 (FIG. 14) of club head 1100 at approximately 0.233 inches (5.92 millimeters), which, in turn, is greater than insert-to-face distance 1560 (FIG. 15) of club head 1200 at approximately 0.195 inches (4.95 millimeters).

Such variation in the insert depths of the lower toe inserts, in the distances between the lower toe inserts and their respective club head front faces, and/or in the distances between the center of gravity of the lower toe inserts and their respective club head front faces, can vary mass distribution for the club heads, thereby permitting the adjustment of certain qualities of the club heads.

For example, by having shallower insert depths and/or larger insert-to-face distances for lower-lofted club heads, the center of gravity of such club heads can be moved away from the respective club head front faces, thereby increasing club head dynamic loft and imparted spin such as to allow higher launch angles and/or flight trajectories for impacted balls. Conversely, by having deeper insert depths and/or shallower insert-to-face distances for higher-lofted club heads, the center of gravity of such club heads can be moved closer to the respective club head front faces, thereby allowing for more penetrating flight paths for impacted balls.

The variation in insert depth described above could lead to a variation in mass of the different lower toe inserts of the club heads. To counteract such mass variation, and the effects it could have on other qualities of the club heads, like the counterbalancing of respective hosels with respective lower toe inserts, other characteristics or dimensions of the lower toe inserts can be varied inversely with respect to the variation in insert depth. For example, as the insert depths of the lower toe inserts increase, an area of the lower toe inserts can be decreased, such that all lower toe inserts comprise substantially similar masses. In some embodiments, a mass of each of the lower toe inserts of club head set 80 comprises approximately 10.25 grams. In the same or other examples, such mass may be of approximately 5 grams to approximately 50 grams. In the example of club head set 80, as insert depths vary by increasing from insert depth 13952 (FIG. 13) to insert depth 14952 (FIG. 14), and from insert depth 14952 to insert depth 15952 (FIG. 15), corresponding areas for the inserts inversely vary by decreasing from insert area 8951 (FIG. 10) to insert area 11951 (FIG. 11), and from insert area 11951 (FIG. 11) to insert area 12951 (FIG. 12).

Figure 19:
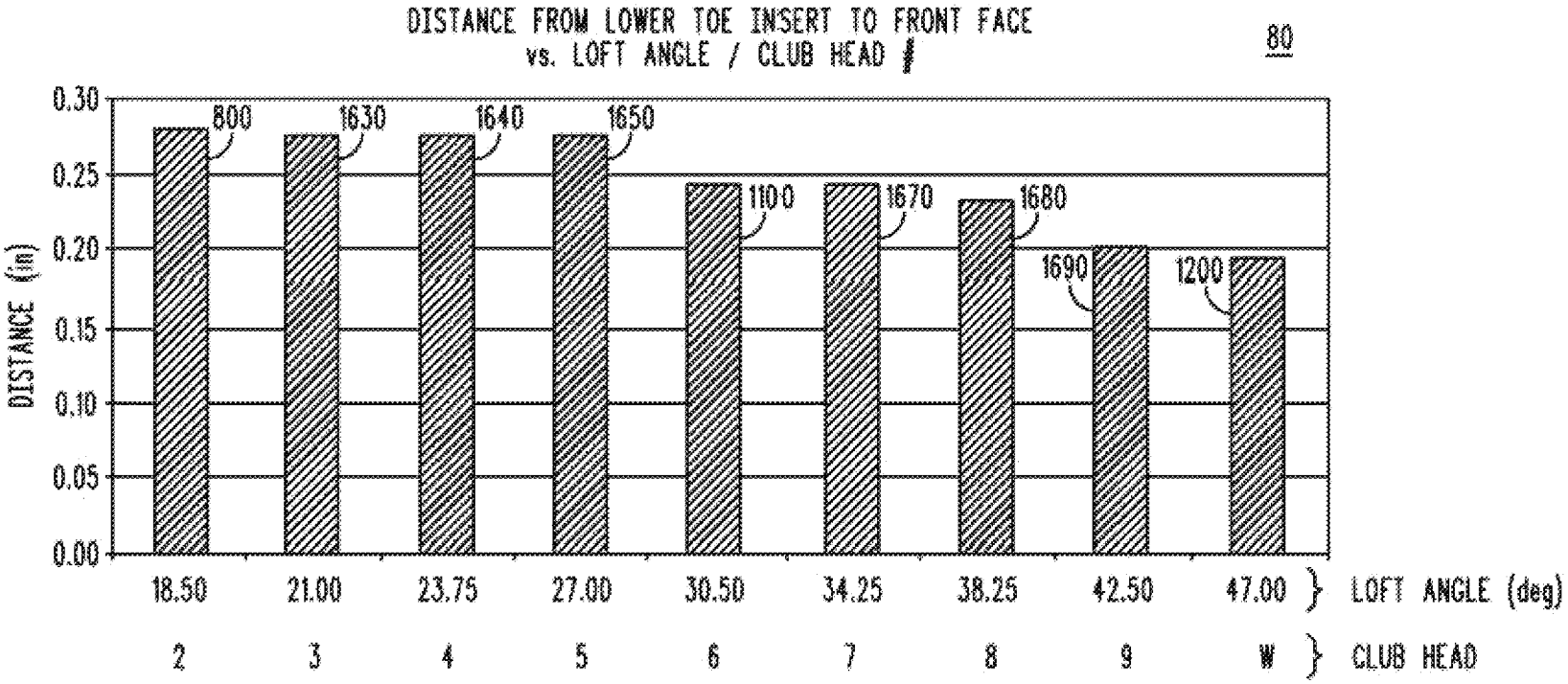
FIG. 19 illustrates a chart of exemplary relationship between loft angle and distances between lower toe inserts to front faces for the exemplary club heads of FIGS. 8-18 according to an embodiment of the golf clubs and methods of manufacture described herein.
Figure 23:
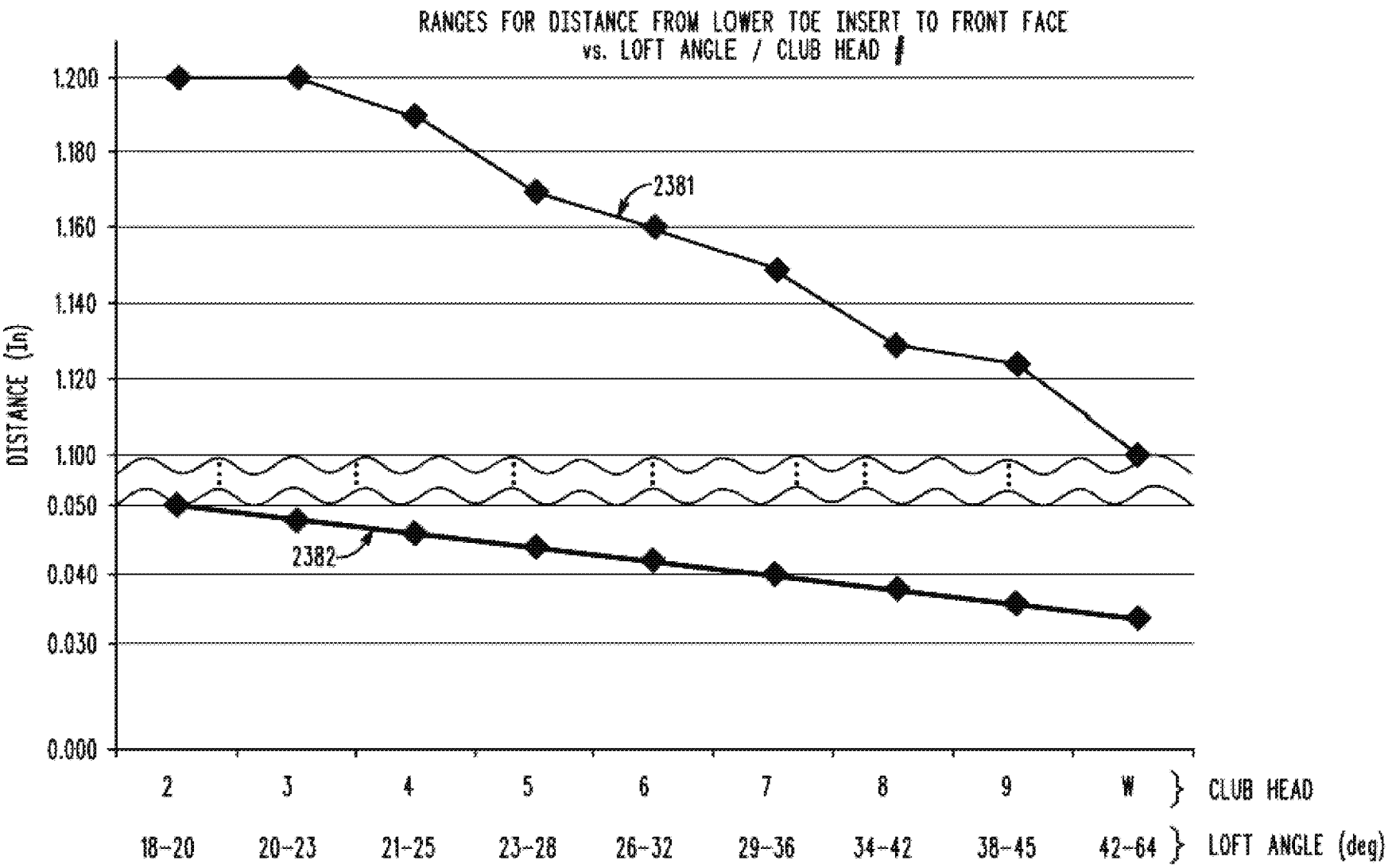
FIG. 23 illustrates a chart with sample ranges for relationships between the distances from the lower toe inserts to the club head front faces and the loft angles/club head numbers.

FIG. 19 illustrates an exemplary relationship between loft angle and the distances between lower toe inserts to front faces for the embodiment of club head set 80. Skipping ahead in the figures, as seen in FIG. 23, relationships between front-face-to-lower-toe-weight distances and loft angle/club head number may lie within one or more ranges. For example, club head set 2381 comprises club heads with longer front-face-to-lower-toe-weight distances that vary from club head to club head as indicated in FIG. 23. Similarly, in another example, club head set 2382 comprises club heads with shorter front-face-to-lower-toe-weight distances that vary from club head to club head as also indicated in FIG. 23. The club heads of club head set 2381 can have soles that are generally wider, from front to back of the club head, than the soles of the club heads of club head set 2382. Other examples or rates of variation are also possible for other club head sets.

In the same or other examples, front-face-to-lower-toe-weight distances may vary within certain ranges, depending on the loft angle and/or the club head number, for club heads of one or more club head sets. For instance:

A 2-iron front-face-to-lower-toe-weight distance can comprise approximately 0.050 inches (1.27 millimeters) to approximately 1.2 inches (28.08 millimeters);

A 3-iron front-face-to-lower-toe-weight distance can comprise approximately 0.048 inches (1.22 millimeters) to approximately 1.2 inches (28.08 millimeters);

A 4-iron front-face-to-lower-toe-weight distance can comprise approximately 0.046 inches (1.17 millimeters) to approximately 1.19 inches (27.85 millimeters);

A 5-iron front-face-to-lower-toe-weight distance can comprise approximately 0.044 inches (1.12 millimeters) to approximately 1.17 inches (27.38 millimeters);

A 6-iron front-face-to-lower-toe-weight distance can comprise approximately 0.042 inches (1.07 millimeters) to approximately 1.16 inches (27.14 millimeters);

A 7-iron front-face-to-lower-toe-weight distance can comprise approximately 0.040 inches (1.02 millimeters) to approximately 1.15 inches (26.91 millimeters);

A 8-iron front-face-to-lower-toe-weight distance can comprise approximately 0.038 inches (0.97 millimeters) to approximately 1.13 inches (26.44 millimeters);

A 9-iron front-face-to-lower-toe-weight distance can comprise approximately 0.036 inches (0.91 millimeters) to approximately 1.125 inches (26.33 millimeters); and/or A wedge-iron front-face-to-lower-toe-weight distance can comprise approximately 0.034 inches (0.86 millimeters) to approximately 1.10 inches (25.74 millimeters). Backtracking to FIGS. 13-15, to simplify matters, relationships between higher-lofted club heads and lower-lofted club heads, with respect to their lower-toe inserts, will be described below by referencing club heads 800 and 1200 of club head set 80. Relationships between other club heads may be extrapolated or interpolated based on the description below of club heads 800 and 1200.

In the present example of club head set 80, lower toe insert 895 of club head 800, and lower toe insert 1295 of club head 1200, comprise weights with substantially similar masses. In addition, dimensions of lower toe inserts 895 and 1295 correspond to each other, such that insert depth 13952 (FIG. 13) of lower toe insert 895 corresponds to insert depth 15952 (FIG. 15) of lower toe insert 1295, and insert area 8951 (FIG. 10) of lower toe insert 895 corresponds to insert area 12951 (FIG. 12) of lower toe insert 1295. Insert areas 8951 and 12951 can represent cross-sectional areas and/or back-end areas of their respective lower toe inserts in the present or other embodiments. In the present example, because insert depth 15952 of lower toe insert 1295 is greater than insert depth 13952 of lower toe insert 895, insert area 8951 of lower toe insert 895 is greater than insert area 12951 of lower toe insert 1295. As a result, the insert area and insert depth dimensions are inversely varied relative to each other.

Furthermore, as seen in FIGS. 13 and 15, insert-to-face distance 1560 between lower toe insert 1595 and front face 1550 is greater than insert-to-face distance 1360 between lower toe insert 895 and front face 950. In the present example, insert-to-face distance 1560 comprises a shortest distance between front face 1550 and lower toe insert 1295, while insert-to-face distance 1360 comprises a shortest distance between front face 950 and lower toe insert 895. Such relationships described above between lower toe inserts (895, 1295) and front faces (950, 1550) of respective club heads 800 and 1200 define respective distributions of mass such that a center of gravity of club head 1200 can be closer to front face 1550 than a center of gravity of club head 800 is to front face 950.

In the present examples, both lower toe inserts 895 and 1295 are visible at their respective lower toe sections of club heads 800 and 1200. In some examples, such visibility of the lower toe inserts may inspire user confidence for users that can appreciate the enhanced performance and control features that the arrangement of the respective lower toe inserts provides. There can be other embodiments, however, where lower toe inserts may not be visible. For example, the interface between the lower toe insert 895 and lower toe section 811 may blend or otherwise become indiscernible after machining or polishing steps.

In the example of club head set 80, club head 800 comprises perimeter weight 875 at a periphery of back portion 802, and club head 1200 comprises perimeter weight 1275 at a periphery of pack portion 1202. Perimeter weight 875 comprises a cavity at lower toe section 811, where lower toe insert 895 is located. Similarly, perimeter weight 1275 comprises a cavity at lower toe section 1211, where lower toe insert 1295 is located. As a result, the lower toe inserts can be integrated with their respective perimeter weights while still being located only at their respective lower toe sections. In addition, in the present example, lower toe insert 1295 is incompatible with the cavity of lower toe section 811 in club head 800, while lower toe insert 895 is incompatible with the cavity of lower toe section 1211 in club head 1200.

Figure 20:
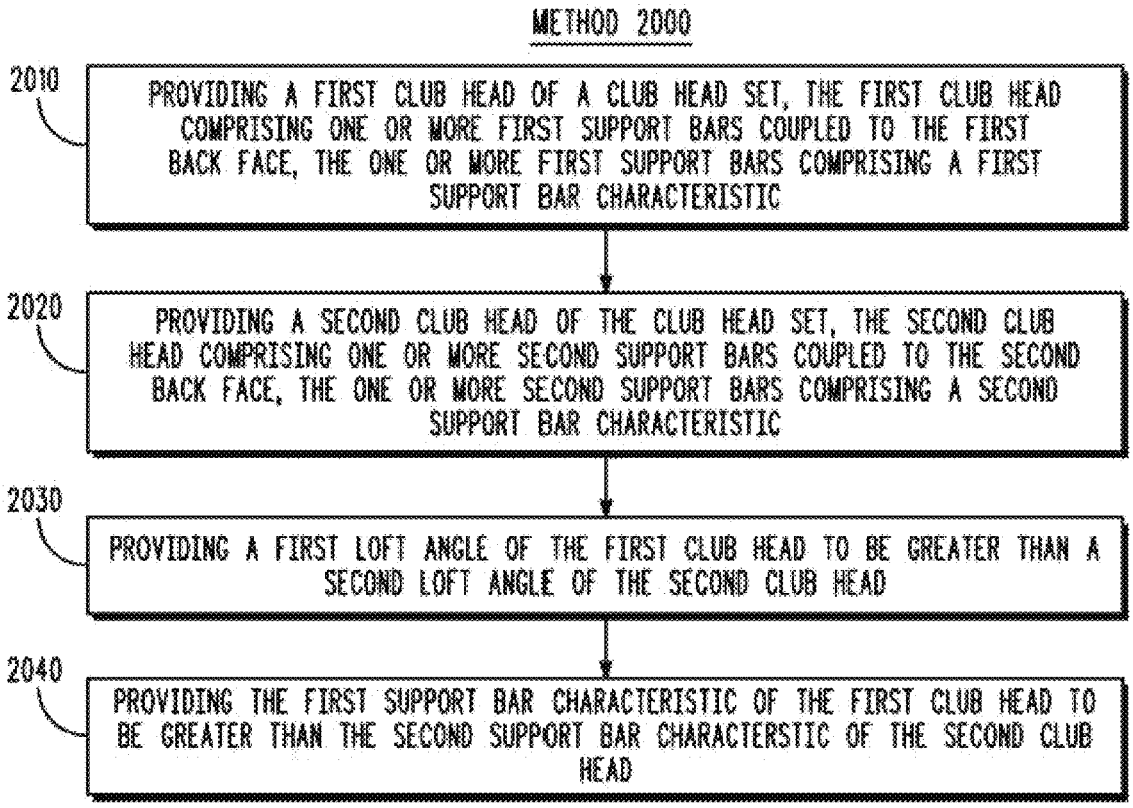
FIG. 20 illustrates a flowchart of a method for providing a club head set similar to the club head sets described for FIGS. 8-19.

Forging ahead, FIG. 20 illustrates a flowchart of method 2000 for providing a club head set. In some examples, the club head set of method 2000 can be similar to club head set 80 of FIGS. 8-16 and 18-19, and/or to club head set 171 of FIG. 17.

Block 2010 of method 2000 comprises providing a first club head of a club head set, the first club head comprising one or more first support bars coupled to the first back face, the one or more first support bars comprising a first support bar characteristic. In some examples, the first club head can be similar to club head 1200 (FIGS. 12, 15, 16, 19), and the one or more first support bars can be similar to support bars 1261 (FIG. 12) coupled to back face 1260, or to support bars 1761 (FIG. 17) coupled to back face 1760. In the same or other examples, the first support bar characteristic can comprise a support bar width, a support bar thickness, and/or a total number of support bars.

Block 2020 of method 2000 comprises providing a second club head of the club head set, the second club head comprising one or more second support bars coupled to the second back face, the one or more second support bars comprising a second support bar characteristic. In some examples, the second club head can be similar to club head 800 (FIGS. 8-10, 13, 16-19), and the one or more first support bars can be similar to support bars 861 (FIGS. 8, 12, 17) coupled to back face 860. In the same or other examples, the second support bar characteristic can comprise a second support bar width, a second support bar thickness, and/or a second total number of support bars.

Block 2030 of method 2000 comprises providing a first loft angle of the first club head to be greater than a second loft angle of the second club head. In some examples, the first loft angle can be similar to loft angle 1555 (FIG. 15) of club head 1200, and the second loft angle can be similar to loft angle 955 (FIGS. 9, 13) of club head 800.

Block 2040 of method 2000 comprises providing the first support bar characteristic of the first club head to be greater than the second support bar characteristic of the second club head. As a result, the support bar characteristic would be greater for the club head having a greater loft angle. As an example, the first support bar characteristic for club head 1200 in FIG. 12 comprises a support bar width of support bars 1261, while the second support bar characteristic for club head 800 in FIG. 10 comprises a support bar width of support bars 861. As can be seen by comparing FIGS. 8 and 12, and by referring to the graph in FIG. 16, the support bar width for support bars 1261 (FIG. 12) is greater than the support bar width for support bars 861 (FIG. 10) in the example of golf club set 80. In the same or another example, where the support bar characteristic comprised a support bar thickness, the support bar thickness for support bars 1261 (FIG. 12) can be thicker than the support bar thickness for support bars 861 (FIG. 10). In the example of FIG. 17, the support bar characteristics comprise a total number of support bars and, as can be seen by comparing club head 1703 against club head 800 in FIG. 17, the total number of support bars 1761 in club head 1703 comprises support bars 12611-12612 and 17613-17616, and is thus greater than the total number of support bars 861 in club head 800, which comprises support bars 8611-8612.

There can be examples where the description above for method 2000 can be extended throughout the two or more club heads of the club head set. For example, method 2000 could comprise providing two or more club heads of the club head set, and providing a support bar characteristic for each of the two or more club heads, the support bar characteristic incrementally varying across the two or more club heads in accordance with loft angle variation across the two or more club heads. In such an example, the two or more club heads comprise the first and second club heads of blocks 2010 and 2020. In addition, the support bar characteristic for the first club head could comprise the first support bar characteristic described above with respect to blocks 2010 and 2040, while the support bar characteristic for the second club head could comprise the second support bar characteristic described above with respect to blocks 2020 and 2040. In the same or other examples, providing the support bar characteristic for each of the two or more club heads can comprises incrementally varying the support bar characteristic across the two or more club heads for each incremental loft angle variation across the two or more club heads.

In some examples, method 2000 could comprise providing a hosel for a club head of the club head set, and providing a counterbalance weight located only at a lower toe section at a back portion of the club head to counterbalance the hosel. In some examples, a counterbalance weight can be provided for the first club head of block 2010, for the second club head of block 2020, and/or for several or all of the club heads of the golf club set of method 2000. In some examples, the counterbalance weight can be similar to lower toe insert 895 (FIGS. 8, 10, 13) and or to lower toe insert 1295 (FIGS. 12, 15).

There can also be examples of method 2000 where an insert can be provided and located in a cavity at a back portion of a club head. For instance, a first back portion of the first club head can further comprise a back wall extended between the heel and toe regions and a first cavity located between the first back face and the back wall. The first cavity can comprises a cavity heel zone, a cavity toe zone, a cavity center zone, a cavity inner wall located opposite the first back face, and a cavity outer wall located opposite the back wall. In addition, the cavity inner wall of the first cavity can be thicker, relative to the first front face, at the cavity heel and toe zones than at the cavity center zone. In some examples, the first cavity can be similar to cavity 1280 of club head 1200 (FIG. 12), which can also be similar to cavity 1080 of club head 800 (FIG. 10). Also, the first club head can further comprise a first insert comprising an insert heel zone, an insert toe zone and an insert center zone, where the first insert is configured to be at least partially housed in the first cavity, and each of the insert heel and toe zones are thinner than the insert center zone. The first insert can comprise an insert inner wall complementary to the cavity inner wall, such that the insert heel and toe zones are obtusely angled relative to each other along the insert inner wall and about the insert center zone, and/or such that the cavity inner wall is obtusely angled complementarily to the insert inner wall. In some examples, the first inset can be similar to insert 885, as described above for FIGS. 8, and 18. Such arrangements may beneficial, for example, to redistribute mass away from a center of the club head to augment the moment of inertia thereof, as described above with respect to insert 885 and cavity 1080 of club head 800 (FIGS. 8, 10).

In some examples, some of the blocks of method 2000 can be subdivided into one or more sub-blocks. For example, block 2010 can be subdivided into several sub-blocks as described above for providing different portions of the first club head, such as the cavity and the insert at the back portion thereof.

In the same or other examples, one or more of the different blocks of method 2000 can be combined into a single block or performed simultaneously, and/or the sequence of such blocks can be changed. For example, block 2030 can occur simultaneously with block 2010 for the first club head, and can occur simultaneously with block 2020 for the second club head. In addition, block 2040 can occur simultaneously with block 2030. In another example, all of the details of the first club head can be performed in a first block, and all of the details of the second club head can be performed in a second block.

There can also be examples where method 2000 can comprise further or different blocks. As an example, method 2000 can also comprise individual blocks similar to blocks 2010 and/or 2020 for each of the two or more club heads of the club head set of method 2000. Other variations can be implemented for method 2000 without departing from the scope of the present disclosure.

Figure 21:
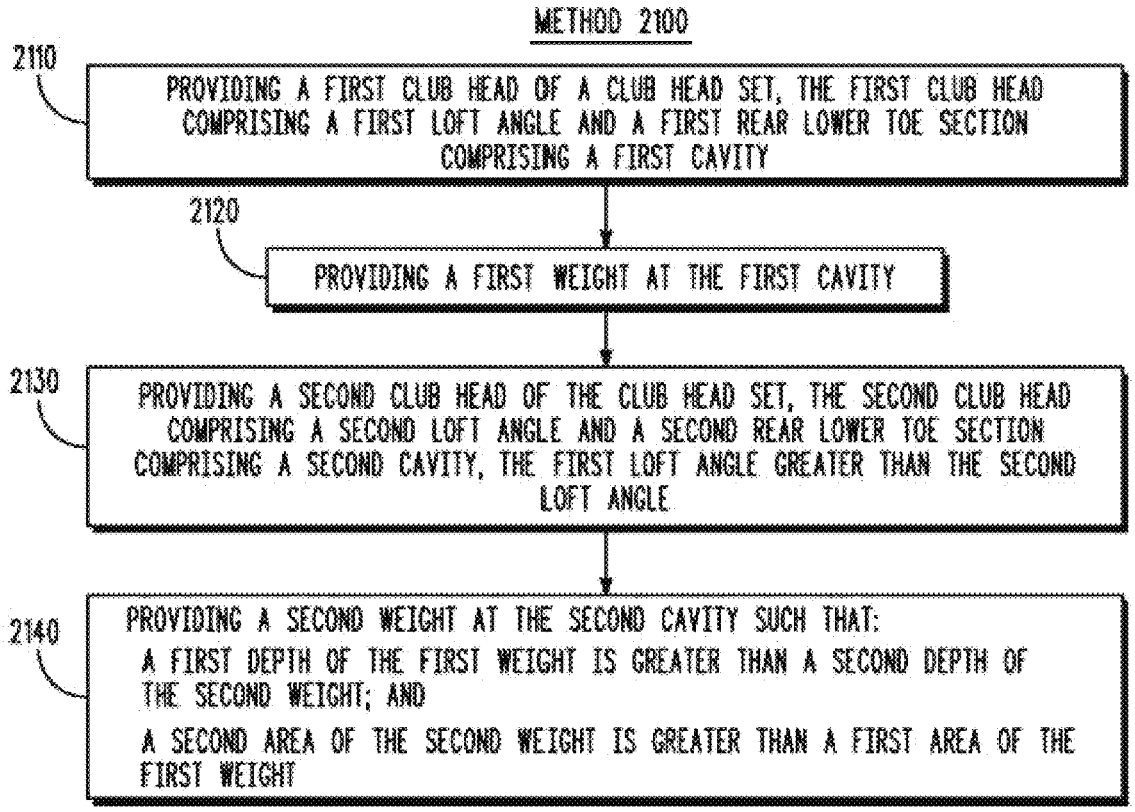
FIG. 21 illustrates a flowchart of another method for providing a club head set similar to the club head sets described for FIGS. 8-19 according to an embodiment of the golf clubs and methods of manufacture described herein.

Moving on, FIG. 21 illustrates a flowchart of method 2100 for providing a club head set. In some examples, the club head set of method 2100 can be similar to club head set 80 of FIGS. 1-16 and 19, and/or to club head set 171 of FIG. 17.

Block 2110 of method 2100 comprises providing a first club head of a club head set, the first club head comprising a first loft angle and a first rear lower toe section comprising a first cavity. In some examples, the first club head can be similar to club head 1200 (FIGS. 12, 15, 16, 19), such that the first loft angle can be similar to loft angle 1555 (FIG. 15), and the first cavity can be similar to cavity 1596 at lower toe section 1211 of club head 1200 (FIG. 15).

Block 2120 of method 2100 comprises providing a first weight at the first cavity. In some examples, the first weight can be similar to lower toe insert 1295 at cavity 1596 of club head 1200 (FIG. 15).

Block 2130 of method 2100 comprises providing a second club head of the club head set, the second club head comprising a second loft angle and a second rear lower toe section comprising a second cavity, the first loft angle greater than the second loft angle. There can be examples where the second club head can be similar to club head 800 (FIGS. 8, 9, 10, 13, 17, 18), such that the second loft angle can be similar to loft angle 955 (FIGS. 9, 13), and the second cavity can be similar to cavity 1396 at lower toe section 811 of club head 800 (FIG. 13). In other examples, the second club head can be another club head of the club head set having a loft angle less than the loft angle of the first club head.

Block 2140 of method 2100 comprises providing a second weight at the second cavity, such that a first depth of the first weight is greater than a second depth of the second weight, and a second area of the second weight is greater than a first area of the first weight. There can be examples where the second weight can be similar to lower toe insert 895 at cavity 1396 of club head 800 (FIG. 13). In such examples, the first depth and the first area of the first weight can be respectively similar to insert depth 15952 (FIG. 15) and insert area 12951 (FIG. 12), while the second depth and the second area can be respectively similar to insert depth 13952 (FIG. 13) and insert area 8951 (FIG. 10), and as a result, insert depth 15952 of lower toe insert 1295 is greater than insert depth 3952 of lower toe insert 895, and insert area 8951 of lower toe insert 895 is greater than insert area 12951 of lower toe insert 1295.

There can be implementations where the relationship above between the first and second areas of the first and second weights can be achieved by varying respective lengths and widths of the first and second weights. For example, the a second length of the second weight can be made greater than a first length of the first weight, and/or a second width of the second weight can be made greater than a first width of the first weight. In the example of club head set 80, where area 8951 (FIG. 10) is defined by length 8952 and width 8953 of lower toe insert 895, and where area 12951 (FIG. 12) is defined by length 12952 and width 12953, area 8951 of lower toe insert 895 can be greater than area 12951 of lower toe insert 1295 as a result of length 8952 being greater than length 12952, and/or as a result of width 8953 being greater than width 12953. In the present example, length 8952 and width 8953 of lower toe insert 895 are substantially the similar to each other, measuring approximately 0.475 inches (12.06 millimeters), while length 12952 and width 12953 of lower toe insert 1295 are also substantially similar to each other, measuring approximately 0.425 inches (10.8 millimeters). The corresponding length and width of lower insert weight 1195 (FIG. 11) measure approximately 0.450 inches (11.43 millimeters). There can be other embodiments, however, where the length and area of a lower toe insert need not be substantially similar to each other.

In some embodiments, block 2140 of method 2100 can further comprise providing a second minimum distance from the second weight to the second front face to be greater than a first minimum distance from the first weight to the first front face. In the same or other embodiments, block 2140 can also comprise providing a center of gravity of the first club head to be closer to the first front face than what a center of gravity of the second club head is to the second front face. For example, the second minimum distance can be similar to insert-to-face distance 1560 between lower toe insert 1295 and front face 1550 of club head 1200 (FIG. 15), while the first minimum distance can be similar to insert-to-face distance 1360 between lower toe insert 895 and front face 950 of club head 800 (FIG. 13). In the same or other embodiments, such arrangement may allow the center of gravity of higher-lofted club heads, like club head 1200, to be closer to their respective front faces than the center of gravity of lower lofted club heads like club head 800.

There can also be examples of method 2100 where an insert can be provided for location in a cavity at a back portion of a club head of the club head set of method 2100, similar to as described above for method 2000 and/or with respect to cavities 1080 (FIG. 10) and 1280 (FIG. 12) of club heads 800 and 1200, respectively, and inserts similar to insert 885 (FIG. 8, 18). For instance, the cavity inner wall of the cavity may be thinner at the cavity center zone than at the cavity heel and toe zones. Similarly, the insert center zone may be thicker than the insert heel and toe zones for said insert. Such arrangements may beneficial, for example, to redistribute mass away from a center of the club head to augment the moment of inertia thereof, as described above with respect to insert 885 and cavity 1080 of club head 800 (FIGS. 8, 10).

There also can be embodiments of method 2100 where the description above for can be extended throughout a portion or all of the two or more club heads of the club head set. For example, method 2100 could comprise providing two or more club heads of the club head set, and inversely varying the depth and area of the lower toe inserts as the loft angles of the respective club heads increase across the two or more club heads of the club head set.

In some examples, some of the blocks of method 2100 can be subdivided into one or more sub-blocks. For example, block 2110 can be subdivided into several sub-blocks as described above for providing different portions of the first club head, such as the cavity and the insert at the back portion thereof. As another example, block 2140 also can comprise providing a mass of the second weight to be substantially similar to a mass of the first weight. Similar provisions can also be made across method 2100 such that the masses of all lower toe inserts of the club head set are substantially similar to each other.

In the same or other examples, one or more of the different blocks of method 2100 can be combined into a single block or performed simultaneously, and/or the sequence of such blocks can be changed. For example, block 2110 can occur simultaneously with block 2120 for the first club head, and/or block 2130 can occur simultaneously with block 2140 for the second club head.

There can also be examples where method 2100 can comprise further or different blocks. As an example, method 2100 can also comprise individual blocks similar to blocks 2110 and/or 2120 for each of the two or more club heads of the club head set of method 2100. Other variations can be implemented for method 2100 without departing from the scope of the present disclosure.

Figure 24:
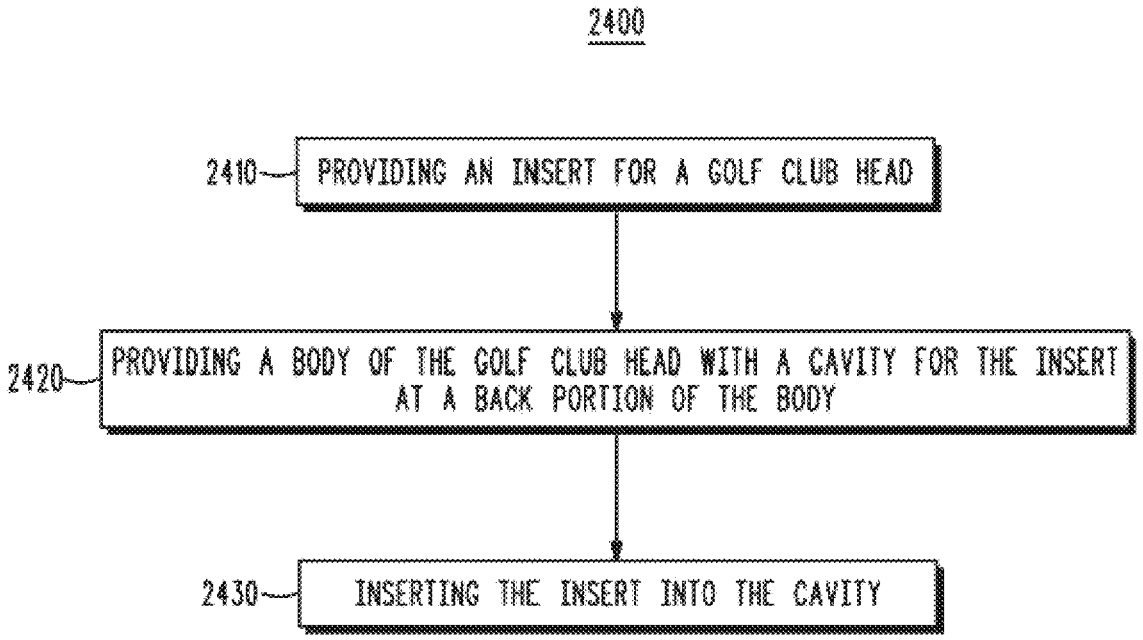
FIG. 24 illustrates a flowchart of a method for providing a club head similar to the club head shown in FIGS. 8-10, 13, and 18.

Skipping ahead, FIG. 24 illustrates a flowchart of method 2400 for providing a club head. In some examples, the club head of method 2400 can be similar to club head 800 as depicted for FIGS. 8-10 and 18.

Block 2410 of method 2400 comprises providing an insert for the golf club head of method 2400. In some examples, the insert can be similar to insert 185 (FIGS. 1, 3) and/or to insert 885 (FIGS. 8, 18). The insert can comprise heel, toe, and center zones, where the center zone is thicker than the heel and toe zones.

Block 2420 of method 2400 comprises providing a body of the golf club head with a cavity for the insert at a back portion of the body. Providing the body can comprise providing a back face and a back end at a back portion of the body, and providing the cavity between the back face and the back end. The cavity can comprise a cavity inner section adjacent to the back face, a cavity outer section opposite the back end, cavity heel and toe zones, and a cavity center zone thicker than the cavity heel and toe zones. In some examples, the body can be similar to body 801 of club head 800 (FIGS. 8, 18), the back face can be similar to back face 860 (FIGS. 8, 18), the back end can be similar to back end 870 (FIGS. 8, 18), and the cavity can be similar to cavity 1080 (FIGS. 10, 18).

Block 2430 of method 2400 comprises inserting the insert into the cavity of the body of the golf club head. In some examples, block 2430 can include adhering or otherwise coupling the insert to the cavity.

In some examples, some of the blocks of method 2400 can be subdivided into one or more sub-blocks. For example, block 2420 can be subdivided into several sub-blocks for providing different portions of the body of the club head.

In the same or other examples, one or more of the different blocks of method 2400 can be combined into a single block or performed simultaneously, and/or the sequence of such blocks can be changed. For example, block 2410 can occur simultaneously with or after block 2420 in some examples.

In other examples one of blocks 2410 or 2420 may be optional. There can also be examples where method 2400 can comprise further or different blocks. Other variations can be implemented for method 2400 without departing from the scope of the present disclosure.

Figure 25:
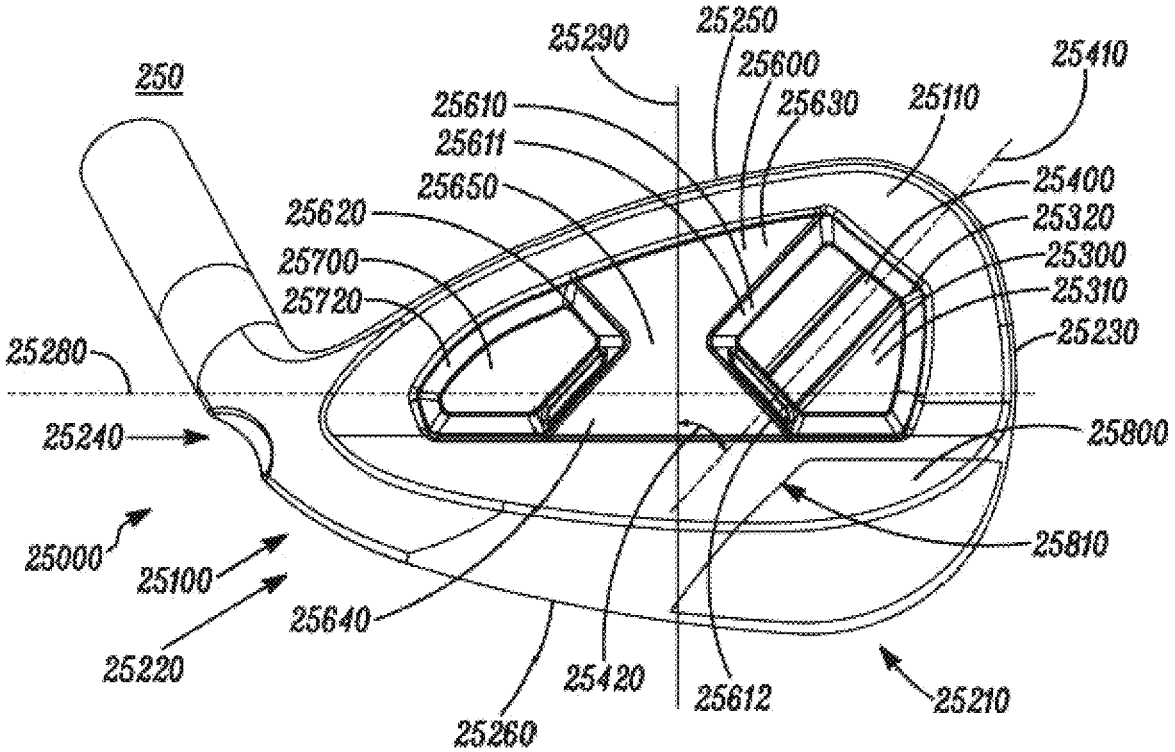
FIG. 25 illustrates a rear view of a club head of a club head set with varying characteristics according to an embodiment of the golf clubs and methods of manufacture described herein.
Figure 26:
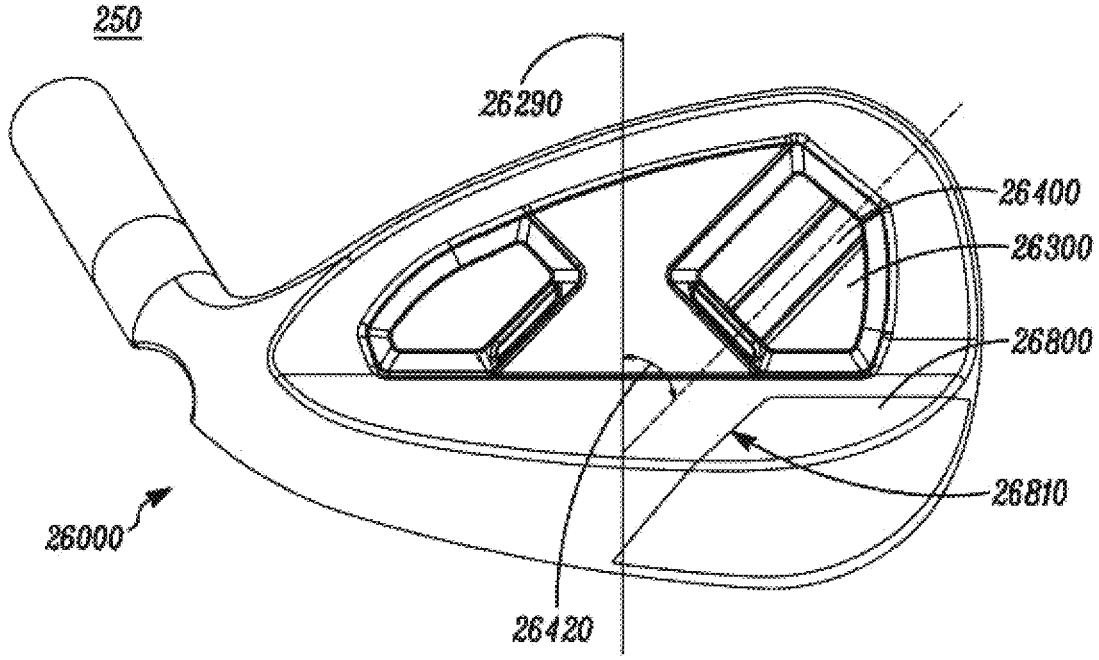
FIG. 26 illustrates a rear view of another club head of the club head set of FIG. 25.
Figure 27:
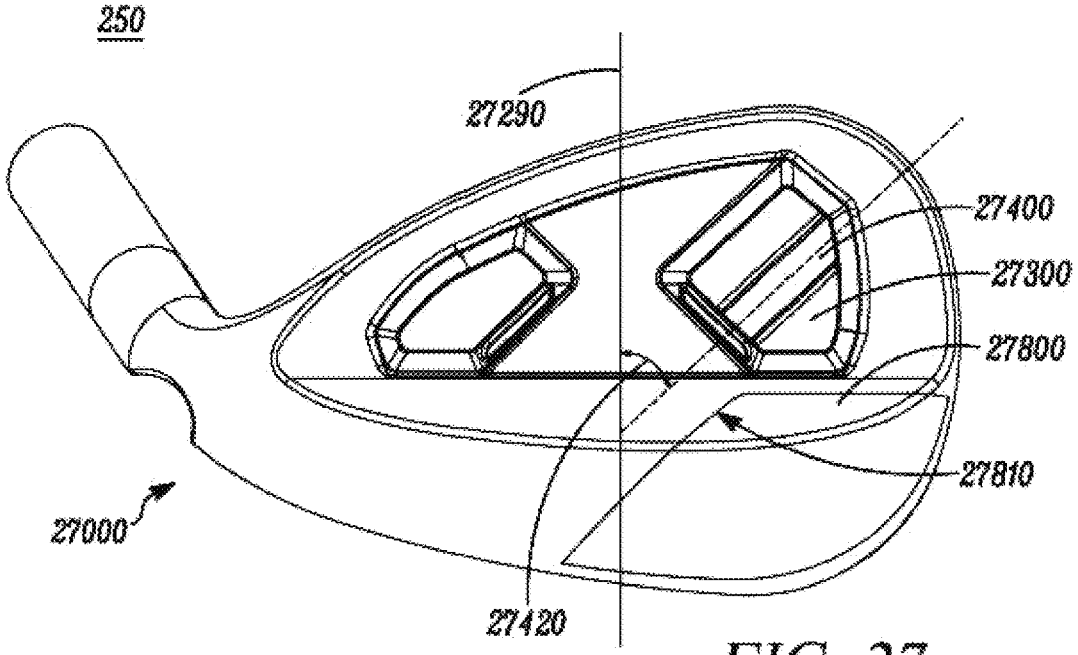
FIG. 27 illustrates a rear view of yet another club head of the club head set of FIG. 25.

Continuing with the figures, FIG. 25 presents a rear view of club head 25000 of club head set 250 according to an embodiment of the golf clubs and methods of manufacture described herein. FIG. 26 presents a rear view of club head 26000 of club head set 250, and FIG. 27 presents a rear view of club head 27000, also of club head set 250. Club head set 250 comprises one or more club heads, such as club heads 25000 (FIG. 25), 26000 (FIG. 26), and 27000 (FIG. 27), having respective diagonal stabilizing bars at their back faces. As will be described below, such diagonal stabilizing bars can be used for strengthening the club heads by reducing club head deformation and/or inhibiting vibrations with the club heads upon impact with a golf ball. In addition, in the same or other examples, such diagonal stabilizing bars may be angled, depending on the loft angle of the club heads, to be aligned with a strike path of the club head so as to better reinforce the club heads against deformation and/or absorb vibrations along expected impact points or paths, and/or to provide better desired directionality control for the impacted golf ball.

In the example of FIG. 25, club head 25000 is shown as a wedge iron head comprising back face 25100 opposite a strike face thereof. There can be other embodiments, however, where other types of club heads may be used, such as irons or iron-like club heads of higher or lower loft. Club head 25000 also comprises toe region 25210, heel region 25220, toe end 25230, heel end 25240, top rail or top end 25250, and sole or bottom end 25260. Vertical axis 25290 extends through top end 25250 and bottom end 25260, splitting club head 25000 between heel region 25220 and toe region 25210.

In the present example, back face 25100 of club head 25000 comprises cavity 25300 located at toe region 25210, where cavity 25300 comprises cavity base 25310, and cavity wall 25320 bounding at least a portion of cavity base 25310. Cavity base 25310 is sunk in relative to perimeter 25110 of back face 25100 in the present example, such that perimeter 25110 protrudes above cavity base 25310 and defines at least a portion of cavity wall 25320. There can be other examples, however, where cavity wall 25320 may not completely bound cavity base 25310, and/or where perimeter 25110 may not protrude above cavity base 25310. In some embodiments, perimeter 25110 is a perimeter weight, and/or cavity 25300 is located within or below a larger rear cavity defined by perimeter 25110. Although cavity 25300 is located only at toe region 25210 in the present embodiment, there can be other embodiments where cavity 25300 may extend at least partially into heel region 25220

Back face 25100 also comprises stabilizing bar 25400 protruded from cavity base 25310 and extending diagonally relative to vertical axis 25290. The length of stabilizing bar 25400 may extend fully or partially across cavity base 25310, depending on the embodiment. As seen in FIG. 25, bar axis 25410 extends along a length of stabilizing bar 25400, being intersected with vertical axis 25290, and extending therefrom to the high toe portion of back face 25100, towards toe end 25230 and top end 25250. In some examples, a thickness or height of stabilizing bar 25400 from cavity base 25310, and/or of other stabilizing bars of club head set 250, may be of approximately 0.010 inch to approximately 0.25 inch. In the same or other examples, a width of stabilizing bar 25400, and/or of other stabilizing bars or other club heads of club head set 250, may be of approximately 0.050 inch to approximately 0.75 inch. In the same or other examples, the thickness or width of stabilizing bar 25400 may vary along its length, such as to increase or decrease towards the high toe portion of back face 25100. In the present example, bar axis 25410 is angled at bar angle 25420 of approximately 43 degrees relative to vertical axis 25290. There can be embodiments where the angle between vertical axis 25290 and bar axis 25410 may range from approximately 40 degrees to approximately 50 degrees. Depending on the club head, other club heads of club head set 250 may comprise bar angles, similar to bar angle 25420, of approximately 25 degrees to approximately 65 degrees between their respective vertical and bar axes.

Figure 28:
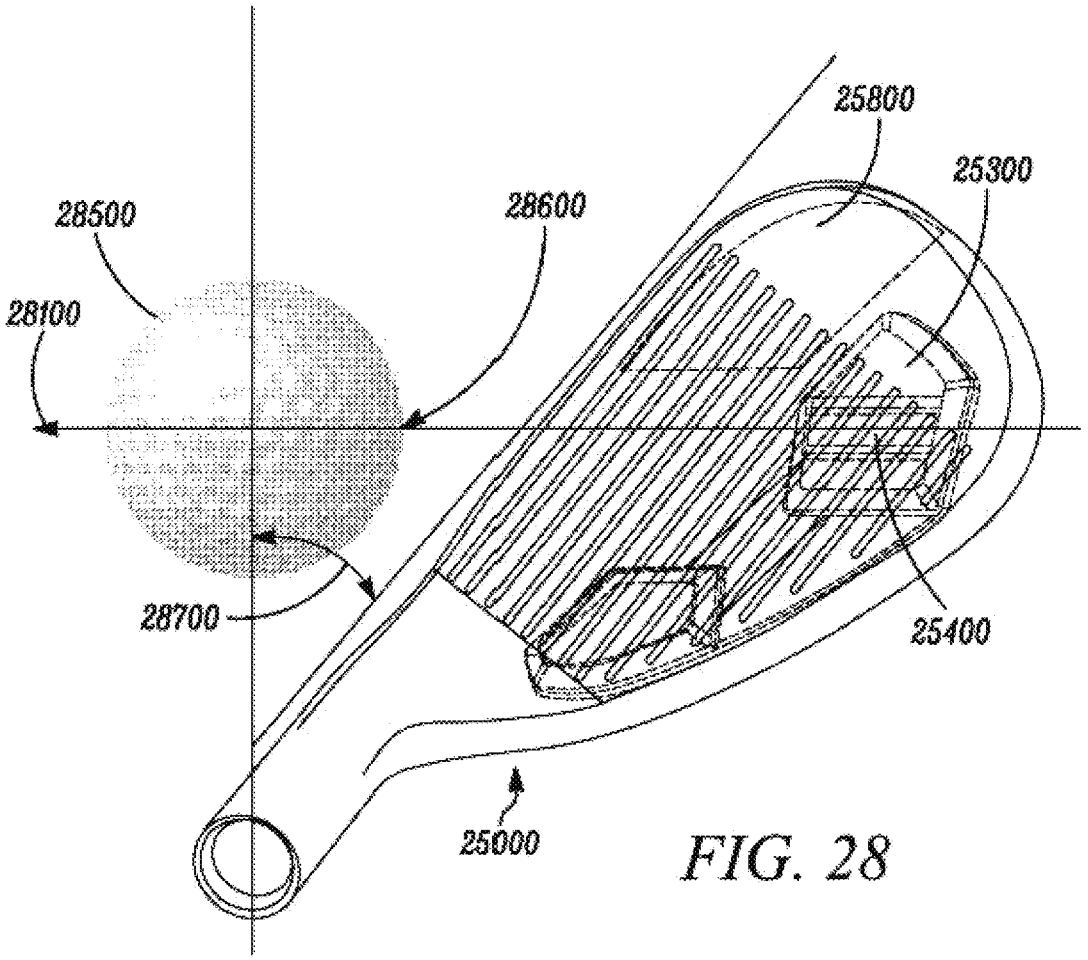
FIG. 28 illustrates a top "x-ray" view of the club head of FIG. 25 poised to strike a golf ball.

Skipping ahead in the figures, FIG. 28 illustrates a top x-ray view of club head 25000 along strike path 28100 and poised to strike golf ball 28500. In the present example, stability bar 25400 is angled at bar angle 25420 (FIG. 25), relative to vertical axis 25290 (FIG. 25), such that bar axis 25410 (FIG. 25) is substantially aligned with strike path 28100 when club head 25000 is proximate to impact point 28600 with golf ball 28500. As a result, stability bar 25400 is better positioned to receive, attenuate, and/or dissipate impact stresses and/or frequencies along its length upon impact with golf ball 28500 than if stability bar 25400 were aligned, for example, parallel or perpendicular to vertical axis 25290 (FIG. 25). In addition, because the length of stability bar 25400 is aligned substantially parallel with strike path 28100, when viewed from the top view of FIG. 28, stability bar 25400 may impart further consistency and directionality control to compel alignment of a flightpath of golf ball 2500 with strike path 28100.

As can be seen from the top view of FIG. 28, stability bar 25400 is angled to be substantially aligned with flight path 28100 when club head 25000 is at a target open face impact angle 28700 while proximate to impact point 28600. In some examples, one or more club heads may have stability bars similar to stability bar 25400, angled for substantial alignment with flight path 28100 for target open face impact angles of approximately 30 degrees to approximately 50 degrees. There also can be other examples, however, where stability bars could instead be angled such as to be aligned with flight path 28100 when their club heads are square or are at closed face impact angles when proximate to impact point 28600.

Backtracking to FIG. 26, club head 26000 comprises vertical axis 26290 similar to vertical axis 25290 (FIG. 25) of club head 25000 (FIG. 25), and stabilizing bar 26400 at cavity 26300, similar to stabilizing bar 25400 (FIG. 25). Stabilizing bar 26400 is angled, relative to vertical axis 26290, at bar angle 26420. FIG. 27 shows club head 27000 comprising vertical axis 27290 similar to vertical axis 25290 (FIG. 25) of club head 25000 (FIG. 25), and stabilizing bar 27400 at cavity 27300, similar to stabilizing bar 25400 (FIG. 25). Stabilizing bar 27400 is angled, relative to vertical axis 27290, at bar angle 27420.

The club heads in FIGS. 25-27 are each part of club head set 250, but differ from each other by comprising different lofts. In the present example, the loft of club head 27000 (FIG. 27) is greater than the loft of club head 26000 (FIG. 26), and the loft of club head 26000 (FIG. 26) is greater than the loft of club head 25000 (FIG. 25). Club head set 250 is configured such that the bar angles of its club heads vary based on the loft of its clubs. For example, bar angle 27420 (FIG. 27) is greater than bar angle 26420 (FIG. 26), and bar angle 26420 (FIG. 26) is greater than bar angle 25420 (FIG. 25). Accordingly, stabilizing bar 26400 (FIG. 26) will be substantially aligned with strike path 28100 (FIG. 28) when club head 26000 is at a target open face impact face angle greater than target open face impact angle 28700 (FIG. 28) of club head 25000 (FIG. 25). Similarly, stabilizing bar 27400 (FIG. 27) will be substantially aligned with strike path 28100 (FIG. 28) when club head 27100 is at a target open face impact angle greater than the target open face impact angle described above for club head 26000 (FIG. 26).

Consistent with the description above, in the present example, club head 25000 (FIG. 25) comprises a loft of approximately 52 degrees, comprises bar angle 25420 of approximately 43 degrees, and is configured for a target open face impact angle 28700 of approximately 37 degrees. Club head 26000 (FIG. 26) comprises a loft of approximately 56 degrees, comprises bar angle 26420 of approximately 44 degrees, and is configured for a target open face impact angle of approximately 38 degrees. Club head 27000 (FIG. 27) comprises a loft of approximately 60 degrees, comprises bar angle 27420 of approximately 47 degrees, and is configured for a target open face impact angle 28700 of approximately 42 degrees.

In the same or other embodiments, club head set 250 may comprise, in addition to, or instead of one or more of club heads 25000, 26000, and/or 27000, other club heads with different loft angles and corresponding characteristics. For instance, club head set 250 may comprise club heads with lofts of 50, 54, and/or 58 degrees, and/or lower lofted irons, with corresponding bar angle and target open face impact angle characteristics.

Several ranges can be implemented for the values described above. For example, there can be embodiments where club head 25000 (FIG. 25), club head 26000 (FIG. 26), club head 27000 (FIG. 27), and/or another club head of club head set 250 can comprise a loft of approximately 45 degrees to approximately 70 degrees, can comprise a bar angle of approximately 40 degrees to approximately 50 degrees, and/or can be configured for a target open face impact angle of approximately 30 degrees to approximately 50 degrees. In the same or other embodiments, where lower lofted irons are included, the lofts may range from approximately 18 degrees to approximately 70 degrees, and the bar angles may range from approximately 25 degrees to 65 degrees.

As can be seen in FIGS. 25-27, the club heads of club head set 250 comprise hourglass supports towards the middle of their respective back faces. As an example, club head 25000 comprises hourglass support 25600 protruding from back face 25100, where hourglass support 25600 comprises top portion 25630, bottom portion 25640, and middle portion 25650. Hourglass support 25600 also comprises toe sidewall 25610 and heel sidewall 25620, defining top portion 25630, bottom portion 25640, and middle portion 25650 therebetween. In the present example, cavity wall 25320 comprises toe sidewall 25610, such that toe sidewall 25610 protrudes above cavity base 25310. Also in the present example, the cavity wall 25720 of cavity 25700 comprises heel sidewall 25620, such that heel sidewall 25620 protrudes above the cavity base of cavity 25700

Hourglass support 25600 can be configured to provide several benefits to club head 25000. For example, by splitting the majority of its mass between top portion 25630 and bottom portion 25640, middle portion 25650 is made relatively lighter. Such an arrangement provides for improved moment of inertia about middle portion 25650 to improve stability on center impact hits at the strike face opposite middle portion 25650, and/or opposite cavities 25300 or 25700. In addition, the mass of the top portion of the hourglass support, located high on club head 25000, can be beneficial for positioning the center of gravity for optimal launch conditions and increasing moment of inertia. In some examples, middle portion 25650 of hourglass support 25600 can be located above a horizontal centerline 25280 of back face 25100, thereby further raising the center of gravity of club head 25000. Raising the center of gravity as described via hourglass support 25600 may provide for better launch control, permitting lower launch angles, and/or increased gear effect and ball spin, for a more stable golf ball flight path. In the same or other embodiments, top portion 25630 can be wider and/or thicker than bottom portion 25640 of hourglass support 25600.

Toe sidewall 25610 of hourglass support 25600 comprises top segment 25611 that defines, at least in part, top portion 25630 of hourglass support 25600. In the same or other examples, top segment 25611 is substantially parallel to stability bar 25400. Such parallel relationship may permit top segment 25611, and/or other parts of hourglass support 25600, to act in conjunction with stability bar 25400 to better receive, attenuate, and/or dissipate impact stresses, vibrations, and/or frequencies, and/or to assist in imparting better golf ball directionality control when aligned relative to strike path 28100 (FIG. 8). Toe sidewall 25610 also comprises bottom segment 25612 in the present example, defining at least in part bottom portion 25640 of hourglass support 25600. In some examples, bottom segment 25612 can be substantially perpendicular to stability bar 25400, and/or can be otherwise angled relative thereto.

Toe sidewall 25610 is substantially non-linear along middle portion 25650 of hourglass support 25600 in the present embodiment. In particular, in the present example, toe sidewall 25610 is angled thereat, approximating a "U" or "V" shape, such that an angle of approximately 80 degrees to approximately 100 degrees can exist between top portion 25611 and bottom portion 25612 of toe sidewall 25610.

In the present example, back face 25100 also comprises cavity 25700 located at heel region 25220. Cavity 25700 can be similar to cavity 25300, but comprises cavity wall 25720 which includes heel sidewall 25620 of hourglass support 25600. In FIG. 25, both of cavities 25700 and 25300 are located above horizontal centerline 25280. In the present example, cavity 25700 is devoid of a stabilizing bar similar to stabilizing bar 25400. There may be other embodiments, however, where a stabilizing bar could be provided at cavity 25700, such as for club heads configured for closed face impact angles. In such examples where a stabilizing bar is provided at cavity 25700, such stability bar may be parallel to a top segment of heel sidewall 25620 of hourglass support 25600, parallel to the angle of stability bar 25400, substantially perpendicular to the angle of stability bar 25400, and/or otherwise angled, such as in alignment with a strike path of its club head while at a target face impact angle. In the same or other examples, where cavity 25700 comprises a stability bar, cavity 25300 may or may not comprise stability bar 25400.

As can be seen in FIGS. 25-27, the club heads of club head set 250 also comprise respective toe weights that can vary depending on the loft angle of their club heads. For example, in FIG. 25, club head 25000 comprises toe weight 25800 located at toe region 25210 towards bottom end 25260. Toe weight 25800 comprises weight surface 25810 facing towards heel region 25240, where weight surface 25810 is angled relative to vertical axis 25290. Similarly, in FIG. 26, club head 26000 comprises toe weight 26800 with weight surface 26810 angled relative to vertical axis 25290, and in FIG. 27, club head 27000 comprises toe weight 27800 with weight surface 27810 angled relative to vertical axis 27290. In the present example of club head set 250, the angles of weight surfaces 25810 (FIG. 25), 26810 (FIG. 26), and 27810 (FIG. 27) vary in accordance with the loft of their respective club heads, similar to the variation described above with respect to the angles of stability bars 25400 (FIG. 25), 26400 (FIG. 26) and 27400 (FIG. 27). For example, where the loft of club head 27000 is greater than the loft of club head 26000 and where the loft of club head 26000 is greater than the loft of club head 25000, the angle of weight surface 27810 relative to the vertical axis is greater than the angle of weight surface 26810 relative to the vertical axis, and the angle of weight surface 26810 relative to the vertical axis is greater than the angle of weight surface 25810 relative to the vertical axis. In the present example, the angled weight surfaces are aligned substantially parallel to their corresponding stabilizing bars, such that weight surface 25810 is substantially parallel to stabilizing bar 25400 (FIG. 25), weight surface 26810 is substantially parallel to stabilizing bar 26400 (FIG. 26), and weight surface 27810 is substantially parallel to stabilizing bar 27400 (FIG. 27). In the same or other examples, such variation in the angles of the weight surfaces can provide benefits similar to those described above with respect to the variation between stabilizing bars 25400 (FIG. 25), 26400 (FIG. 26), and 27400 (FIG. 27), such as by aligning weight surfaces 25810, 26810, 27810 with respective strike paths when their club heads are at respective target face impact angles. There may be other examples, however, where club heads of a club head set similar to club head set 250 need not comprise respective toe weights, or may comprise respective toe weights that do not necessarily vary depending on the loft angle of their club heads.

Figure 29:
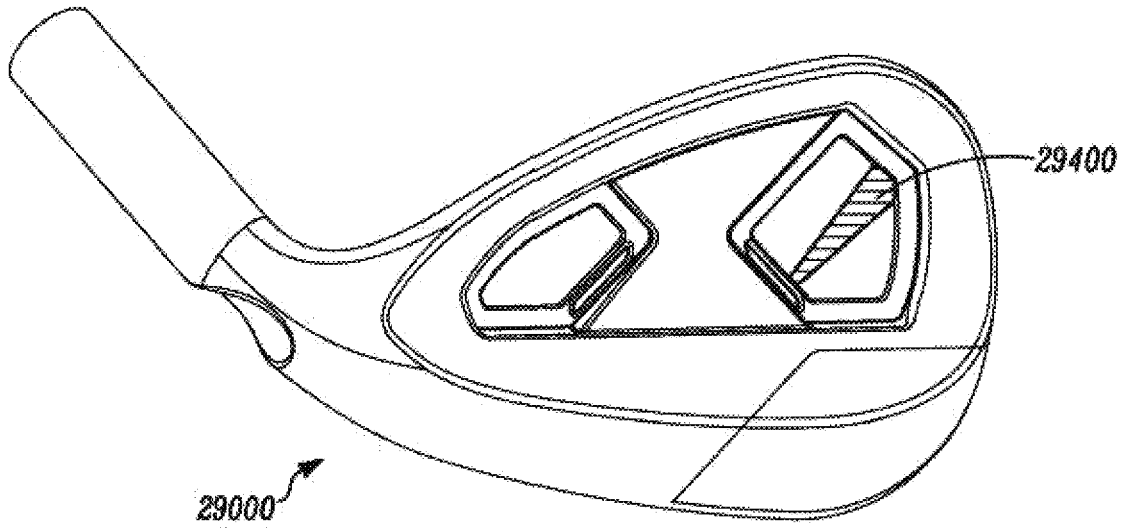
FIG. 29 illustrates a rear view of a club head similar to that of FIG. 25 and with a varying stabilizing bar.

Continuing with the figures, FIG. 29 illustrates a rear view of club head 29000. Club head 29000 can be similar to club head 25000 (FIG. 25), but comprises stabilizing bar 29400. Stabilizing bar 29400 is similar to stabilizing bar 25400 (FIG. 25), but increases in width towards a top toe end of club head 29000. In the same or other examples, stabilizing bar 29400 can also, or alternatively, increase in thickness towards the top toe end of club head 29000. In some examples, increasing the width or thickness of the stabilizing bar towards the top toe end of the club head can provide additional structural support to the high toe region thereof, and/or provide further reinforced area along a broader path aligned for impact with a golf ball. Such reinforcement can further reduce deformation and absorb further stresses at impact. Additionally, the increase width and/or thickness can position the center of gravity of the club head higher for increased spin rate and greater moment of inertia.

Figure 30:
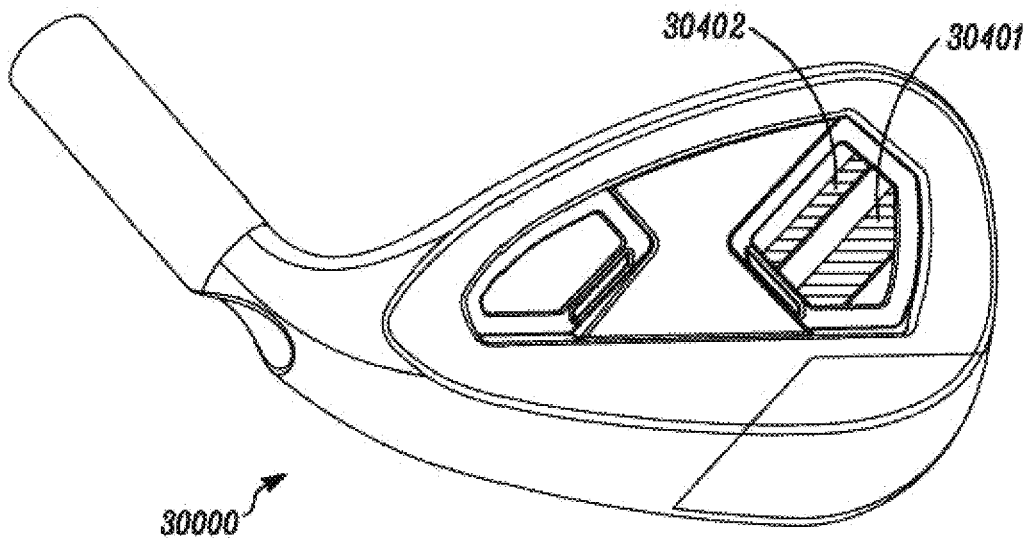
FIG. 30 illustrates a rear view of a club head similar to that of FIG. 25 and with a plurality of stabilizing bars.

FIG. 30 illustrates a rear view of club head 30000. Club head 30000 is similar to club head 25000 (FIG. 25), but comprises stabilizing bars 30401 and 30402 rather than just a single stabilizing bar like stabilizing bar 25400 (FIG. 25). In the present example, stabilizing bars 30404 and 30402 are angled as described above for stabilizing bar 25400 (FIG. 25), but stabilizing bar 30401 is wider than stabilizing bar 30402, and is located closer to the toe end of club head 30000 than stabilizing bar 30402. In the same or other examples, stabilizing bar 30401 can be thicker or taller in addition to, or instead of, wider than stabilizing bar 30402. Similarly, in the same or other examples, the widths of stabilizing bar 30401 and 30402 can be the same. In some embodiments, additional stabilizing bars can provide further structural support across the toe region of club head. While a single stabilizing bar provides reinforcement at a particular location, added bars can increase support over a larger cross section of the face.

Figure 31:
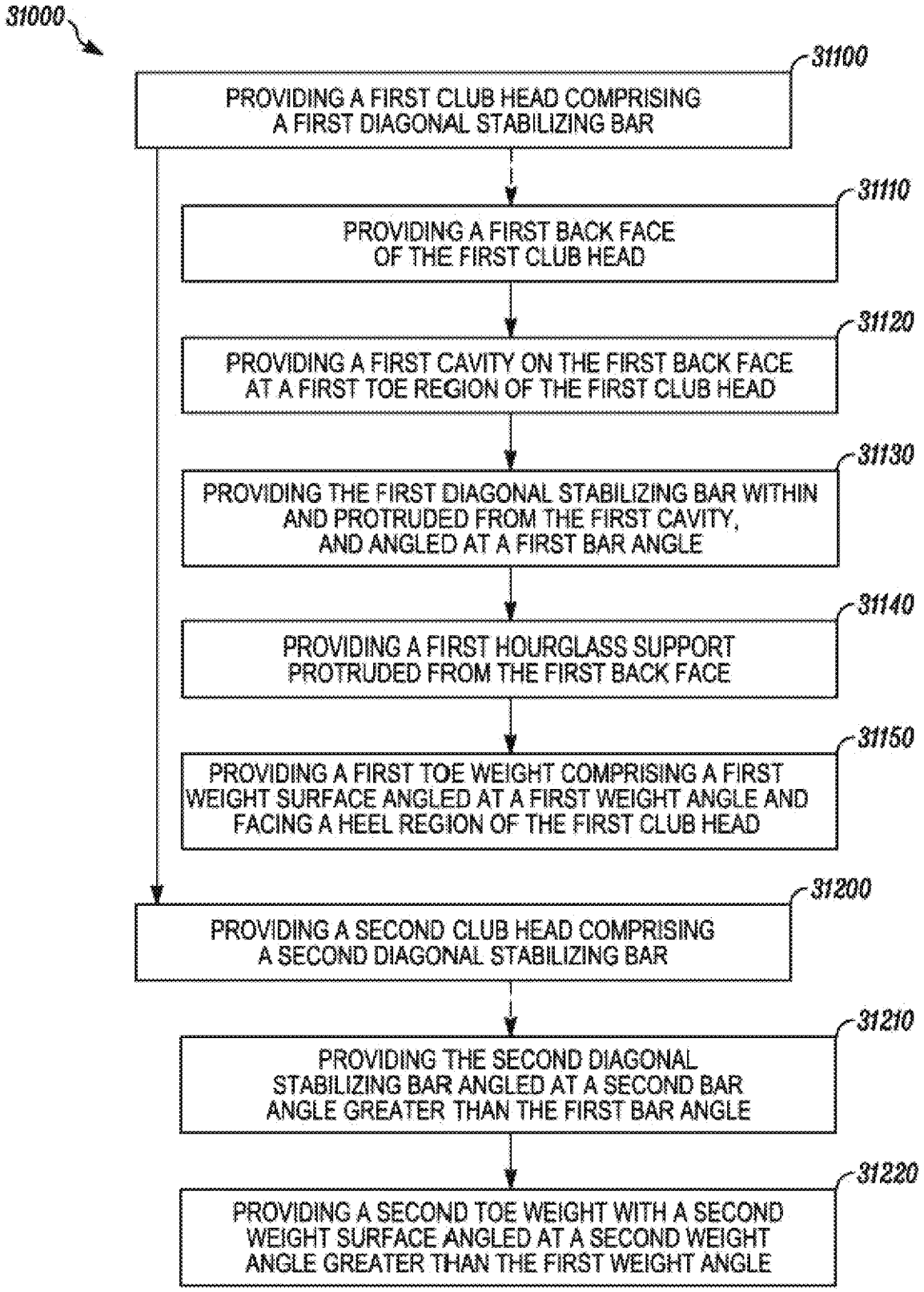
FIG. 31 illustrates a flowchart of a method for providing a club head set in accordance with FIGS. 25-30.

Moving along, FIG. 31 illustrates a flowchart of method 31000 for providing a golf club head set. In some examples, the golf club head set of method 31000 can be similar to golf club head set 250 described with respect to FIGS. 25-28, and/or to a golf club head set comprising club heads similar to those of FIGS. 29 and/or 30. The golf club head set may comprise one or more club heads comprising diagonal stabilizing bars.

Block 31100 of method 31000 comprises providing a first club head comprising a first diagonal stabilizing bar. In some examples, the first club head can be similar to one of the club heads of club head set 250 described above, such as club head 25000 (FIG. 25), club head 29000 (FIG. 29), or club head 30000 (FIG. 30). A first vertical axis may be defined to extend through first top and first bottom ends of the first club head, and between first heel and first toe regions of the first club head. In some examples, the first vertical axis can be similar to vertical axis 25290 (FIG. 25), and the first toe region can be similar to toe region 25210 (FIG. 25).

Block 31100 can comprise sub-block 31110, in some examples, for providing a first back face of the first club head. As an example, the first back face can be similar to back face 25100 of club head 25000 (FIG. 25). The first back face can be located opposite a first strike face of the first club head. The first club head may be provided, for example, via a casting or forging process.

Next, block 31100 can comprise sub-block 31120 for providing a first cavity on the first back face at the first toe region of the first club head. The first cavity can be similar to first cavity 25300 (FIG. 25), and may comprise a first cavity base similar to cavity base 25310, and a first cavity wall bounding the first cavity base and similar to cavity wall 25320 (FIG. 25). In some examples, a perimeter of the first club head may protrude above the first cavity base and/or define a portion of the first cavity wall, such as seen in FIG. 25 with respect to perimeter 25110 protruding above cavity base 25310. In the same or other examples, the first back face may be configured such that the first cavity is located only at the first toe region of the first club head.

Block 31100 of method 31000 can also comprise sub-block 31130 for providing the first diagonal stabilizing bar within and protruded from the first cavity, and angled at a first bar angle relative to a vertical axis of the first club head. The first diagonal stabilizing bar may be similar to stabilizing bar 25400 (FIG. 25), and may comprise a first bar axis extending along a length of the first bar, similar to bar axis 25410 (FIG. 25). The first bar axis can be aligned to intersect the first vertical axis, and to extend therefrom towards a high toe portion of the first club head. In some examples, the first diagonal stabilizing bar may be forged or cast with the first club head, and/or may be machined therefrom. There can be other examples where the first diagonal stabilizing bar does not comprise a single piece of material with the first back face.

There can be embodiments where the first bar axis can be angled at the first bar angle such that the first bar axis can be substantially aligned with a strike path of the first club head when the first club head is proximate to an impact point with a golf ball along the strike path. In some examples, such alignment of the first bar axis and/or the first stabilizing bar can be as described above with respect to FIG. 28 for stabilizing bar 25400 relative to strike path 28100. In the same or other examples, the alignment of the first bar axis and/or of the first stabilizing bar can be configured with respect to target face impact angles as described above with respect to the club heads of FIGS. 25-28.

There can also be embodiments with other configurations for the first diagonal stabilizing bar. As an example, in some embodiments, at least one of a thickness or a width of the first diagonal stabilizing bar may be configured to increase towards the first top end of the first club head, as described above with respect to FIGS. 25 and 29. As another example, a second diagonal stabilizing bar may be located in the first cavity, parallel to the first diagonal stabilizing bar, as described with respect to FIG. 30. In such examples, the second diagonal stabilizing bar may be thicker and/or wider than the first diagonal stabilizing bar, and can be located closer to the first toe end of the first club head than the first diagonal stabilizing bar.

In some examples, block 31100 may further comprise sub-block 31140 for providing a first hourglass support protruded from the first back face. There can be examples where the first hourglass support may be similar to hourglass support 25600 (FIG. 25). The first hourglass support may be machined at the first back face in some examples, but there can also be examples where the first hourglass support need not comprise a single piece of material with the first back face. In some implementations, the first hourglass support may comprise top, bottom, and middle portions that may be respectively similar to top portion 25630, bottom portion 25640, and/or middle portion 25650 of hourglass support 25600 (FIG. 25). The first hourglass support may also comprise heel and toe hourglass sidewalls, which may be respectively similar to heel sidewall 25620 and/or toe sidewall 25610 of hourglass support 25600 (FIG. 25). In some embodiments, the toe hourglass sidewall may protrude above the first cavity of block 31120, and/or may comprise a portion of the first cavity wall. There can also be examples where a top segment of the toe hourglass sidewall can be substantially parallel to the first bar axis of the first diagonal stabilizing bar. In the same or other examples, the toe hourglass sidewall can be non-linear along the middle hourglass portion of the first hourglass support, as seen for toe sidewall 25610 in FIG. 25. In the same or other embodiments, the heel hourglass sidewall may protrude above a second cavity of the first club head. For example, such second cavity can be located at the heel region of the first club head, and/or can be similar to cavity 25700 (FIG. 25) in some embodiments.

Block 31100 may comprise, in some embodiments, sub-block 31150 for providing a first toe weight comprising a first weight surface angled at a first weight angle and facing a heel region of the first club head. The first toe weight can be located at the first toe region and towards the first bottom end of the first club head, and the first weight surface can face towards the first heel region at a first weight angle relative to the first vertical axis of the first club head. In some examples, the first toe weight can be similar to toe weight 25800, and the first weight surface can be similar to weight surface 25810 (FIG. 25). In the same or other example, the first toe weight can be similar to insert 895 (FIG. 8), such as by comprising similar material(s).

In some examples, method 31000 can comprise block 31200 for providing a second club head comprising a second diagonal stabilizing bar. The second club head can be similar, in some examples to another one of the club heads of club head set 250, such as one of club heads 26000 (FIG. 26) or 27000 (FIG. 27).

Block 31200 comprises sub-block 31210 for providing the second diagonal stabilizing bar angled at a second bar angle greater than the first bar angle. In some examples, the loft of the second club head of block 31200 can be greater than the loft of the first club head of block 31100, such that bar angles increase with increasing lofts. In some embodiments, the second diagonal stabilizing bar can be similar to stabilizing bar 26400 at bar angle 26420 (FIG. 26)

Block 31200 can also comprise, in some examples, sub-block 31220 for providing a second toe weight with a second weight surface angled at a second weight angle greater than the first weight angle. There can be embodiments where the second toe weight can be similar to toe weight 26800 with weight surface 26810.

In some examples, one or more of the different blocks of method 31000 can be combined into a single block or performed simultaneously, and/or the sequence of such blocks can be changed. For example, sub-blocks 31120 and 31130 may be carried out concurrently with sub-block 31110 in some examples, such as when casting, forging, and/or machining the first club head. In the same or other examples, some of the blocks of method 31000 can be subdivided into several sub-blocks. For example, sub-block 31150 may comprise a sub-block for coupling the first toe weight to the first club head, such as by welding or via adhesives. There can also be examples where method 31000 can comprise further or different blocks. As an example, another block similar to block 31100 and/or corresponding sub-blocks 31110, 31120, 31130, 31140, and/or 31150 may be provided for providing a third club head comprising a third diagonal stabilizing bar, such as for club head 27000 (FIG. 27) or other club heads of club head set 250. In addition, there may be examples where method 31000 can comprise only part of the steps described above. For instance, sub-block 31150 may be optional in some embodiments. Other variations can be implemented for method 31000 without departing from the scope of the present disclosure. Although the club head sets with varying characteristics and related methods have been described with reference to specific embodiments, various changes may be made without departing from the spirit or scope of the disclosure. Additional examples of such options and other embodiments have been given in the foregoing description. Accordingly, the disclosure herein of embodiments of club head sets with varying characteristics and related methods is intended to be illustrative of the scope of the present disclosure and is not intended to be limiting. For example, in one embodiment, a golf club head may have one or more features of FIGS. 1-5, with or without the other features described with reference to FIGS. 1-5. In another example, the club head sets described above with respect to FIGS. 8-21 may comprise more or less club heads than those listed in FIGS. 16 and 19, and the loft angles, support bar characteristics, and/or lower toe insert weight attributes may differ from those in the examples of FIGS. 8-21 while still being related to each other. As yet another example, club heads in accordance with the implementations discussed for FIGS. 25-31 may have corresponding stabilizing bars of several shapes, such as rectangular, triangular, trapezoidal, circular, crescent, and/or rhomboid shapes, and/or may have corresponding stabilizing bars of several patterns, such as solid, waffle, dimpled, honeycomb, growth, and/or reduction patterns, while still embracing the teachings of the present disclosure. Other permutations of the different embodiments having one or more of the features of the various figures are likewise contemplated. It is intended that the scope of the club head sets with varying characteristics and related methods shall be limited only to the extent required by the appended claims.

Figure 32:
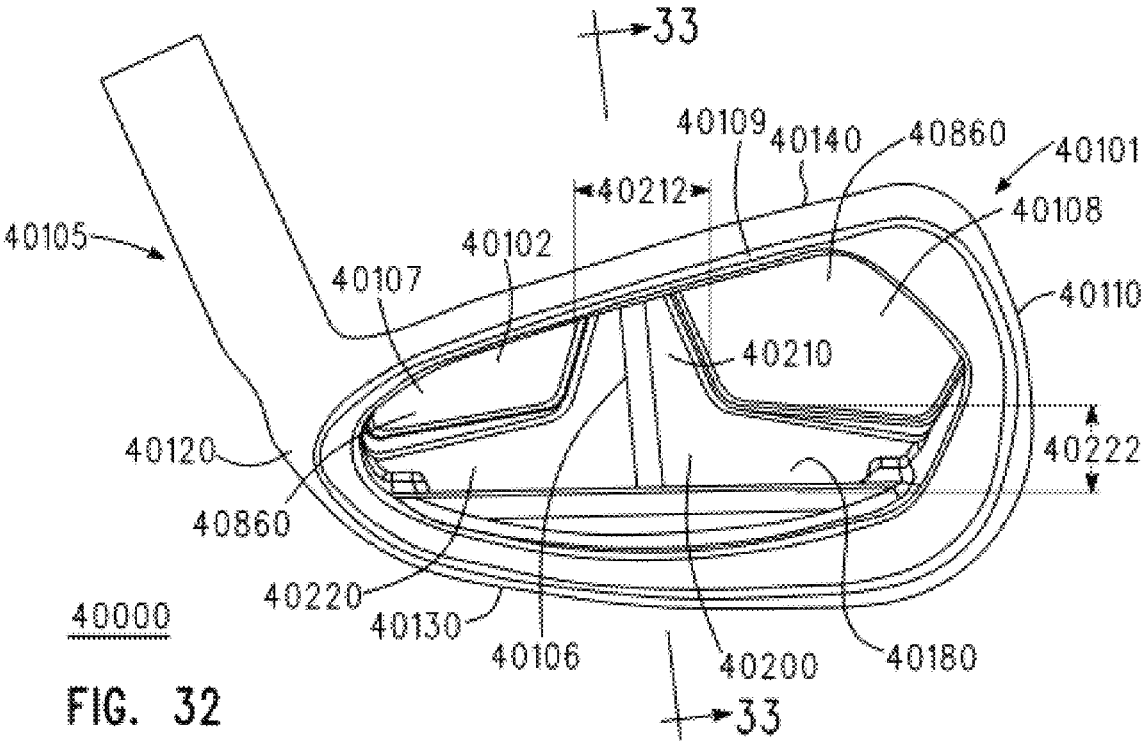
FIG. 32 illustrates a rear view of an exemplary golf club head according to an embodiment of the golf clubs and methods of manufacture described herein.
Figure 33:
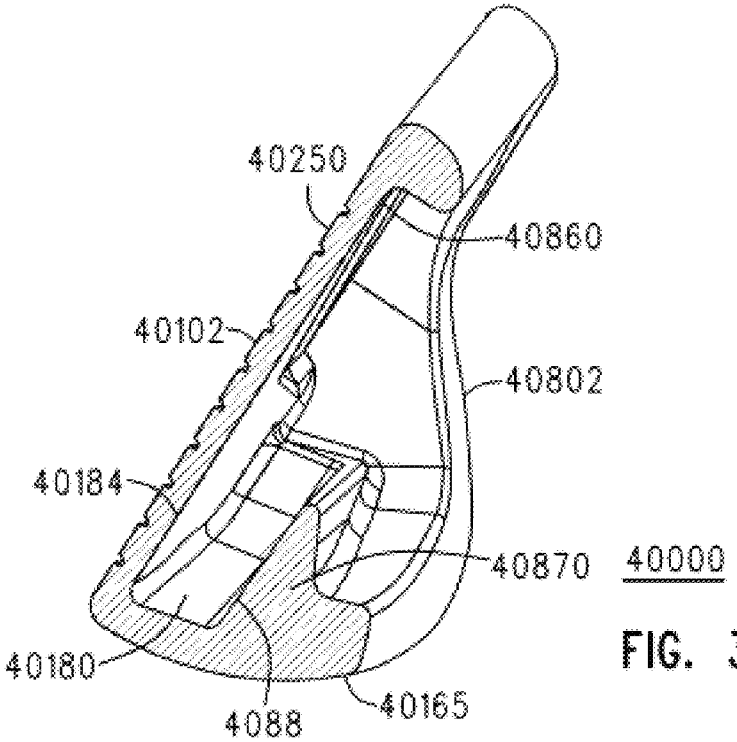
FIG. 33 illustrates a cross sectional view taken from a section line 33-33 of the golf club head of FIG. 32.
Figure 34:
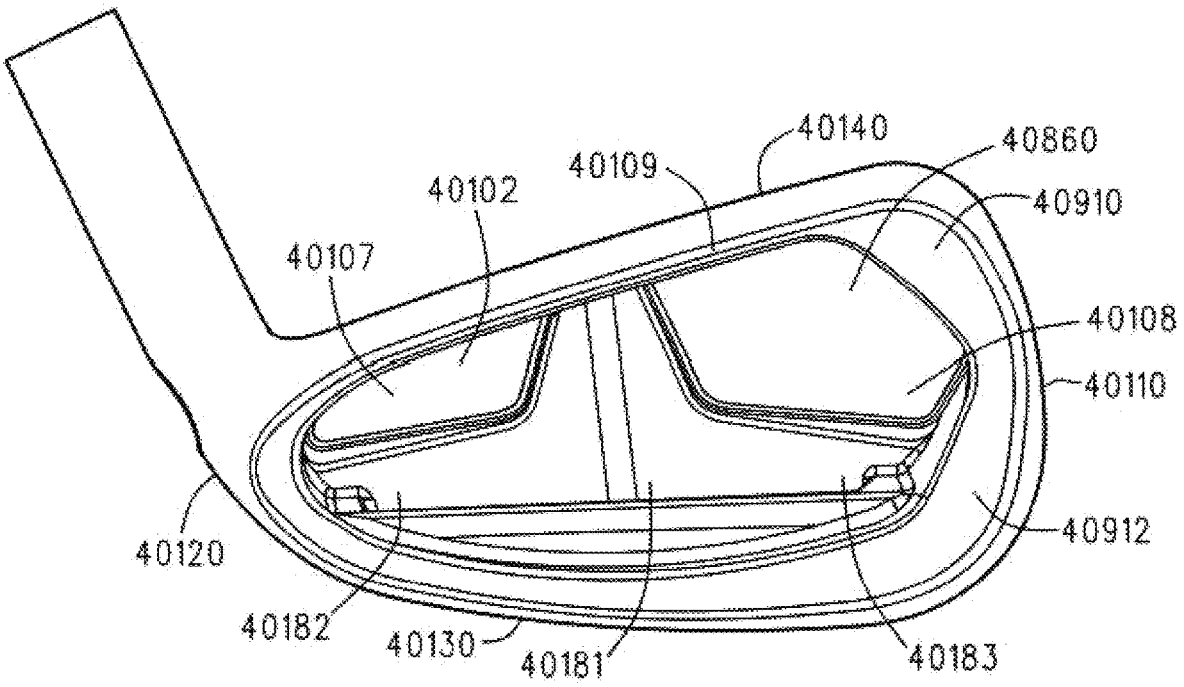
FIG. 34 illustrates another rear view of the exemplary golf club head of FIG. 32.

FIGS. 32-34 illustrate a golf club head 40000 of golf club head set 45000 according to an embodiment of the golf clubs and methods of manufacture described herein. Club head 40000 can be similar to club head 100 and club head 800, and golf club comprising club head 40000 can be similar to a golf club comprising club head 100 and a golf club comprising club head 800. The club head 40000 comprises a body 40101 having a strike face 40102 with a front face 40250 and a back face 40860, a toe region 40110, a heel region 40120 opposite the toe region 40110, a hosel 40105 at the heel region 40120, a sole region 40130, and a top region 40140 opposite the sole region 40130. The sole region 40130 may extend from the heel region 40120 to the toe region 40110, and the sole region 40130 may extend from the front face 40250 to a back sole edge 40165. The club head 40000 also comprises a back portion 40802 comprising back face 40860 opposite front face 40250 and extending between toe region 40110 and heel region 40120 of back portion 40802. In a different embodiment, the golf club head 40000 may have a bore (not shown), instead of the hosel 40105, at the heel region 40120.

Referring to FIG. 32, the club head 40000 further comprises a support structure 40200 protruding from back face 40860. The support structure 40200 includes a central support bar 40210 and a bottom support bar 40220. The central support bar 40210 is positioned in the center region and extends from near the top of the strikeface 40102 to near the bottom of the strikeface 40102. Further, the central support bar 40220 includes a width 40212 measured in a heel to toe direction of the club head 40000 (i.e. measured in a direction from extending from the heel region 40120 to the toe region 40110). In the illustrated embodiment, the width 40212 of the central support bar 40210 increases from near the top region 40140 to near the sole region 40130 of the club head 40000. In other embodiments, the width 40212 of the central support bar 40210 may remain constant, or the width 40212 of the central support bar 40210 may decrease from near the top region 40140 to near the sole region 40130 of the club head 40000. The bottom support bar 40220 is positioned below the center of the back face 40860 and extends from near the heel region 40120 to near the toe region 40110 of the club head 40000. Further, the bottom support bar 40220 includes a height 40222 measured in a top to bottom direction of the strikeface 40102 (i.e. measured in a direction extending from the top region 40140 to the sole region 40130). In the illustrated embodiment, the height 40222 of the bottom support bar 40220 decreases from near the center to near the heel portion 40120 and near the toe portion 40110 of the club head 40000. In other embodiments, the height 40222 of the bottom support bar 40220 may be constant from near the center to near the heel portion 40120 and near the toe portion 40110 of the club head 40000, or the height 40222 of the bottom support bar 40220 may increase from near the center to near the heel portion 40120 and near the toe portion 40110 of the club head 40000.

In the present embodiment, support bars 40210 and 40220 are integrally formed and comprise substantially the same support bar thickness, as measured from back face 40860. Although the support bar thickness is constant for both support bars 40210 and 40220 in the example of FIG. 32, there can be other examples where the support bar thickness tapers or otherwise varies along a length of a support bar.

Support bars 40210 and 40220 are integral with back face 40860 in the present embodiment by comprising part of the same piece of material. For example, support bars 40861 can be cast, forged, or machined along with back face 40860. There can be other embodiments where support bars 40210 and 40220 may not be integral with their respective back faces, but are securely attached thereto. In such examples, the support bars can be welded, brazed, epoxied, or otherwise adhered to the back faces. The strike face 40102 of the club head 40000 includes a thickness measured as the perpendicular distance from the front face 40250 to the back face 40860. In the illustrated embodiment, the thickness of the strike face 40102 varies according to a strike face zone, as described below. In other embodiments, the thickness of the strike face 40102 may be substantially constant.

Referring to FIG. 32, the strike face 40102 has a central zone 40106, a heel zone 40107, a toe zone 40108, and a perimeter zone 40109. The central zone 40106 comprises a portion of the strike face 40102 reinforced by the central support bar 40210. The heel zone 40107 comprises a portion of the strike face 40102 devoid of reinforcement from the support structure 40200 near the heel region 40120 of the club head 40000. The toe zone 40108 comprises a portion of the strike face 40102 devoid of reinforcement from the support structure 40200 near the toe region 40110 of the club head 40000. The perimeter zone 40109 comprises a portion of the club head surrounding the central zone 40106, the heel zone 40107, the toe zone 40108, and the bottom support bar 40220.

In the illustrated embodiment the thickness of the strike face in the heel zone is approximately the same as the thickness of the strike face in the toe zone. Further, in the illustrated embodiment, the thickness of the strike face in the heel zone and the toe zone are less than the thickness of the strike face in the central zone, and the thickness of the strike face in the central zone is less than the thickness of the strike face in the perimeter zone.

For example, in the illustrated embodiment, the thickness of the strike face 40102 in the heel zone 40107 is approximately 0.075 inch (0.19 cm). In many embodiments, the thickness of the faceplate in the heel zone 40107 ranges from approximately 0.067 inch (0.17 cm) to 0.082 inch (0.21 cm). In other embodiments, the thickness of the strike face 40102 in the heel zone 40107 can be less than approximately 0.10 inch (0.25 cm), less than approximately 0.09 inch (0.23 cm), less than approximately 0.08 inch (0.20 cm), or less than approximately 0.07 inch (0.18 cm).

For further example, in the illustrated embodiment, the thickness of the strike face 40102 in the toe zone 40108 is approximately 0.075 inch (0.19 cm). In many embodiments, the thickness of the faceplate in the toe zone 40108 ranges from approximately 0.067 inch (0.17 cm) to 0.082 inch (0.21 cm). In other embodiments, the thickness of the strike face 40102 in the toe zone 40108 can be less than approximately 0.10 inch (0.25 cm), less than approximately 0.09 inch (0.23 cm), less than approximately 0.08 inch (0.20 cm), or less than approximately 0.07 inch (0.18 cm).

For further example, in the illustrated embodiment, the thickness of the strike face 40102 in the central zone 40106 is approximately 0.085 inches. In many embodiments, the thickness of the faceplate in the central zone 40106 ranges from approximately 0.078 inch (0.20 cm) to 0.092 inch (0.23 cm). In other embodiments, the thickness of the strike face 40102 in the central zone 40106 can range from approximately 0.065 inch (0.17 cm) to 0.15 inch (0.38 cm). For example, the thickness of the strike face 40102 in the central zone 40106 can be approximately 0.065 inch (0.17 cm), approximately 0.070 inch (0.18 cm), approximately 0.075 inch (0.19 cm), approximately 0.080 inch (0.20 cm), approximately 0.085 inch (0.22 cm), approximately 0.090 inch (0.23 cm), approximately 0.095 inch (0.24 cm), approximately 0.100 inch (0.25 cm), approximately 0.105 inch (0.27 cm), approximately 0.110 inch (0.28 cm), or approximately 0.115 inch (0.29 cm).

For further example, in the illustrated embodiment, the thickness of the strike face 40102 in the perimeter zone 40109 is approximately 0.160 inch (0.406 cm). In many embodiments, the thickness of the faceplate in the perimeter zone 40109 ranges from approximately 0.140 inch (0.356 cm) to 0.180 inch (0.457 cm). In other embodiments, the thickness of the strike face 40102 in the perimeter zone 40109 can be less than or equal to approximately 0.260 inch (0.660 cm). For example, the thickness of the strike face 40102 in the perimeter zone 40109 can be less than or equal to approximately 0.260 inch (0.660 cm), less than or equal to approximately 0.240 inch (0.610 cm), less than or equal to approximately 0.220 inch (0.559 cm), less than or equal to approximately 0.200 inch (0.508 cm), less than or equal to approximately 0.180 inch (0.457 cm), less than or equal to approximately 0.160 inch (0.406 cm), or less than or equal to approximately 0.140 inch (0.356 cm).

In many embodiments, strikeface 40102 can comprise an upper region and a lower region. In these embodiments, upper region can comprise a region of the strikeface 40102 above the cavity 40180 or between the top of the cavity 40180 and the top end of the strikeface 40102. Further, in these embodiments, lower region can comprise a region of the strikeface 40102 in front of or within the cavity 40180 or between the top of the cavity 40180 and the bottom end of strikeface 40102.

In some embodiments, an upper thickness of upper region can be measured from the front face 40250 to the back face 40860 in a direction substantially perpendicular to front face 40250 in the upper region of the strikeface 40102. In many embodiments, the upper thickness can vary defining a lowest or minimum upper thickness. In many embodiments, minimum upper thickness can be 0.06 inch (0.152 cm) to 0.12 inch (0.305 cm). In many embodiments, minimum upper thickness can be less than or equal to 0.12 inch (0.305 cm), less than or equal to 0.11 inch (0.279 cm), less than or equal to 0.10 inch (0.254 cm), less than or equal to 0.09 inch (0.2286 cm), less than or equal to 0.08 inch (0.2032 cm), less than or equal to 0.07 inch (0.1778 cm), or less than or equal to 0.06 inch (0.1524 cm). For example, in some embodiments, minimum upper thickness can be approximately 0.06 inch (0.1524 cm), 0.07 inch (0.1778 cm), 0.08 inch (0.2032 cm), 0.09 inch (0.2286 cm), or 0.1 inch (0.254 cm).

In some embodiments, a lower thickness of lower region can be measured from the front face 40250 to the back face 40860 in a direction substantially perpendicular to front face 40250 in the lower region of the strikeface 40102. In many embodiments, the lower thickness can vary defining a lowest or minimum lower thickness. In many embodiments, minimum lower thickness can be less than minimum upper thickness. In some embodiments, minimum lower thickness of lower region can be 0.05 inch (0.127 cm) to 0.10 inch (0.254 cm). In many embodiments, minimum lower thickness can be less than or equal to 0.10 inch (0.254 cm), less than or equal to 0.09 inch (0.2286 cm), less than or equal to 0.08 inch (0.2032 cm), less than or equal to approximately 0.07 inch (0.1778 cm), less than or equal to 0.06 inch (0.1524 cm), or less than or equal to 0.05 inch (0.127 cm). For example, in some embodiments, minimum lower thickness can be approximately 0.05 inch (0.127 cm), 0.06 inch (0.1524 cm), 0.07 inch (0.1778 cm), 0.08 inch (0.2032 cm), or 0.09 inch (0.2286 cm).

In many embodiments, the minimum lower thickness is greater than the minimum upper thickness. In other embodiments, the minimum lower thickness can be less than the minimum upper thickness. In many embodiments, a minimum thickness of the strikeface 40102 including the upper region and lower region, measured from the front face 40250 to the back face 40860 in a direction substantially perpendicular to front face 40250, can be less than or equal to 0.11 inch (0.279 cm), less than or equal to 0.10 inch (0.254 cm), less than or equal to 0.09 inch (0.2286 cm), less than or equal to 0.08 inch (0.2032 cm), less than or equal to 0.07 inch (0.1778 cm), less than or equal to 0.06 inch (0.1524 cm), or less than or equal to 0.05 inch (0.127 cm).

Referring to FIG. 33, the front face 40250 of the club head 40000 includes a surface area. In the illustrated embodiment, the surface area of the front face 40250 ranges from approximately 4.0 $in^2$ to approximately 5.5 $in^2$. In other embodiments, the surface area of the front face 40250 can range from approximately 3.0 $in^2$ to approximately 6.0 $in^2$. For example, the surface area of the front face 40250 can be approximately 3.00 $in^2$, approximately 3.25 $in^2$, approximately 3.50 $in^2$, approximately 3.75 $in^2$, approximately 4.00 $in^2$, approximately 4.25 $in^2$, approximately 4.50 $in^2$, approximately 4.75 $in^2$, approximately 5.00 $in^2$, approximately 5.25 $in^2$, approximately 5.50 $in^2$, approximately 5.75 $in^2$, or approximately 6.00 $in^2$.

The golf club head 40000 further comprises a cavity 40180 configured to receive a cavity insert 40185. Cavity 40180 is located at back portion 40802, between back face 40860 and back end 40870, and comprises cavity heel zone 40182, cavity toe zone 40183, cavity center zone 40181, cavity inner section 40184 located towards front face 40250, and cavity outer section 40885 located towards back end 40870. In the present example, cavity inner section 40184 is located opposite back face 40860, and cavity outer section 40885 is located opposite back end 40870. In the illustrated embodiment, cavity 40180 is wider at cavity center zone 40181 than at either of cavity heel zone 40182 or cavity toe zone 40183.

In the present example, a distance between front face 40250 and an exposed surface of cavity inner section 40184 is greater at cavity heel zone 40182 and at cavity toe zone 40183 than at cavity center zone 40181. There can also be embodiments where a distance between back end 40870 and an exposed surface of cavity outer section 40885 can be greater at cavity heel zone 40182 and at cavity toe zone 40183 than at cavity center zone 40181. In the illustrated embodiment, the cavity 40180 has a volume ranging from approximately 4.5 cubic centimeters (cc) to approximately 5.0 cc. In other embodiments, the cavity 40180 can have any volume greater than approximately 4.0 cc. For example, the cavity 40180 can have a volume greater than approximately 4.0 cc, greater than approximately 4.1 cc, greater than approximately 4.2 cc, greater than approximately 4.2 cc, greater than approximately 4.3 cc, greater than approximately 4.4 cc, greater than approximately 4.5 cc, greater than approximately 4.6 cc, greater than approximately 4.7 cc, greater than approximately 4.8 cc, greater than approximately 4.9 cc, or greater than approximately 5.0 cc.

The cavity 40180 is configured to receive the cavity insert 40185. The cavity insert 40885 comprises insert heel zone 40886, insert toe zone 40887, and insert center zone 40888 in the present embodiment, and is shaped complementarily to cavity 40180 such that insert center zone 40888 is thicker than either of insert heel zone 40886 or insert toe zone 40887. In the illustrated embodiment, insert heel and toe zones 40886 and 40887 are obtusely angled relative to each other along insert inner wall 40889 and about insert center zone 40888. Similarly, cavity inner section 40184 is obtusely angled complementarily to insert inner wall 40889. In the present example, cavity 40180 is configured such that insert 40885 is insertable in a top-to-sole direction with respect to club head 40000. There can also be examples where insert 40885 can be interchangeable with other inserts of similar shape. In some embodiments, the insert 40185 can comprise a shape that only partially occupies the cavity 40180, or the insert 40185 can comprise a shape that overfills the cavity 40180.

In the present embodiment, the insert 40185 comprises a shape that overfills the cavity 40180 near the back face 40860. In the illustrated embodiment, the insert 40185 extends past an opening of the cavity 40180 adjacent to the back face 40860 by a distance of approximately 0.15 inch (0.38 cm) to approximately 0.20 inch (0.51 cm). In other embodiments, the insert 40185 can extend past the cavity 40180 adjacent to the back face 40860 by a distance of approximately 0 inches to approximately 0.25 inch (0.64 cm). In many embodiments, the insert 40185 extending past the cavity adjacent to the strike face 40102 increases support to the strike face 40102 on impact with a golf ball. In some embodiments, a limit exists on the distance the insert 40185 extends past the cavity 40180 to increase support to the strike face 40102. For example, in the illustrated embodiment, an insert that extends greater than approximately 0.25 inch (0.64 cm) past the cavity 40180 does not further increase the support on the strike face 40102 during impact with a golf ball.

In many embodiments, the insert 40185 of the club head 40000 has increased contact area with the back face 40860 or cavity inner section 40184 compared to current designs. For example, in the illustrated embodiment, the contact area of the insert 40185 with the back face 40860 is approximately 1.0 $in^2$ (6.45 $cm^2$). In other embodiments, the contact area of the insert 40185 with the back face 40860 can be greater than approximately 0.9 $in^2$ (5.81 $cm^2$), greater than approximately 1.0 $in^2$ (6.45 $cm^2$), greater than approximately 1.1 $in^2$ (7.10 $cm^2$), greater than approximately 1.2 $in^2$ (7.74 $cm^2$), greater than approximately 1.3 $in^2$ (8.39 $cm^2$), greater than approximately 1.4 $in^2$ (9.03 $cm^2$), or greater than approximately 1.5 $in^2$ (9.68 $cm^2$). In many embodiments, the contact area of the insert 40185 with the back face 40860 comprises approximately 18%-25% of the surface area of the front face 40250. In other embodiments, the contact area of the insert 40185 with the back face 40860 can comprise 20%-45%, 20%-35%, 25%-40%, 25%-45%, or 30%-45% of the surface area of the front face 40250. For example, in some embodiments, the contact area of the insert 40185 with the back face 40860 comprises greater than approximately 18%, greater than approximately 19%, greater than approximately 20%, greater than approximately 21%, greater than approximately 22%, greater than approximately 23%, greater than approximately 24%, greater than approximately 25% of the surface area of the front face 40250.

Further, in many embodiments, the insert 40185 has increased contact area with the back surface of the cavity 40180 or cavity outer section 40885 compared to current designs. For example, in the illustrated embodiment, the contact area of the insert 40185 with the back surface is approximately 0.8 $in^2$ (5.16 $cm^2$). In other embodiments, the contact area of the insert 40185 with the back surface of the cavity 40180 can be greater than approximately 0.7 $in^2$ (4.52 $cm^2$), greater than approximately 0.8 $in^2$ (5.16 $cm^2$), greater than approximately 0.9 $in^2$ (5.81 $cm^2$), greater than approximately 1.0 $in^2$ (6.45 $cm^2$), greater than approximately 1.1 $in^2$ (7.10 $cm^2$), greater than approximately 1.2 $in^2$ (7.74 $cm^2$), greater than approximately 1.3 $in^2$ (8.39 $cm^2$), greater than approximately 1.4 $in^2$ (9.03 $cm^2$), or greater than approximately 1.5 $in^2$ (9.68 $cm^2$). In many embodiments, the contact area of the insert 40185 with the back surface of the cavity 40180 comprises approximately 16%-25% of the surface area of the front face 40250. For example, in some embodiments, the contact area of the insert 40185 with the back surface of the cavity 40180 comprises greater than approximately 16%, greater than approximately 17%, greater than approximately 18%, greater than approximately 19%, greater than approximately 20%, greater than approximately 21%, greater than approximately 22%, greater than approximately 23%, greater than approximately 24%, or greater than approximately 25% of the surface area of the front face 40250.

Increased contact area between the insert 40185 and the back face 40860 reduces vibrations of the club head 40000 to produce a better feel. Further, increased contact area between the insert 40185 and the back face 40860 of the club head 40000 increases the support of the strike face 40102 on impact with a golf ball. Increased support allows portions of the strike face 40102 to be thinned, thereby reducing club head weight, while maintaining durability. In the illustrated embodiment, the thinnest portion of the strike face 40102 is positioned in the toe zone 40108 and the heel zone 40107 of the strike face 40102 and has a thickness of approximately 0.075 inch (0.19 cm), measured as the minimum distance from the front face 40250 to the back face 40860 of the strike face 40102. In other embodiments, the thinnest portion of the strike face 40102 can have a thickness measured as the minimum distance from the front face 40250 to the back face 40860 of less than approximately 0.100 inch (0.25 cm), less than approximately 0.090 inch (0.23 cm), less than approximately 0.080 inch (0.20 cm), less than approximately 0.075 inch (0.19 cm), or less than approximately 0.070 inch (0.18 cm).

In these or other embodiments, the thickness of the strike face 40102 (i.e. thickness of central zone 40106, thickness of heel zone 40107, thickness of toe zone 40108, thickness of perimeter zone 40109, or thickness of thinnest portion of strike face 40102) can be reduced by up to approximately 30% compared to current club head designs. In some embodiments, the thickness of the strike face 40102 can be reduced by approximately 20%-25% compared to current club head designs. For example, in the illustrated embodiment, the thickness of the strike face 40102 is reduced by approximately 23% compared to current club head designs.

Reduced weight of the club head 40000 due to thinning of the strike face 40102 allows additional weight to be positioned on perimeter regions of the club head to increase the moment of inertia and forgiveness. In many embodiments, additional weight is positioned on at least one of a high toe region 40910, a low toe region 40912, or the heel region 40120 of the club head 40000.

For example, in the illustrated embodiment, approximately 13 grams to 15 grams of weight is repositioned from the strike face 40102 to the high toe region 40910 of the club head 40000. In other embodiments, approximately 10 grams to 100 grams of weight can be repositioned from the strike face 40102 to the high toe region 40910 of the club head 40000. For example, in some embodiments, approximately 10 grams, 20 grams, 30 grams, 40 grams, 50 grams, 60 grams, 70 grams, 80 grams, 90 grams, or 100 grams of weight can be can be repositioned from the strike face 40102 to the high toe region 40910 of the club head 40000.

For further example, in the illustrated embodiment, approximately 40 grams to 65 grams of weight is repositioned from the strike face 40102 to the low toe region 40912 of the club head 40000. In other embodiments, approximately 10 grams to 100 grams of weight can be repositioned from the strike face 40102 to the low toe region 40912 of the club head 40000. For example, in some embodiments, approximately 10 grams, 20 grams, 30 grams, 40 grams, 50 grams, 60 grams, 70 grams, 80 grams, 90 grams, or 100 grams of weight can be can be repositioned from the strike face 40102 to the low toe region 40912 of the club head 40000.

For further example, in the illustrated embodiment, approximately 65 grams to 85 grams of weight is repositioned from the strike face 40102 to the heel region 40120 of the club head 40000. In other embodiments, approximately 10 grams to 100 grams of weight can be repositioned from the strike face 40102 to the heel region 40120 of the club head 40000. For example, in some embodiments, approximately 10 grams, 20 grams, 30 grams, 40 grams, 50 grams, 60 grams, 70 grams, 80 grams, 90 grams, or 100 grams of weight can be can be repositioned from the strike face 40102 to the heel region 40120 of the club head 40000.

In many embodiments, repositioning weight from the strike face 40102 to the perimeter of the club head 40000 can increase the moment of inertia of the club head, thereby increasing club head forgiveness. Accordingly, in many embodiments, a low toe cavity and a low toe insert are not necessary to achieve or improve the desired club head performance characteristics. The club head 40000 described herein, devoid of a low toe cavity and a low toe insert, has increased moment of inertia compared to a similar club head having a low toe cavity and a low toe insert, without a thinned strike face.

For example, in the illustrated embodiment, the club head 40000 has a moment of inertia about an x-axis of approximately 80 grams·inches$^2$ (g·in$^2$) to 130 g·in$^2$ (516 grams·centimeter$^2$ to 839 g·cm$^2$). The x-axis extends through the head center of gravity from the heel region 40120 to the toe region 40110 of the club head. In these or other embodiments, the moment of inertia about the x-axis is approximately 2.0% to 8.5% greater than a similar club head having a low toe cavity and a low toe insert, without a thinned strike face. In other embodiments, the club head 40000 can have a moment of inertia about the x-axis greater than approximately 80 g·in$^2$ (516 g·cm$^2$). For example, the club head 40000 can have a moment of inertia about the x-axis greater than approximately 90 g·in$^2$ (581 g·cm$^2$), greater than approximately 100 g·in$^2$ (645 g·cm$^2$), greater than approximately 110 g·in$^2$ (710 g·cm$^2$), greater than approximately 120 g·in$^2$ (774 g·cm$^2$), or greater than approximately 130 g·in$^2$ (839 g·cm$^2$).

For further example, in the illustrated embodiment, the club head 40000 has a moment of inertia about a y-axis of approximately 390 grams·inches$^2$ (g·in$^2$) to 470 g·in$^2$ (2516 grams·centimeter$^2$ to 3032 g·cm$^2$). The y-axis extends through the head center of gravity from a top region to a bottom region of the club head 40000. In these or other embodiments, the moment of inertia about the y-axis is approximately 2.5% to 7.5% greater than a similar club head having a low toe cavity and a low toe insert, without a thinned strike face. In other embodiments, the club head 40000 can have a moment of inertia about the y-axis greater than approximately 350 g·in$^2$ (2258 g·cm$^2$). For example, the club head 40000 can have a moment of inertia about the y-axis greater than approximately 350 g·in$^2$ (2258 g·cm$^2$), greater than approximately 375 g·in$^2$ (2419 g·cm$^2$), greater than approximately 400 g·in$^2$ (2580 g·cm$^2$), greater than approximately 425 g·in$^2$ (2741 g·cm$^2$), greater than approximately 450 g·in$^2$ (2903 g·cm$^2$), greater than approximately 475 g·in$^2$ (3064 g·cm$^2$) or greater than approximately 500 g·in$^2$ (3226 g·cm$^2$).

In many embodiments, the cavity 40180 further comprises one or more ribs (not shown) corresponding to one or more grooves on the insert 40185. The one or more ribs can have a cross sectional shape corresponding to a cross sectional shape of the one or more grooves. The one or more ribs can be positioned on the cavity inner section 40184 or on the cavity outer section 40885. Further, the one or more grooves can be positioned on a side of the insert 40185 corresponding to the position of the one or more ribs. The one or more grooves can receive the one or more ribs on positioning the insert 40185 within the cavity 40180 to secure the insert 40185 within the cavity 40180. The insert 40185 can be positioned in the cavity 40180 with or without the use of epoxy or other bonding material.

The club head 40000 can be part of a set of club heads 45000 comprising two or more club heads having loft angles varying incrementally across the two or more club heads. For example, the set of golf club heads 45000 can include a first golf club head having a first loft angle and a second golf club head having a second loft angle, greater than the first loft angle. Further, one or more additional characteristics can vary across the two or more golf club heads within the set 45000, as described in further detail below.

In some embodiments, the surface area of the strike face 40102 can vary across the two or more golf club heads in the set 45000. In the illustrated embodiment, the surface area of the strike face 40102 increases with increasing loft angle within the set 45000. For example, the first golf club head has a first surface area, and the second golf club head has a second surface area greater than the first surface area.

In some embodiments, the width 40212 of the central support bar 40210 can vary across the two or more golf club heads in the set 45000. For example, the width 40212 of the central support bar 40210 can increase with increasing loft angle of one or more golf club heads within the set 45000. In these embodiments, the first golf club head can have a first width of the central support bar 40210 and the second golf club head can have a second width of the central support bar 40210 greater than the first width. For further example, the width 40212 of the central support bar 40210 can decrease with increasing loft angle of one or more golf club heads within the set 45000. In these embodiments, the first golf club head can have a first width of the central support bar 40210 and the second golf club head can have a second width of the central support bar 40210 less than the first width. In other embodiments, the width 40212 of the central support bar 40210 can remain substantially constant with increasing loft angle of one or more golf club heads within the set 45000.

In some embodiments, the thickness of the central support bar 40210 can vary across the two or more golf club heads in the set 45000. For example, the thickness of the central support bar 40210 can increase with increasing loft angle of one or more golf club heads within the set 45000. In these embodiments, the first golf club head can have a first thickness of the central support bar 40210 and the second golf club head can have a second thickness of the central support bar 40210 greater than the first thickness. For further example, the thickness of the central support bar 40210 can decrease with increasing loft angle of one or more golf club heads within the set 45000. In these embodiments, the first golf club head can have a first thickness of the central support bar 40210 and the second golf club head can have a second thickness of the central support bar 40210 less than the first thickness. In other embodiments, the thickness of the central support bar 40210 can remain substantially constant with increasing loft angle of one or more golf club heads within the set 45000.

In some embodiments, the height 40222 of the bottom support bar 40220 can vary across the two or more golf club heads in the set 45000. In some embodiments, the height 40222 of the bottom support bar 40220 can vary across the two or more golf club heads in the set 45000. For example, the height 40222 of the bottom support bar 40220 can increase with increasing loft angle of one or more golf club heads within the set 45000. In these embodiments, the first golf club head can have a first height of the bottom support bar 40220 and the second golf club head can have a second height of the bottom support bar 40220 greater than the first height. For further example, the height 40222 of the bottom support bar 40220 can decrease with increasing loft angle of one or more golf club heads within the set 45000. In these embodiments, the first golf club head can have a first height of the bottom support bar 40220 and the second golf club head can have a second height of the bottom support bar 40220 less than the first height. In other embodiments, the height 40222 of the bottom support bar 40220 can remain substantially constant with increasing loft angle of one or more golf club heads within the set 45000. In some embodiments, the thickness of the central support bar 40210 can vary across the two or more golf club heads in the set 45000

In some embodiments, the thickness of the bottom support bar 40220 can vary across the two or more golf club heads in the set 45000. For example, the thickness of the bottom support bar 40220 can increase with increasing loft angle of one or more golf club heads within the set 45000. In these embodiments, the first golf club head can have a first thickness of the bottom support bar 40220 and the second golf club head can have a second thickness of the bottom support bar 40220 greater than the first thickness. For further example, the thickness of the bottom support bar 40220 can decrease with increasing loft angle of one or more golf club heads within the set 45000. In these embodiments, the first golf club head can have a first thickness of the bottom support bar 40220 and the second golf club head can have a second thickness of the bottom support bar 40220 less than the first thickness. In other embodiments, the thickness of the bottom support bar 40220 can remain substantially constant with increasing loft angle of one or more golf club heads within the set 45000.

In some embodiments, the contact area of the insert 40185 with the back face 40860 or cavity inner section 40184 can vary across the two or more golf club heads in the set 45000. For example, the contact area of the insert 40185 with the back face 40860 can increase with increasing loft angle of one or more golf club heads within the set 45000. In these embodiments, the first golf club head can have a first contact area and the second golf club head can have a second contact area greater than the first contact area. For further example, the contact area of the insert 40185 with the back face 40860 can decrease with increasing loft angle of one or more golf club heads within the set 45000. In these embodiments, the first golf club head can have a first contact area and the second golf club head can have a second contact area less than the first contact area. In other embodiments, the contact area of the insert 40185 with the back face 40860 can remain substantially constant with increasing loft angle of one or more golf club heads within the set 45000.

In some embodiments, the contact area of the insert 40185 with the cavity outer section 40885 or back surface of the cavity 40180 can vary across the two or more golf club heads in the set 45000. For example, the contact area of the insert 40185 with the cavity outer section 40885 can increase with increasing loft angle of one or more golf club heads within the set 45000. In these embodiments, the first golf club head can have a first contact area and the second golf club head can have a second contact area greater than the first contact area. For further example, the contact area of the insert 40185 with the cavity outer section 40885 can decrease with increasing loft angle of one or more golf club heads within the set 45000. In these embodiments, the first golf club head can have a first contact area and the second golf club head can have a second contact area less than the first contact area. In other embodiments, the contact area of the insert 40185 with the cavity outer section 40885 can remain substantially constant with increasing loft angle of one or more golf club heads within the set 45000.

In some embodiments, the volume of the cavity 40180 can vary across the two or more golf club heads in the set 45000. For example, the volume of the cavity 40180 can increase with increasing loft angle of one or more golf club heads within the set 45000. In these embodiments, the first golf club head can have a first volume and the second golf club head can have a second volume greater than the first volume. For further example, the volume of the cavity 40180 can decrease with increasing loft angle of one or more golf club heads within the set 45000. In these embodiments, the first golf club head can have a first volume and the second golf club head can have a second volume less than the first volume. In other embodiments, the volume of the cavity 40180 can remain substantially constant with increasing loft angle of one or more golf club heads within the set 45000.

In some embodiments, the distance the insert 40185 extends past the cavity 40180 adjacent to the back face 40860 can vary across the two or more golf club heads in the set 45000. For example, the distance the insert 40185 extends past the cavity 40180 adjacent to the back face 40860 can increase with increasing loft angle of one or more golf club heads within the set 45000. In these embodiments, the first golf club head can have a first distance and the second golf club head can have a second distance greater than the first distance. For further example, the distance the insert 40185 extends past the cavity 40180 adjacent to the back face 40860 can decrease with increasing loft angle of one or more golf club heads within the set 45000. In these embodiments, the first golf club head can have a first distance and the second golf club head can have a second distance less than the first distance. In other embodiments, the distance the insert 40185 extends past the cavity 40180 adjacent to the back face 40860 can remain substantially constant with increasing loft angle of one or more golf club heads within the set 45000.

In some embodiments, the thickness of the strike face 40102 can vary across the two or more golf club heads in the set 45000. In these embodiments, the thickness of the strike face 40102 can indicate the strike face thickness in any zone including the central zone 40106, the heel zone 40107, the toe zone 40108, or the perimeter zone 40109. For example, the thickness of the strike face 40102 can increase with increasing loft angle of one or more golf club heads within the set 45000. In these embodiments, the first golf club head can have a first strike face thickness and the second golf club head can have a second strike face thickness greater than the first strike face thickness. For further example, the thickness of the strike face 40102 can decrease with increasing loft angle of one or more golf club heads within the set 45000. In these embodiments, the first golf club head can have a first strike face thickness and the second golf club head can have a second strike face thickness less than the first strike face thickness. In other embodiments, the thickness of the strike face 40102 can remain substantially constant with increasing loft angle of one or more golf club heads within the set 45000.

In some embodiments, the moment of inertia of the club head about the x-axis can vary across the two or more golf club heads in the set 45000. In the illustrated embodiment, the moment of inertia about the x-axis increases with increasing loft angle of one or more club heads in the set 45000. In these embodiments, first golf club head can have a first moment of inertia about the x-axis and the second golf club head can have a second moment of inertia about the x-axis greater than the first moment of inertia about the x-axis. In other embodiments, the moment of inertia about the x-axis can decrease with increasing loft angle of one or more club heads in the set 45000. In these embodiments, first golf club head can have a first moment of inertia about the x-axis and the second golf club head can have a second moment of inertia about the x-axis less than the first moment of inertia about the x-axis. Further, in other embodiments, the moment of inertia about the x-axis can remain substantially constant with increasing loft angle of one or more golf club heads within the set 45000.

In some embodiments, the moment of inertia of the club head about the y-axis can vary across the two or more golf club heads in the set 45000. In the illustrated embodiment, the moment of inertia about the y-axis increases with increasing loft angle of one or more club heads in the set 45000. In these embodiments, first golf club head can have a first moment of inertia about the y-axis and the second golf club head can have a second moment of inertia about the y-axis greater than the first moment of inertia about the y-axis. In other embodiments, the moment of inertia about the y-axis can decrease with increasing loft angle of one or more club heads in the set 45000. In these embodiments, first golf club head can have a first moment of inertia about the y-axis and the second golf club head can have a second moment of inertia about the x-axis less than the first moment of inertia about the y-axis. Further, in other embodiments, the moment of inertia about the y-axis can remain substantially constant with increasing loft angle of one or more golf club heads within the set 45000.

In some embodiments, the amount of weight repositioned from the strike face 40102 to perimeter regions of the club head (i.e. the high toe region 40910, the low toe region 40912 or the heel region 40120) can vary across the two or more golf club heads in the set 45000. For example, in the illustrated embodiment, the amount of weight repositioned from the strike face 40102 to the high toe region 40910 decreases with increasing loft angle of one or more club heads in the set 45000. In other embodiments, the amount of weight repositioned from the strike face 40102 to the high toe region 40910 can increase with increasing loft angle of one or more club heads in the set 45000, or the amount of weight repositioned from the strike face 40102 to the high toe region 40910 can remain substantially constant with increasing loft angle of one or more club heads in the set 45000.

For further example, in the illustrated embodiment, the amount of weight repositioned from the strike face 40102 to the low toe region 40912 increases with increasing loft angle of one or more club heads in the set 45000. In other embodiments, the amount of weight repositioned from the strike face 40102 to the low toe region 40912 can decrease with increasing loft angle of one or more club heads in the set 45000, or the amount of weight repositioned from the strike face 40102 to the low toe region 40912 can remain substantially constant with increasing loft angle of one or more club heads in the set 45000.

For further example, in the illustrated embodiment, the amount of weight repositioned from the strike face 40102 to the heel region 40120 increases with increasing loft angle of one or more club heads in the set 45000. In other embodiments, the amount of weight repositioned from the strike face 40102 to the heel region 40120 can decrease with increasing loft angle of one or more club heads in the set 45000, or the amount of weight repositioned from the strike face 40102 to the heel region 40120 can remain substantially constant with increasing loft angle of one or more club heads in the set 45000.

FIGS. 35-38 illustrate a golf club head 50000 of golf club head set 55000 according to an embodiment of the golf clubs and methods of manufacture described herein. Club head 50000 can be similar to club head 40000, and the golf club comprising the club head 50000 can be similar to a golf club comprising club head 40000. The club head 50000 comprises a body 50101 having a strike face 50102 with a front face 50250, a back face 50860 opposite the front face 50250, a toe region 50110, a heel region 50120 opposite the toe region 50110, a hosel 50105 at the heel region 50120, a sole region 50130, and a top region 50140 opposite the sole region 50130. The sole region 50130 may extend from the heel region 50120 to the toe region 50110, and the sole region 50130 may extend from the front face 50250 to a back sole edge 50165. The club head 50000 also comprises a back portion 50802 comprising back face 50860 and extending between toe region 50110 and heel region 50120 of the club head 50000. In other embodiments, the golf club head 50000 may have a bore (not shown), instead of the hosel 50105, at the heel region 50120.

Figure 35:
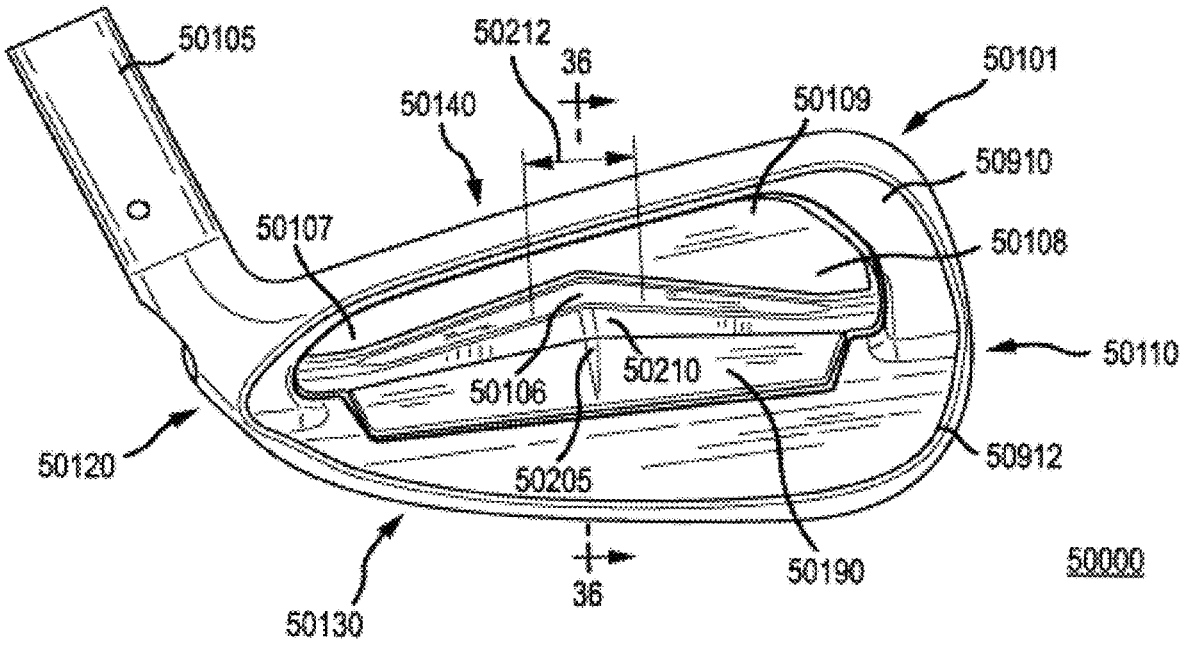
FIG. 35 illustrates a rear view of an exemplary golf club head according to an embodiment of the golf clubs and methods of manufacture described herein.

Referring to FIG. 35, the club head 50000 can further comprise a support structure protruding from back face 50860. The support structure can include a central support bar 50210. The central support bar 50210 can be positioned in the center region and extends from near the bottom of the strike face 50102 toward the top of the strike face 50102. In many embodiments, the central support bar 50210 can be continuous, discontinuous, or a combination thereof from near the bottom of the strike face 50102 toward the top of the strike face 50102. Further, the central support bar 50210 can include a width 50212 measured in a heel to toe direction of the club head 50000 (i.e. measured in a direction extending from the heel region 50120 to the toe region 50110). In the illustrated embodiment, the width 50212 of the central support bar 50210 increases from near the top region 50140 to near the sole region 50130 of the club head 50000. In other embodiments, the width 50212 of the central support bar 50210 may remain constant, or the width 50212 of the central support bar 50210 may taper such as decreasing from near the top region 50140 to near the sole region 50130 of the club head.

In the many embodiments, the central support bar 50210 can be integrally formed and can comprise substantially the same support bar thickness, as measured outward from the back face 50860. In some embodiments, the central support bar 50210 thickness tapers or otherwise varies along a length of a support bar.

In many embodiments, the central support bar 50210 can be integral with the back face 50860. For example, the central support bar 50210 can be cast, forged, or machined with the back face 50860. In other embodiments, the central support bar 50210 may not be integral with the backface 50860, but are securely attached thereto. In such examples, the central support bar 50210 can be welded, brazed, epoxied, or otherwise adhered to the back face 50860. The strike face 50102 of the club head 50000 includes a thickness measured as the perpendicular distance from the front face 50250 to the back face 50860. In the illustrated embodiment, the thickness of the strike face 50102 varies according to a strike face zone, as described below. In other embodiments, the thickness of the strike face 50102 may be substantially constant.

Figure 37:
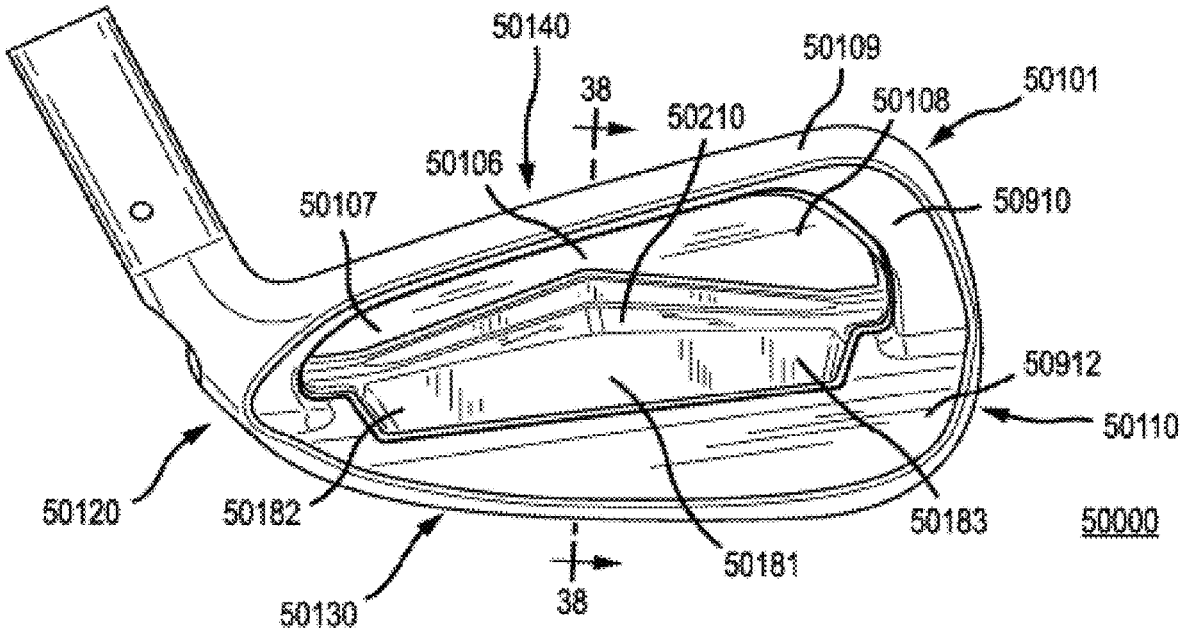
FIG. 37 illustrates a rear view of the golf club head of FIG. 35 without the insert.

Referring to FIGS. 35 and 37, the strike face 50102 can comprise a central zone 50106, a heel zone 50107, a toe zone 50108, and a perimeter zone 50109. The central zone 50106 can comprise a portion of the strike face 50102 reinforced by the central support bar 50210. The heel zone 50107 can comprise a portion of the strike face 50102 devoid of reinforcement from the support structure near the heel region 50120 of the club head 50000. The toe zone 50108 can comprise a portion of the strike face 50102 devoid of reinforcement from the support structure near the toe region 50110 of the club head 50000. The perimeter zone 50109 can comprise a portion of the club head 50000 surrounding the central zone 50106, the heel zone 50107, and the toe zone 50108.

In many embodiments, the thickness of the strike face 50102 in the heel zone 50107 can be approximately the same as the thickness of the strike face 50102 in the toe zone 50108. In many embodiments, the thickness of the strike face 50102 in the heel zone 50107 and the toe zone 50108 can be less than the thickness of the strike face 50102 in the central zone 50106, and the thickness of the strike face 50102 in the central zone 50106 can be greater than the thickness of the strike face 50102 in the perimeter zone 50109. The thickness of the strike face 50102 in the perimeter zone 50109 can be less than the thickness of the strike face 50102 in the heel zone 50107 and the toe zone 50108.

In many embodiments, the thickness of the strike face 50102 in the heel zone 50107 can range from 0.08 inch (0.20 cm) to 0.16 inch (0.41 cm). In some embodiments, the thickness of the strike face 50102 in the heel zone 50107 can range from 0.08 inch (0.20 cm) to 0.12 inch (0.30 cm), 0.07 inch (0.18 cm) to 0.15 inch (0.38 cm), 0.08 inch (0.20 cm) to 0.14 inch (0.36 cm), 0.09 inch (0.23 cm) to 0.13 inch (0.33 cm), or 0.12 inch (0.30 cm) to 0.16 inch (0.41 cm). For example, the thickness of the strike face 50102 in the heel zone 50107 can be 0.08 inch (0.20 cm), 0.09 inch (0.23 cm), 0.10 inch (0.25 cm), 0.11 inch (0.28 cm), 0.12 inch (0.30 cm), 0.13 inch (0.33 cm), 0.14 inch (0.36 cm), 0.15 inch (0.38 cm), or 0.16 inch (0.41 cm). In a exemplary embodiment, the thickness of the strike face 50102 in the heel zone 50107 can be 0.11 inch (0.28 cm).

In many embodiments, the thickness of the strike face 50102 in the toe zone 50108 can range from 0.08 inch (0.20 cm) to 0.16 inch (0.41 cm). In some embodiments, the thickness of the strike face 50102 in the toe zone 50108 can range from 0.08 inch (0.20 cm) to 0.12 inch (0.30 cm), 0.07 inch (0.18 cm) to 0.15 inch (0.38 cm), 0.08 inch (0.20 cm) to 0.14 inch (0.36 cm), 0.09 inch (0.23 cm) to 0.13 inch (0.33 cm), or 0.12 inch (0.30 cm) to 0.16 inch (0.41 cm). For example, the thickness of the strike face 50102 in the toe zone 50108 can be 0.08 inch (0.20 cm), 0.09 inch (0.23 cm), 0.10 inch (0.25 cm), 0.11 inch (0.28 cm), 0.12 inch (0.30 cm), 0.13 inch (0.33 cm), 0.14 inch (0.36 cm), 0.15 inch (0.38 cm), or 0.16 inch (0.41 cm). In a exemplary embodiment, the thickness of the strike face 50102 in the toe zone 50108 can be 0.11 inch (0.28 cm).

In many embodiments, the thickness of the strike face 50102 in the central zone 50106 can range from 0.08 inch (0.20 cm) to 0.16 inch (0.41 cm). In some embodiments, the thickness of the strike face 50102 in the central zone 50106 can range from 0.08 inch (0.20 cm) to 0.12 inch (0.30 cm), 0.07 inch (0.18 cm) to 0.15 inch (0.38 cm), 0.08 inch (0.20 cm) to 0.14 inch (0.36 cm), 0.09 inch (0.23 cm) to 0.13 inch (0.33 cm), or 0.12 inch (0.30 cm) to 0.16 inch (0.41 cm). For example, the thickness of the strike face 50102 in the central zone 50106 can be 0.08 inch (0.20 cm), 0.09 inch (0.23 cm), 0.10 inch (0.25 cm), 0.11 inch (0.28 cm), 0.12 inch (0.30 cm), 0.13 inch (0.33 cm), 0.14 inch (0.36 cm), 0.15 inch (0.38 cm), or 0.16 inch (0.41 cm). In a exemplary embodiment, the thickness of the strike face 50102 in the central zone 50106 can be 0.13 inch (0.33 cm).

In many embodiments, in the illustrated embodiment, the thickness of the strike face 50102 in the perimeter zone 50109 can range from 0.08 inch (0.20 cm) to 0.16 inch (0.41 cm). In some embodiments, the thickness of the strike face 50102 in the perimeter zone 50109 can range from 0.08 inch (0.20 cm) to 0.12 inch (0.30 cm), 0.07 inch (0.18 cm) to 0.15 inch (0.38 cm), 0.08 inch (0.20 cm) to 0.14 inch (0.36 cm), 0.09 inch (0.23 cm) to 0.13 inch (0.33 cm), or 0.12 inch (0.30 cm) to 0.16 inch (0.41 cm). For example, the thickness of the strike face 50102 in the perimeter zone 50109 can be 0.08 inch (0.20 cm), 0.085 inch (0.22 cm), 0.09 inch (0.23 cm), 0.10 inch (0.25 cm), 0.11 inch (0.28 cm), 0.12 inch (0.30 cm), 0.13 inch (0.33 cm), 0.14 inch (0.36 cm), 0.15 inch (0.38 cm), or 0.16 inch (0.41 cm). In a exemplary embodiment, the thickness of the strike face 50102 in the perimeter zone 50109 can be 0.10 inch (0.25 cm). In another exemplary embodiment, the thickness of the strike face 50102 in the perimeter zone 50109 can be 0.085 inch (0.22 cm).

In many embodiments, the thickness of the strike face 50102 can increase, decrease, or increase and decrease from the center zone 50106 to the perimeter zone 50109. In some embodiments, the thickness of the strike face can be uniform or non-uniform from the center zone 50106 to the perimeter zone 50109. The strike face 50102 can comprise a minimum thickness measured perpendicular from the front face 50250 to the back face 50860. In many embodiments, the minimum thickness of the strike face 50102 can be positioned in the upper region of the strike face 50102. The upper region can comprise a region of the strikeface 50102 above the central zone 50106 or between the central zone 50106 and the top end of the strikeface 50102. In many embodiments, the minimum thickness of the strike face 50102 can range from 0.08 inch (0.20 cm) to 0.16 inch (0.41 cm). In some embodiments, the minimum thickness of the strike face 50102 can range from 0.08 inch (0.20 cm) to 0.12 inch (0.30 cm), or 0.12 inch (0.30 cm) to 0.16 inch (0.41 cm). For example, the minimum thickness of the strike face 50102 can be 0.08 inch (0.20 cm), 0.085 inch (0.216 cm), 0.086 inch (0.218 cm), 0.087 inch (0.221 cm), 0.088 inch (0.224 cm), 0.089 inch (0.226 cm), 0.09 inch (0.23 cm), 0.10 inch (0.25 cm), 0.11 inch (0.28 cm), 0.12 inch (0.30 cm), 0.13 inch (0.33 cm), 0.14 inch (0.36 cm), 0.15 inch (0.38 cm), or 0.16 inch (0.41 cm). In a exemplary embodiment, the minimum thickness of the strike face 50102 can be 0.085 inch (0.216 cm).

The front face 50250 of the club head 50000 comprises a surface area. In many embodiments, the surface area of the front face 50250 can range from 4.0 to 10 $in^2$. In some embodiments, the surface area of the front face 50250 can range from 4.0 to 8.0 $in^2$, 4.0 to 6.0 $in^2$, 5.0 to 7.0 $in^2$, 6 to 9 $in^2$, or 8.0 to 10 $in^2$. For example, the surface area of the front face 50250 can be 4.0, 4.4, 4.8, 5.2, 5.6, 6.0, 6.4, 6.8, 7.2, 7.6, 8.0, 8.4, 8.8, 9.2, 9.6, or 10 $in^2$.

Figure 36:
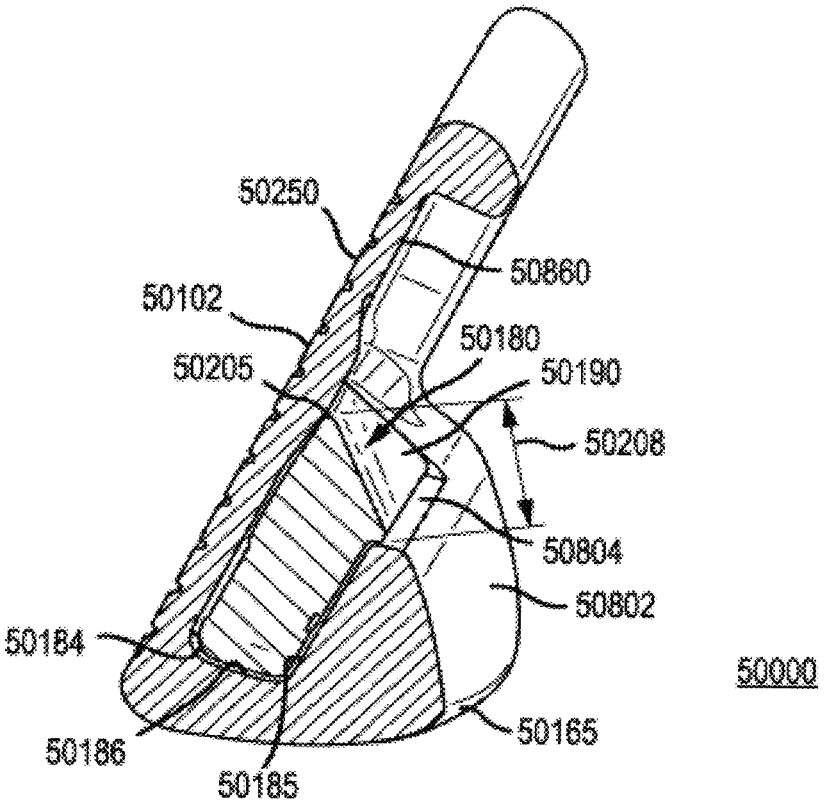
FIG. 36 illustrates a cross sectional view taken from a cross sectional line 36-36 of the golf club head of FIG. 35.
Figure 38:
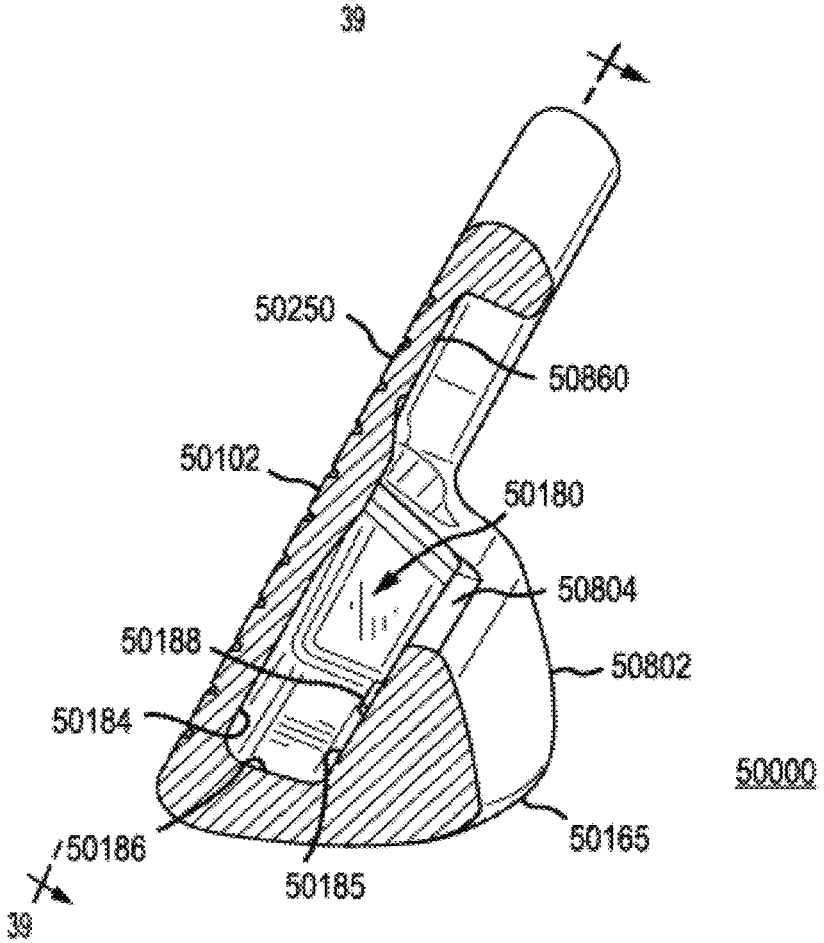
FIG. 38 illustrates a cross sectional view taken from a cross sectional line 38-38 of the golf club head of FIG. 37.

FIG. 36 illustrates a cross sectional view taken along the line 36-36 of the club head 50000 shown in FIG. 35. FIG. 38 illustrates a cross sectional view taken along the line 38-38 of the club head 50000 shown in FIG. 37. As illustrated in FIGS. 36 and 38, the golf club head 50000 can further comprise a cavity inner wall 50184, a cavity outer wall 50185 opposite the cavity inner wall 50184, a cavity bottom wall 50186 positioned between the cavity inner wall 50184 and the cavity outer wall 50185. The cavity inner wall 50184, the cavity outer wall 50185, and the cavity bottom wall 50186 together form a cavity 50180 configured to receive a insert 50190. The cavity inner wall 50184 forms a portion of a backface 50860. The cavity 50180 can comprise the cavity heel zone 50182, the cavity toe zone 50183, and the cavity center zone 50181. In many embodiments, the cavity 50180 can comprise a substantially constant width, measured from the front face 50250 to back portion 50802 direction, from the cavity heel zone 50182 to the cavity toe zone 50183. In other embodiments, the cavity 50180 can be wider at the cavity center zone 50181 than at either of the cavity heel zone 50182 or the cavity toe zone 50183.

Figure 39A:
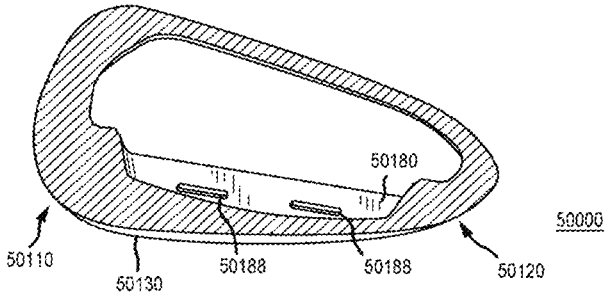
FIG. 39A illustrates a cross sectional view taken from a cross sectional line 39-39 of the golf club head of FIG. 38 without an insert.
Figure 39B:
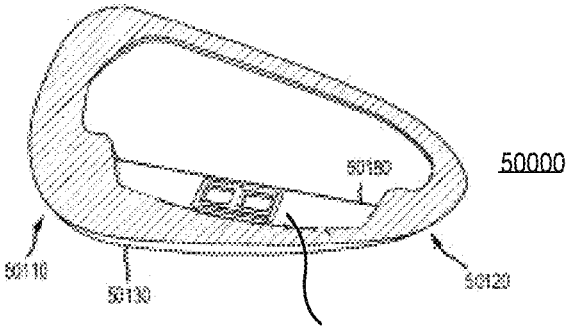
FIG. 39B illustrates a cross sectional view taken from a cross sectional line 39-39 of the golf club head of FIG. 38 without an insert, showing a cavity protrusion in a two-by-two grid.

In many embodiments, the cavity outer wall 50185 of the cavity 50180 can further comprise one or more protrusions 50188 extending into a portion of the cavity 50180, as illustrated in FIG. 38 and FIG. 39. In some embodiments, the one or more protrusions 50188 can be positioned centrally on the cavity outer wall 50185. In other embodiments, the one or more protrusions 50188 can be positioned near the cavity heel zone 50182 or near the cavity toe zone 50183. In some embodiments, the cavity outer wall 50185 can comprise one, two, three, four, five, six, seven, eight, or nine protrusions 50188. In these embodiments, the one or more protrusions 50188 can be spaced equidistant from one another; while in other embodiments, the one or more protrusions 50188 can be unevenly spaced any distance from one another. In other embodiments, the one or more protrusions 50188 can form a square grid-like structure (not shown). For example, the one or more protrusions 50188 can form a two by two square grid, or a three by three square grid. In an exemplary embodiment, the one or more protrusions 50188 can comprise two protrusions extending into a portion of the cavity 50190 that are spaced equidistant from one another. The one or more protrusions 50188 comprises a length extending from the cavity heel zone 50182 to cavity toe zone 50183 direction. In many embodiments, the length of the one or more protrusions 50188 can range from 0.2 to 0.8 inch. In some embodiments, the length of the one or more protrusions 50188 can range from 0.2 to 0.4 inch, or 0.4 to 0.8 inch. For example, the length of the one or more protrusions 50188 can be 0.2, 0.3, 0.4, 0.5, 0.6, 0.7, or 0.8 inch. The one or more protrusions 50188 comprises a width extending from the sole region 50130 to top region 50140 direction. In many embodiments, the width of the one or more protrusions 50188 can range from 0.2 inch to 0.8 inch. In some embodiments, the width of the one or more protrusions 50188 can range from 0.2 inch to 0.4 inch, or 0.4 inch to 0.8 inch. For example, the width of the one or more protrusions 50188 can be 0.2 inch, 0.3 inch, 0.4 inch, 0.5 inch, 0.6 inch, 0.7 inch, or 0.8 inch.

In many embodiments, the cavity 50180 comprises a volume ranging from 4 to 8 cubic centimeters (cc). In some embodiments, the cavity 50180 comprises a volume ranging from 4 to 6 cubic centimeters (cc), or 6 to 8 cubic centimeters (cc). For example, the cavity 50180 comprises a volume of 4, 4.5, 5.0, 5.5, 6.0, 6.5, 7.0, 7.5, or 8.0 cubic centimeters (cc). Referring to FIGS. 35 and 36, the cavity 50180 is configured to receive insert 50190. In many embodiments, the insert 50190 can be shaped complementarily to the cavity 50180. In many embodiments, the insert 50190 can be shaped complementarily to the continuous central support bar 50210. In many embodiments, the cavity 50180 can be configured such that insert 50190 is insertable in a top-to-sole direction with respect to club head 50000. There can also be examples where insert 50190 can be interchangeable with other inserts of similar shape. In some embodiments, the insert 50190 can comprise a shape that only partially occupies the cavity 50180. In other embodiments, the insert 50190 can comprise a shape that overfills the cavity 50180. In an exemplary embodiment, the insert 50190 can comprise a shape that overfills the cavity 50180 near the back portion 50802.

Figure 40:
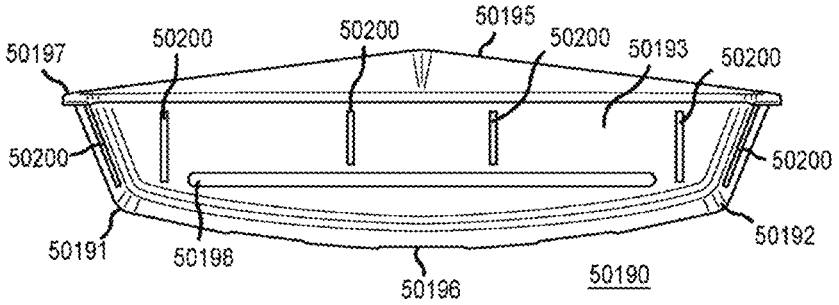
FIG. 40 illustrates a back view of an insert of the golf club head of FIG. 35, according to an embodiment.
Figure 41:
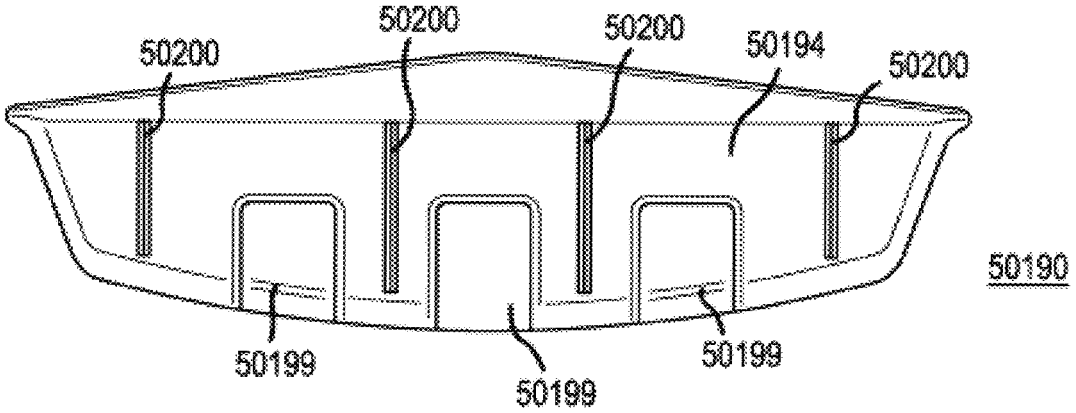
FIG. 41 illustrates a front perspective view of an insert of the golf club head of FIG. 35, according to an embodiment.

FIG. 40 and FIG. 41 illustrate the insert 50190. The insert 50190 can comprise a first end 50191 proximate the heel region 50120 of the golf club head 50000, a second end 50192 proximate the toe region 50110 of the golf club head 50000, a back surface 50193, a front surface 50194 opposite the back surface 50193, a top surface 50195, an apex 50205, and a bottom surface 50196 opposite the top surface 50195.

The insert 50190 can further comprise a lip 50197. In many embodiments, the lip 50197 can protrude from the top surface 50195 of the insert 50190. Further, the lip 50197 can extend perpendicular to the back surface 50193 of the insert 50190. In many embodiments, the lip 50197 can extend along a portion of the insert 50190 in a direction from the first end 50191 to the second end 50192. For example, the lip 50197 can extend along the back surface 50193, from the first end 50191 to the second end 50192 of the insert 50190. In other embodiments, the lip 50197 can extend along the front surface 50194 from the first end 50191 to the second end 50192. In other embodiments, the lip 50197 can extend along at least a portion of the front surface 50194, the back surface 50193, the first end 50191, the second end 50192, or any combination thereof. Further, in other embodiments, the lip 50197 can be continuous or discontinuous. In many embodiments, the top surface 50195 of the insert 50190 can increase upward from the lip 50197 to the apex 50205 of the insert 50190. When the insert 50190 is positioned within the cavity 50180, the lip 50197 of the top surface 50195 abuts against a top surface 50804 of the back portion 50802. The lip 50197 of the top surface 50804 of the back portion 50802 can act as a lever to remove the insert 50190 from the cavity 50180 during fittings or adjustments.

As illustrated in FIG. 40, the insert 50190 can comprise one or more grooves 50198 positioned centrally on the back surface 50193 of the insert 50190. In some embodiments, the one or more grooves 50198 can extend into a portion of the back surface 50193 of the insert 50190. In other embodiments, the one or more grooves 50198 can extend all the way through the insert 50190 from the back surface 50193 to the front surface 50194. The one or more grooves 50198 can extend in the direction of the first end 50191 to the second end 50192 of the insert 50190. The one or more grooves 50198 can be continuous or segmented from the first end 50191 to the second end 50192 of the insert 50190. The one or more grooves 50198 can comprise a first end proximate the first end 50191 of the insert 50190 and a second end proximate the second end 50192 of the insert 50190. The first end 50191 and the second end 50192 of the one or more grooves 50198 can comprise a rounded shape. In other embodiments, the first end 50191 and the second end 50192 of the one or more grooves 50198 can comprise any shape such as a square shape, a triangular shape, a trapezoidal shape, a polygonal shape, or any other suitable shape. In some embodiments, the insert 50190 can comprise one, two, three, four, five, six, seven, eight, or nine grooves 50198. The one or more grooves 50198 can be similar to the square grid-like structure of the one or more protrusions 50188 as described above. In an exemplary embodiment, the one or more grooves 50198 can comprise one continuous groove 50198 extending from the first end 50191 to the second end 50192 of the insert 50190.

As illustrated by way of example in FIG. 41, the insert 50190 can further comprise one or more recesses 50199 on the front surface 50194 of the insert 50190. In some embodiments, the one or more recesses 50199 can be positioned centrally on the front surface 50194 in between the first end 50191 and the second end 50192 of the insert 50190. In other embodiments, the one or more recesses 50199 can be positioned near the first end 50191 or near the second end 50192 of the insert 50190. In some embodiments, the insert 50190 can comprise one, two, three, four, five, or six recesses 50199. In these embodiments, the one or more recesses 50199 can be spaced equidistant from one another; while in other embodiments, the one or more recesses 50199 can be spaced any distance from one another. In these embodiments, the one or more recesses 50199 allows for a greater flow of an adhesive into the cavity 50180 and more adhesive to be positioned between the cavity 50180 and the insert 50190. The greater amount of adhesive positioned between the cavity 50180 and the insert 50190 allows for more surface area of the insert 50190 to couple with the cavity 50180. The greater adhesive surface area secures the insert 50190 within the cavity and prevents the insert 50190 from dislodging during use. The one or more grooves 50198, the one or more recesses 50199, and one or more ribs 50200 (as described below) together provide an optimal coupling of the surfaces of the insert 50190 within the cavity 50180. In an exemplary embodiment, the one or more recesses 50199 can comprise three recesses positioned centrally on the front surface 50194 of the insert 50190 that are spaced equidistant from one another.

The insert 50190 can further comprise one or more ribs 50200. The one or more ribs 50200 can be positioned on the back surface 50193 of the insert 50190. In other embodiments, the one or more ribs 50200 can be positioned on a front surface 50194 of the insert 50190, or on a combination of the back surface 50193, the first end 50191, the second end 50192, and the front surface 50194 of the insert 50190. In some embodiments, the one or more ribs 50200 can be positioned near the first end 50191 or near the second end 50192 on the insert 50190. Furthermore, the one or more ribs 50200 can be orientated perpendicular (straight up and down) relative to the top surface 50195 of the insert 50190. In other embodiments, the one or more ribs 50200 can be orientated at various angles relative to top surface 50195. In some embodiments, the insert 50190 can comprise one, two, three, four, five, six, seven, eight, nine, ten, eleven, or twelve ribs 50200. In some embodiments, the one or more ribs 50200 are oriented in the same direction. In other embodiments, the one or more ribs 50200 are oriented in different directions than the other one or more ribs 50200. In embodiments with more than one rib 50200, the ribs 50200 can be spaced equidistant from one another, or spaced any distance from one another. In some embodiments, an adhesive is applied within the cavity 50180 to help secure the insert 50190. The combination of the adhesive and the one or more ribs 50200 prevents the insert 50190 from shifting within the cavity 50180. In many embodiments, the one or more ribs 50200 allow for the insert 50190 to compress as it is being positioned within the cavity 50180.

Figure 42:
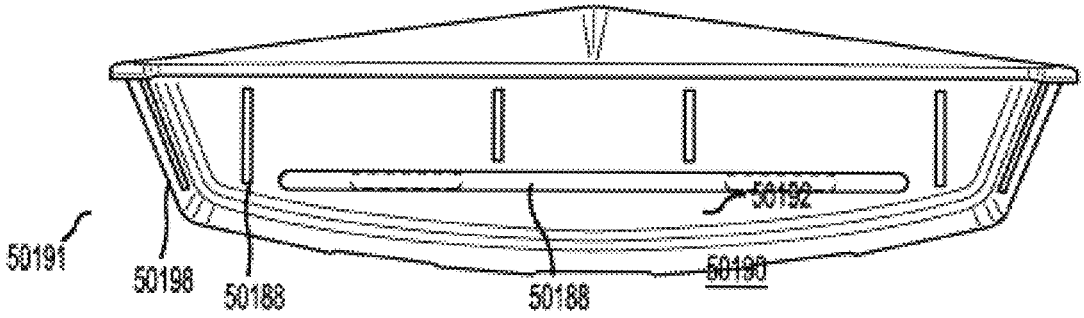
FIG. 42 illustrates a back view of an insert of the golf club head of FIG. 35, according to an embodiment.

When the cavity 50180 of the golf club head 50000 receives the insert 50190, the front surface 50194 of the insert 50190 presses against or abuts the cavity inner wall 50184 of the cavity 50180, the front surface 50194 of the insert 50190 abuts the continuous central support bar 50210, the back surface 50193 of the insert 50190 presses against or abuts the cavity outer wall 50185 of the cavity 50180, the bottom surface 50196 of the insert 50190 presses against or abuts with the cavity bottom wall 50186 of the cavity 50180, and the top surface 50195 of the insert 50190 forms a portion of the back portion 50802 of the golf club head 50000. As illustrated in FIG. 42, the one or more protrusions 50188 of the cavity outer wall 50185 are received by the one or more grooves 50198 of the insert 50190 to secure the insert 50190 into the cavity 50180. The one or more protrusions 50188 of the cavity outer wall 50185 and the one or more grooves 50198 of the insert 50190 have complementary geometries to allow for a mechanical interlock. In addition to the mechanical interlock between the one or more protrusions 50188, and the one or more grooves 50198, the insert 50190 can be secured within the cavity 50180 with a press-fit, a friction fit, an adhesive, or any combination thereof. In some embodiments, the insert 50190 can be secured within the cavity 50180 without the use of threads. The structural interlock between the one or more protrusions 50188 and the one or more grooves 50198 secures the insert into the cavity 50180, lowering the likelihood of the insert 50190 dislodging during use.

Further, when the cavity 50180 of the golf club head 50000 receives the insert 50190, the club head 50000 can comprise an insert height 50208. The insert height 50208 is measured from the top surface of the back portion 50804 to the apex 50205 of the insert 50190. The apex 50205 of the insert 50190 is the highest point on the top surface 50195 of the insert 50190. In many embodiments, the insert height 50208 of the club head 50000 can range from 0.10 to 0.75 inch. In some embodiments, the insert height 50208 of the club head 50000 can range from 0.10 to 0.25 inch, 0.25 to 0.50 inch, 0.25 to 0.40 inch, 0.30 to 0.45 inch, 0.4 to 0.60 inch, or 0.50 to 0.75 inch. For example, the insert height 50208 can be 0.10, 0.20, 0.25, 0.26, 0.27, 0.28, 0.29, 0.30, 0.31, 0.32, 0.33, 0.34, 0.35, 0.40, 0.50, 0.60, 0.70, or 0.75 inch. The insert height 50208 provides more contact area between the insert 50190 and the backface 50860 of the club head 50000. The increase in contact area between the insert 50190 and the backface 50860 provides more support behind the strike face 50102 to (1) increase strike face deflection while (2) reducing stress on the strike face during golf ball impacts as described below.

In many embodiments, the insert 50190 can comprise a mass. The mass of the insert 50190 can range from 0.50 to 36 grams, 0.50 to 30 grams, 0.50 to 25 grams, 0.50 to 20 grams, 0.50 to 15 grams, 0.50 to 10 grams, or 0.50 to 5 grams. For example, the mass of the insert 50190 can be 0.50 gram, 1 gram, 2 grams, 3 grams, 5 grams, 10 grams, 15 grams, 20 grams, 25 grams, 30 grams, or 36 grams.

In some embodiments, the insert 50190 can comprise a material denser than a material of the body of the golf club head 50000. In other embodiments, the material of insert 50190 can be the same density or less dense than the material of body of the golf club head 50000. In many embodiments, the elastically deformable material of the insert can comprise a polymer, a urethane material, a urethane-based material, an elastomer material, a thermoplastic material, other suitable types of material, a composite, or a combination thereof. In some embodiments, the material of the insert 50190 can comprise a thermoplastic elastomer, thermoplastic polyurethane, resin, or resin mixed with powdered metals. In some embodiments, the resin can comprise a thermoplastic elastomer, or thermoplastic polyurethane.

In embodiments where the insert 50190 comprises a resin mixed with powdered metals, the resin can comprise a mass. The mass of the resin can range from 0.5 to 8 grams. In some embodiments, the mass of the resin can range from 0.5 to 4 grams, or 4 to 8 grams. For example, the mass of the resin can be 0.5, 1, 2, 3, 4, 5, 6, 7, or 8 grams. The resin comprises a specific gravity ranging from 0.5 to 8 gm/cc. In some embodiments, the specific gravity can range from 0.5 to 4 gm/cc, or 4 to 8 gm/cc. For example, the specific gravity of the resin can be 0.5, 1, 2, 3, 4, 5, 6, 7, or 8 gm/cc. In some embodiments, the specific gravity of the resin is proportional to the mass of the resin, wherein 1 specific gravity of the resin is equal to 1 gram, 2 specific gravity of the resin is equal to 2 grams and etc.

In these embodiments, the powdered metal can comprise steel, stainless steel, tungsten, or other metals. In these embodiments, the resin mixed with powdered metals forms the insert 50190 described above. In some embodiments, the insert 50190 can comprise one powdered metal. In other embodiments, the insert 50190 can comprise multiple types of powdered metals. For example, the insert 50190 can comprise the resin and the stainless steel powdered metal, the resin and the tungsten powdered metal, or the resin, the stainless steel powdered metal, and the tungsten powdered metal. The insert 50190 can further comprise a percentage of powdered metal by volume. The insert 50190 can comprise 0% to 50% powdered metal by volume. In some embodiments, the insert 50190 can comprise 0% to 10%, 10% to 20%, 20% to 30%, 30% to 40%, or 40% to 50% powdered metal by volume. For example, the insert 50190 can comprise 0%, 1%, 10%, 20%, 30%, 40%, or 50% powdered metal by volume. The powdered metal percentage varies approximately linearly with the mass of the insert 50190. As the mass of the insert 50190 increases, the powdered metal percentage increases.

In many embodiments, the material of the insert 50190 can dampen vibrations on the golf club head 50000 after impact of a golf ball on the strikeface 50102, which can improve feel and sound. In many embodiments, the hardness of the insert 50190 can range from Shore A 10 to Shore A 55. In some embodiments, the hardness of the insert 50190 can range from Shore A 10 to Shore A 25, Shore A 15 to Shore A 25, Shore A 20 to Shore A 30, Shore A 25 to Shore A 35, Shore A 25 to Shore A 40, or Shore A 40 to Shore A 55. For example, the hardness of the insert 50190 can have a Shore A value of 10, 15, 25, 30, 35, 40, 45, 50, or 50.

In many embodiments, the insert 50190 of the club head has increased contact area with the back face 50860 or cavity inner wall 50184 compared to other golf club heads with inserts. The contact area of the insert 50190 with the back face 50860 can range from 1.0 $in^2$ to 3.0 $in^2$. In some embodiments, the contact area of the insert 50190 with the back face 50860 can range from 1.0 $in^2$ to 2.0 $in^2$, or 2.0 $in^2$ to 3.0 $in^2$. For example, the contact area of the insert 50190 with the back face 50860 can be 1.0 $in^2$, 1.5 $in^2$, 2.0 $in^2$, 2.5 $in^2$, or 3.0 $in^2$. In many embodiments, the contact area of insert 50190 with the back face 50860 can range from 20% to 35% of the surface area of the front face 50250. The surface area of the front face 50250 is described above. In some embodiments, the contact area of the insert 50190 with the back face 50860 can range from 20% to 25%, 25% to 30%, or 30% to 35% of the surface area of front face 50250. For example, the contact area of the insert 50190 with the back face 50860 can be 20%, 21%, 22%, 23%, 24%, 25%, 26%, 27%, 28%, 29%, 30%, 31%, 32%, 33%, 34%, or 35% of the surface area of the front face 50250.

Further, in many embodiments, insert 50190 has increased contact area with the cavity outer wall 50185 of the cavity 50180 compared to current designs. In many embodiments, the contact area of insert 50190 with the cavity outer wall 50185 can range from 0.5 $in^2$ to 1.5 $in^2$. In some embodiments, the contact area of insert 50190 with the cavity outer wall 50185 can range from 0.5 $in^2$ to 1 $in^2$, or 1 $in^2$ to 1.5 $in^2$. For example, the contact area of insert 50190 with the cavity outer wall 50185 can be 0.5 $in^2$, 1 $in^2$, 1.5 $in^2$. In many embodiments, the contact area of insert 50190 with the cavity outer wall 50185 can range from 10% to 25% of the surface area of front face 50250. In some embodiments, the contact area of insert 50190 with the cavity outer wall 50185 can range from 10% to 15%, 15% to 20%, or 20% to 25% of the surface area of front face 50250. For example, the contact area of insert 50190 with the cavity outer wall 50185 can be 10%, 12%, 14%, 16%, 18%, 20%, 21%, 22%, 23%, 24%, or 25% of the surface area of front face 50250.

The insert 50190 can comprise a lower hardness compared to other golf club heads with inserts provided within the cavity. The lower hardness provides less support on the backface 50860 and maximizes the strike face deflection after impacts of the golf ball. Further, the increased contact area between the insert 50190 and the backface 50860 provides more support to the backface 50860 during impacts of the golf ball to offset the structural support losses from the lower hardness of the insert 50190. In addition, the insert height 50208 height balances the amount of strike face deflection and stress the club head 50000 experiences during golf ball impacts by increasing the amount of insert 50190 surface area on the back face 50860. The increased contact area allows portions of the strike face 50102 to be thinned, thereby reducing the club head weight, while maintaining durability. The combination of the lower hardness, the increased contact area between the insert 50190 and the backface 50860, and the thinned strikeface 50102 provides more strike face deflection over other golf club head with inserts provided within the cavity. In these embodiments, the strikeface deflection can range from 0.012 inch to 0.020 inch. In some embodiments, the strikeface deflection can range from 0.012 inch to 0.016 inch, or 0.016 inch to 0.020 inch. For example, the strikeface deflection can be 0.012 inch, 0.013 inch, 0.014 inch, 0.015 inch, 0.016 inch, 0.017 inch, 0.018 inch, 0.019 inch, or 0.020 inch Reducing the weight of the club head 50000 due to thinning of strike face 50102 allows additional weight to be positioned on perimeter regions of the club head 50000 to increase the moment of inertia and forgiveness. In many embodiments, additional weight can be positioned on at least one of a high toe region 50110, a low toe region 50110, or the heel region 50120 of the club head.

In many embodiments, approximately 35 grams to 45 grams of weight can be repositioned from strike face 50102 to the high toe region 50910 of the club head 50000. In other embodiments, approximately 10 grams to 100 grams of weight can be repositioned from strike face 50102 to the high toe region 50910 of the club head 50000. For example, in some embodiments, approximately 10 grams, 20 grams, 30 grams, 40 grams, 50 grams, 60 grams, 70 grams, 80 grams, 90 grams, or 100 grams of weight can be can be repositioned from strike face 50102 to the high toe region 50910 of the club head 50000.

In many embodiments, approximately 80 grams to 120 grams of weight can be repositioned from strike face 50102 to the low toe region 50912 of the club head 50000. In other embodiments, approximately 10 grams to 150 grams of weight can be repositioned from strike face 50102 to the low toe region 50912 of the club head 50000. For example, in some embodiments, approximately 10 grams, 20 grams, 30 grams, 40 grams, 50 grams, 60 grams, 70 grams, 80 grams, 90 grams, 100 grams, 110 grams, 120 grams, 130 grams, 140 grams, or 150 grams of weight can be can be repositioned from strike face 50102 to the low toe region 50912 of the club head 50000.

In many embodiments, approximately 55 grams to 85 grams of weight can be repositioned from strike face 50102 to the heel region 50120 of the club head 50000. In other embodiments, approximately 10 grams to 100 grams of weight can be repositioned from strike face 50102 to the heel region 50120 of the club head 50000. For example, in some embodiments, approximately 10 grams, 20 grams, 30 grams, 40 grams, 50 grams, 60 grams, 70 grams, 80 grams, 90 grams, or 100 grams of weight can be can be repositioned from strike face 50102 to the heel region 50120 of the club head 50000.

In many embodiments, repositioning weight from strike face 50102 to the perimeter of the club head can increase the moment of inertia of the club head 50000, thereby increasing club head forgiveness. Accordingly, in many embodiments, a low toe cavity and a low toe insert are not necessary to achieve or improve the desired club head performance characteristics. The club head described herein, devoid of a low toe cavity 50180 and a low toe insert, has increased moment of inertia compared to a similar club head having a low toe cavity and a low toe insert, without a thinned strike face 50102.

In many embodiments, the club head 50000 has a moment of inertia about an x-axis ranging from 80 grams·inches$^2$ (g·in$^2$) to 160 g·in$^2$ (516 grams·centimeter$^2$ to 1032 g·cm$^2$). The x-axis extends through the head center of gravity from the heel region 50120 to the toe region 50110 of the club head 50000. In these or other embodiments, the moment of inertia about the x-axis is approximately 2.0% to 10% greater than a similar club head having a low toe cavity and a low toe insert, without a thinned strike face. In other embodiments, the club head 50000 can have a moment of inertia about the x-axis ranging from 80 g·in$^2$ (516 g·cm$^2$) to 120 g·in$^2$ (774 g·cm$^2$), 120 g·in$^2$ (774 g·cm$^2$) to 140 g·in$^2$ (903 g·cm$^2$), or 140 g·in$^2$ (903 g·cm$^2$) to 160 g·in$^2$ (1032 g·cm$^2$). For example, the moment of inertia about the x-axis can be 80 g·in$^2$ (516 g·cm$^2$), 100 g·in$^2$ (645 g·cm$^2$), 120 g·in$^2$ (774 g·cm$^2$), 140 g·in$^2$ (903 g·cm$^2$), or 160 g·in$^2$ (1032 g·cm$^2$).

In many embodiments, the club head 50000 has a moment of inertia about a y-axis of approximately 390 grams·inches$^2$ (g·in$^2$) to 500 g·in$^2$ (2516 grams·centimeter$^2$ to 3226 g·cm$^2$). The y-axis extends through the head center of gravity from a top region 50140 to a sole region 50130 of the club head 50000. In these or other embodiments, the moment of inertia about the y-axis is approximately 2.0% to 10% greater than a similar club head having a low toe cavity and a low toe insert, without a thinned strike face. In other embodiments, the club head 50000 can have a moment of inertia about the y-axis ranging from 390 g·in$^2$ (2516 g·cm$^2$) to 420 g·in$^2$ (2710 g·cm$^2$), 420 g·in$^2$ (2710 g·cm$^2$) to 460 g·in$^2$ (2968 g·cm$^2$), or 460 g·in$^2$ (2968 g·cm$^2$) to 500 g·in$^2$ (3226 g·cm$^2$). For example, the moment of inertia about the y-axis can be 390 g·in$^2$ (2516 g·cm$^2$), 410 g·in$^2$ (2645 g·cm$^2$), 420 g·in$^2$ (2710 g·cm$^2$), 430 g·in$^2$ (2774 g·cm$^2$), 440 g·in$^2$ (2839 g·cm$^2$), 450 g·in$^2$ (2903 g·cm$^2$), 460 g·in$^2$ (2968 g·cm$^2$), 470 g·in$^2$ (3032 g·cm$^2$), 480 g·in$^2$ (3097 g·cm$^2$), 490 g·in$^2$ (3161 g·cm$^2$), or 500 g·in$^2$ (3226 g·cm$^2$).

The club head 50000 can be part of a set of club heads 55000 comprising two or more club heads having loft angles varying incrementally across the two or more club heads. For example, the set of golf club heads 55000 can include a first golf club head having a first loft angle and a second golf club head having a second loft angle, greater than the first loft angle. Further, one or more additional characteristics can vary across the two or more golf club heads within the set 55000, as described in further detail below.

In many embodiments, the parameters of the club head 50000 described above can vary across the two or more golf club heads in the set 55000, similar to the variability of the parameters of the club head 40000 across two or more golf club heads in the set 45000.

EXAMPLE

An exemplary club head 50000 comprising an insert 50190 having an insert height 50208 was compared to a similar control club head using finite element analysis to simulate impact deflection profiles of the strike face. The insert height directly relates to the contact area between the back face and the insert. As the insert height increases, the contact area between the back face and the insert increases. The contact area between the back face and the insert provides support behind the strike face during golf ball impacts. Further, the hardness of the insert contributes to the strike face deflection. The softer insert allows the strike face to deflect more during golf ball impacts compared to harder inserts. The exemplary club head 50000 has a insert height 50208 of 0.3 inch, a contact area between the insert 50190 and the back face 50860 of 1.218 in$^2$, and a hardness of Shore A 30. The control golf club has a insert height of 0.168 inch, a contact area between the insert and the back face of 1.01 in$^2$, and a hardness of Shore A 60.

When a golf ball strikes the surface of the strike face, the control club head deflects 0.013 inch, whereas the exemplary club head 50000 deflects 0.016 inch. The smaller insert height, the smaller contact area between the insert and back face, and higher hardness of the control club head results in less strike face deflection than the exemplary club head 50000. The combination of the larger insert height increasing the contact area between the insert and the back face, and the lower hardness of the insert of the exemplary club head 50000 together are advantageous over the control club head to increase the deflection of the strike face while reducing stress on the strike face during golf ball impacts. The increase in deflection equates to increases in ball performance. A golf ball that impacts the exemplary club head 50000 experiences a 0.4 mph increase in ball speed and a 4 yard increase in carry distance over the control club head.

The club head sets with varying characteristics and related methods discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment, and may disclose additional embodiments.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:

a top region;

a sole region opposite the top region;

a toe region;

a heel region opposite the toe region;

a front face and a back face;

wherein the sole region extends from the heel region to the toe region and from the front face to the back face;

a back portion wherein the back portion comprises the back face extending between the toe region and the heel region; and wherein the back portion further comprises a back portion top surface;

a support structure having a continuous central support bar;

wherein the central support bar comprises a width measured in a heel region to toe region direction; and wherein the width of the central support bar increases from near the top region to near the sole region;

a strike face having a front face and a back face opposite the front face, and a non-uniform thickness;

a cavity configured to receive an insert, wherein a contact area of the insert with the back face comprises 20% 40% of a surface area of the front face; and the insert is shaped complementarily to the continuous central support bar; and wherein the insert further comprises a shape that occupies the cavity such that the insert overfills the cavity;

wherein the insert comprises an insert height measured from a top surface of an insert back portion to an apex of the insert;

wherein the insert height is in a range from 0.10 to 0.75 inch;

the cavity comprises:

a cavity inner wall;

a cavity outer wall;

a cavity bottom wall;

a cavity heel zone;

a cavity toe zone; and a cavity center zone;

wherein:

the cavity outer wall comprises a plurality of protrusions extending into a portion of the cavity;

the insert comprises:

an insert back surface positioned to be adjacent to the cavity outer wall of the golf club head, the insert back surface comprising a plurality of grooves configured to receive the plurality of protrusions on the cavity outer wall; and the insert back surface further comprises one or more ribs;

an insert front surface opposite the insert back surface positioned to be adjacent to the cavity inner wall of the golf club head; and the insert front surface further comprising three recesses and one or more ribs;

an insert bottom surface;

an insert top surface opposite the insert bottom surface;

wherein the insert further comprises a first end, a second end, and a lip extending outward past the insert back surface;

wherein the each of the first end and second end are surfaces connecting the insert front surface and the insert back surface;

wherein the first end and the second end each further comprise a rib having a length extending from towards the insert top surface towards the insert bottom surface;

wherein the lip extends along the insert first end, the insert back surface, and the insert second end;

wherein the lip extends approximately perpendicular to the insert back surface; and wherein the lip abuts against the back portion top surface;

wherein the insert top surface increases upward from the lip of the insert to an apex of the insert;

wherein the plurality of grooves extend from proximate the insert first end to proximate the insert second end;

an elastically deformable material; and a hardness between approximately Shore A 10 to approximately Shore A 55;

wherein a portion of the insert is secured within the cavity by a combination of an adhesive and a mechanical interlock between the one or more protrusions and the plurality of grooves;

wherein the three recesses are spaced equidistantly;

wherein the three recesses allow for more adhesive to be positioned between the cavity and the insert.

2. The golf club head of claim 1, wherein the central support bar has a width that increases from near the top region to near the sole region.

3. The golf club head of claim 1, wherein the strike face further comprises:

a central zone comprising a portion of the strike face reinforced by the central support bar;

a heel zone comprising a portion of the strike face devoid of reinforcement from the support structure near the heel region of the club head;

a toe zone comprising a portion of the strike face devoid of reinforcement from the support structure near the toe region of the club head; and a perimeter zone comprising a portion of the strike face surrounding the central zone, the heel zone, and the toe zone;

wherein:

the thickness of the strike face in the heel zone is approximately the same as the thickness of the strike face in the toe zone, the thickness of the strike face in the heel zone and the toe zone is less than the thickness of the strike face in the central zone, and the thickness of the strike face in the central zone is greater than the thickness of the strike face in the perimeter zone.

4. The golf club head of claim 1, wherein the strike face comprises a thickness ranging from 0.08 inch to 0.16 inch.

5. The golf club head of claim 1, wherein an insert height measured from a top surface of a back portion to an apex of the insert ranges from 0.15 inch to 0.40 inch.

6. The golf club head of claim 1, wherein a moment of inertia about an x-axis extending through a center of gravity of the club head from the heel region to the toe region is greater than or equal to 80 $g \cdot in^2$.

7. The golf club head of claim 1, wherein a moment of inertia about a y-axis extending through a center of gravity of the club head from the top region to the sole region is greater than or equal to 380 $g \cdot in^2$.

8. The golf club head of claim 1, wherein the insert abuts the continuous central support bar.

9. The golf club head of claim 1, wherein the elastically deformable material of the insert comprises a resin mixed with a powdered metal.

10. The golf club head of claim 1, wherein the contact area of the insert with the back face comprises 25%-45% of the surface area of the front face.

11. The golf club head of claim 1, wherein the contact area of the insert with the back face comprises 30%-45% of the surface area of the front face.

12. A golf club head comprising:

a top region;

a sole region opposite the top region;

a toe region;

a heel region opposite the toe region;

a front face and a back face;

wherein the sole region extends from the heel region to the toe region and from the front face to the back face;

a back portion wherein the back portion comprises the back face extending between the toe region and the heel region; and wherein the back portion further comprises a back portion top surface;

a support structure having a continuous central support bar;

a strike face having a front face and a back face opposite the front face, and a non-uniform thickness;

a cavity configured to receive an insert, wherein a contact area of the insert with the back face comprises 20%-40% of a surface area of the front face;

the insert is shaped complementarily to the continuous central support bar;

the insert abuts the continuous central support bar;

the cavity comprises:

a cavity inner wall;

a cavity outer wall;

a cavity bottom wall;

a cavity heel zone;

a cavity toe zone; and a cavity center zone;

wherein:

the cavity outer wall comprises a plurality of protrusions extending into a portion of the cavity;

the insert comprises:

a first end;

a second end;

an insert back surface positioned to be adjacent to the cavity outer wall of the golf club head, the insert back surface comprising a plurality of grooves configured to receive the plurality of protrusions on the cavity outer wall; and the back surface further comprises one or more ribs;

an insert front surface opposite the insert back surface positioned to be adjacent to the cavity inner wall of the golf club head; and the insert front surface further comprising three recesses and one or more ribs;

an insert bottom surface;

an insert top surface opposite the insert bottom surface;

wherein the first end and the second each further comprise a rib;

wherein the each of the first end and second end are surfaces connecting the insert front surface and the insert back surface;

a lip extending along the insert first end of the insert, the insert back surface of the insert, and the insert second end;

wherein the lip extends along the insert first end, the insert back surface, and the insert second end;

wherein the lip is approximately perpendicular to the insert back surface; and wherein the lip abuts against the back portion top surface; and wherein the insert further comprises a shape that occupies the cavity such that the insert overfills the cavity;

wherein the insert comprises an insert height measured from a top surface of a back portion of the insert to an apex of the insert;

wherein the insert height is in a range from 0.10 to 0.75 inch;

wherein the plurality of grooves extend from proximate the insert first end to proximate the insert second end;

an elastically deformable material; and a hardness between approximately Shore A 10 to approximately Shore A 55;

wherein:

the top surface of the insert increases upward from the lip of the insert to the apex of the insert;

wherein a portion of the insert is secured within the cavity by a combination of an adhesive and a mechanical interlock between the plurality of protrusions and the plurality of grooves;

wherein the three recesses are spaced equidistantly;

wherein the three recesses allow for more adhesive to be positioned between the cavity and the insert.

13. The golf club head of claim 12, wherein the central support bar has a width that increases from near the top region to near the sole region.

14. The golf club head of claim 12, wherein an insert height measured from a top surface of a back portion to the apex of the insert ranges from 0.15 inch to 0.40 inch.

15. The golf club head of claim 12, wherein the strike face comprises a thickness ranging from 0.08 inch to 0.16 inch.

16. The golf club head of claim 12, wherein the contact area of the insert with the back face comprises 25%-45% of the surface area of the front face.

17. The golf club head of claim 12, wherein the contact area of the insert with the back face comprises 30%-45% of the surface area of the front face.

18. The golf club head of claim 12, wherein the elastically deformable material of the insert comprises a resin mixed with a powdered metal.

19. The golf club head of claim 18, wherein the insert comprises 1% to 30% powdered metal by volume.

* * * * *